US012736294B2

(12) United States Patent
Underwood et al.

(10) Patent No.: US 12,736,294 B2
(45) **Date of Patent: *Sep. 15, 2026**

(54) ROLLER DELAYED FIREARM OPERATING SYSTEM

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 56 days.

This patent is subject to a terminal disclaimer.

(21) Appl. No.: 18/917,430

(22) Filed: Oct. 16, 2024

(65) Prior Publication Data

US 2026/0110505 A1 Apr. 23, 2026

Related U.S. Application Data

(63) Continuation of application No. 18/242,910, filed on Sep. 6, 2023, now Pat. No. 12,146,717, which is a continuation of application No. 17/741,004, filed on May 10, 2022, now Pat. No. 11,781,824, which is a continuation of application No. 16/987,204, filed on Aug. 6, 2020, now Pat. No. 11,371,789.

(60) Provisional application No. 63/048,057, filed on Jul. 3, 2020, provisional application No. 62/883,309, filed on Aug. 6, 2019.

(51) Int. Cl.
*F41A 3/46* (2006.01)

(52) U.S. Cl.
CPC ..... *F41A 3/46* (2013.01)

(58) Field of Classification Search
CPC ..... F41A 3/46; F41A 3/44; F41A 3/36; F41A 3/38; F41A 3/40
USPC ..... 89/194
See application file for complete search history.

(56) References Cited

U.S. PATENT DOCUMENTS

| | | | | |
|---|---|---|---|---|
| 1,085,698 A | | 2/1914 | Nelson | |
| 1,168,024 A | | 1/1916 | Nelson | |
| 1,349,345 A | | 8/1920 | Payne | |
| 1,365,355 A | * | 1/1921 | Taliaferro | F41A 3/64 42/16 |
| 2,089,671 A | | 8/1937 | Stecke | |
| 2,182,693 A | | 12/1939 | Harton | |
| 2,370,189 A | * | 2/1945 | Penney | F41A 3/40 89/190 |
| 2,651,974 A | | 9/1953 | Simpson | |
| 2,691,232 A | | 10/1954 | Hoopes | |

(Continued)

FOREIGN PATENT DOCUMENTS

| | | |
|---|---|---|
| DE | 1242477 B | 6/1967 |
| DE | 3627573 A1 | 2/1988 |
| WO | 2005108900 A1 | 11/2005 |

*Primary Examiner* — John Cooper

(57) ABSTRACT

An operating system for a firearm includes a forward bolt includes a forward bolt cavity, a carrier disposed on a rear side of the forward bolt, the carrier including a carrier cavity, a short cam pin including (i) a forward section that is at least partially disposed within the forward bolt cavity and (ii) a rear section that is at least partially disposed within the carrier cavity, a plurality of bearings that interface with the forward bolt, a retracted configuration where the short cam pin is in a rear position relative to the forward bolt, and a deployed configuration where the short cam pin is in a forward position relative to the forward bolt.

20 Claims, 42 Drawing Sheets

(56) References Cited

U.S. PATENT DOCUMENTS 2,717,535 A * 9/1955 Taylor ..... F41A 3/26 89/184
2,978,826 A 4/1961 Ivy
3,101,648 A 8/1963 Walther
3,283,435 A 11/1966 Koch
3,415,000 A 12/1968 Koucky et al.
3,540,147 A 11/1970 Cream et al.
3,715,826 A 2/1973 Seifried
3,848,510 A 11/1974 Wolpert
4,031,648 A 6/1977 Thomas
4,246,830 A 1/1981 Krieger
4,420,899 A 12/1983 Bourlet et al.
4,521,985 A 6/1985 Smith et al.
4,549,465 A 10/1985 Charron
4,594,935 A 6/1986 Smith
4,619,062 A 10/1986 Johnson
4,742,634 A 5/1988 Swenson
4,815,226 A 3/1989 Ruger
5,036,612 A 8/1991 Jennings
5,090,147 A 2/1992 Pastor
5,105,570 A 4/1992 Lishness et al.
5,259,137 A * 11/1993 Blenk ..... F41A 3/42 42/16
5,299,374 A 4/1994 Mathys
5,386,659 A 2/1995 Vaid et al.
5,388,362 A 2/1995 Melcher
5,438,784 A 8/1995 Lenkarski et al.
5,447,092 A * 9/1995 Dobbins ..... F41A 3/46 42/16
5,537,769 A 7/1996 Hargraves et al.
5,640,794 A 6/1997 Gardner et al.
5,682,007 A * 10/1997 Dobbins ..... F41A 3/46 42/16
5,926,987 A 7/1999 Novak
6,073,380 A 6/2000 Hauser et al.
6,079,138 A 6/2000 Meaker
6,141,895 A 11/2000 Rost et al.
6,374,526 B1 4/2002 Mochak
6,457,271 B1 10/2002 Vaid et al.
6,655,066 B2 12/2003 Fluhr
6,665,973 B1 12/2003 Peev
6,820,606 B1 11/2004 Duffey
6,880,281 B1 4/2005 Orr
6,931,978 B1 * 8/2005 Dionne ..... F41A 3/54 89/194
7,140,141 B2 11/2006 Vaid
7,194,833 B1 3/2007 Curry
7,299,737 B2 11/2007 Hajjar et al.
7,516,570 B2 4/2009 Stone
7,571,671 B2 * 8/2009 Engel ..... F41A 5/16 89/174
7,617,628 B2 11/2009 Curry
7,703,230 B2 4/2010 Curry et al.
7,721,639 B2 * 5/2010 Wossner ..... F41A 21/484 89/181
7,770,507 B1 8/2010 Hajjar et al.
7,810,268 B1 10/2010 McGarry
7,810,269 B2 10/2010 Zukowski et al.
7,866,077 B2 1/2011 Constant et al.
7,930,848 B2 4/2011 Dye, Jr.
7,958,661 B2 6/2011 Strayer
8,015,742 B2 9/2011 Zedrosser
8,033,043 B2 10/2011 McGarry
8,122,634 B2 2/2012 Constant et al.
8,191,298 B2 6/2012 Cash et al.
8,359,778 B2 1/2013 Doll et al.
8,438,768 B2 5/2013 Kallio
8,459,165 B2 6/2013 Doll et al.
8,572,878 B2 11/2013 Gentilini et al.
8,656,619 B2 2/2014 Popikov
8,667,881 B1 3/2014 Hawbaker
8,726,555 B2 5/2014 Carr
8,820,211 B1 9/2014 Hawbaker
8,844,425 B2 9/2014 Mueller
8,863,425 B2 10/2014 Lee
8,925,232 B2 1/2015 Silveira
8,935,872 B2 1/2015 Zukowski
8,955,422 B1 2/2015 Schumacher
8,959,818 B2 2/2015 Mayerl
9,038,525 B2 5/2015 Sullivan et al.
9,217,614 B2 12/2015 Pizano
9,222,742 B2 12/2015 Steuwer et al.
9,347,738 B1 5/2016 Schumacher
9,482,481 B2 11/2016 LaValley et al.
9,488,423 B2 11/2016 Sullivan et al.
9,541,341 B2 1/2017 Macy
9,835,397 B2 12/2017 Stussak
9,964,369 B2 * 5/2018 Garrow ..... F41A 3/44
10,101,102 B2 10/2018 Eitan et al.
10,151,544 B1 12/2018 Sugg
10,401,102 B1 9/2019 Carroll
10,436,530 B2 10/2019 Overstreet et al.
10,557,673 B2 2/2020 Overstreet et al.
10,739,095 B2 8/2020 Underwood et al.
11,371,789 B2 6/2022 Underwood et al.
11,421,954 B2 8/2022 Underwood et al.
11,543,195 B2 1/2023 Underwood et al.
11,725,895 B2 8/2023 Underwood et al.
11,781,824 B2 10/2023 Underwood et al.
12,025,391 B2 7/2024 Underwood et al.
2005/0132627 A1 6/2005 Wossner et al.
2005/0257682 A1 * 11/2005 Hajjar ..... F41A 3/46 89/188
2006/0266209 A1 11/2006 Grabowski
2008/0078284 A1 4/2008 Murello
2010/0186581 A1 * 7/2010 Hajjar ..... F41A 3/46 89/188
2010/0229447 A1 9/2010 Metzger
2010/0287806 A1 11/2010 Marfione et al.
2011/0232148 A1 9/2011 Cain et al.
2011/0271827 A1 11/2011 Larson et al.
2013/0036900 A1 2/2013 Mueller
2014/0041518 A1 2/2014 Neitzling
2014/0075807 A1 * 3/2014 Lewis ..... F41A 15/14 42/25
2015/0068092 A1 3/2015 Kallio
2015/0219413 A1 8/2015 Karimullah et al.
2015/0253096 A1 9/2015 Lee
2015/0308784 A1 10/2015 Cho
2016/0010938 A1 1/2016 Merkley et al.
2016/0033218 A1 2/2016 Folkestad et al.
2016/0047614 A1 2/2016 Larson, Jr.
2016/0178303 A1 6/2016 Macy
2016/0187082 A1 6/2016 Pizano
2016/0187090 A1 6/2016 Mather et al.
2016/0187092 A1 6/2016 Mather et al.
2016/0252316 A1 * 9/2016 Garrow ..... F41A 19/30 89/181
2016/0377364 A1 12/2016 Santos Reis
2018/0112944 A1 4/2018 Underwood et al.
2018/0142981 A1 5/2018 Collazo et al.
2018/0224227 A1 8/2018 Durham, III
2019/0271524 A1 9/2019 Khoshnood
2020/0072567 A1 * 3/2020 Michut ..... F41A 3/44
2020/0340769 A1 10/2020 Underwood et al.
2021/0108870 A1 4/2021 Underwood et al.
2022/0003512 A1 1/2022 Underwood et al.
2022/0268540 A1 8/2022 Underwood et al.
2022/0299280 A1 * 9/2022 Sunseri ..... F41A 3/20
2022/0364813 A1 11/2022 Underwood et al.
2023/0108620 A1 4/2023 Underwood et al.
2024/0167777 A1 5/2024 Underwood et al.

* cited by examiner

ROLLER DELAYED FIREARM OPERATING SYSTEM

CROSS REFERENCE TO RELATED APPLICATIONS

This application is a continuation of U.S. patent application Ser. No. 18/242,910 ("the '910 application") filed Sep. 6, 2023, which is a continuation of U.S. patent application Ser. No. 17/741,004 ("the '004 application") filed May 10, 2022, which is a continuation of U.S. patent application Ser. No. 16/987,204 ("the '204 application") filed Aug. 6, 2020, which is related to and claims priority benefit from U.S. Provisional Application No. 62/883,309 ("the '309 application"), filed on Aug. 6, 2019 and entitled "ROLLER DELAYED FIREARM OPERATING SYSTEM" and U.S. Provisional Application No. 63/048,057 ("the '057 application"), filed on Jul. 3, 2020 and entitled "ROLLER DELAYED FIREARM OPERATING SYSTEM." The '910 application, the '004 application, the '204 application, the '309 application, and the '057 application are each hereby incorporated in their entirety by this reference.

FIELD OF THE INVENTION

The field of the invention relates to firearms, particularly firearms with operating systems that include a roller delay mechanism with a plurality of bearings.

BACKGROUND

Many modern firearms (including handguns, rifles, carbines, shotguns, etc.) rely on operating systems using blowback or gas pressure (including direct gas impingement arrangements, gas piston arrangements, or other appropriate arrangements). However, for compatibility with various calibers (including rifle calibers, pistol calibers, or other appropriate calibers), blowback or gas pressure operating systems are difficult to adapt to a wide variety of calibers. Adjustments for these operating systems may be necessary due to mass of the cartridge for various calibers to ensure suitable function of the firearm, including a sufficient delay between firing the projectile and rearward movement of the firearm bolt.

To simplify the firearm operating system, to increase reliability, and to increase safety, it may be desirable to design a new operating system that includes a roller delayed operating system that utilizes at least one cam pin. Such a design can allow for modular firearm components to be combined with the new roller delayed operating system.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a firearm operating system comprises: a forward bolt comprising an internal cavity; a carrier disposed on a rear side of the forward bolt, wherein the carrier comprises a cavity; a short cam pin; a plurality of bearings; a retracted configuration; and a deployed configuration, wherein: at least a portion of a forward section of the short cam pin is disposed within the internal cavity of the forward bolt; at least a portion of a rear section of the short cam pin is disposed within a cavity of the carrier; and movement from the retracted configuration to the deployed configuration includes movement in a forward/aft direction of the short cam pin relative to the forward bolt and movement of the plurality of bearings.

According to certain embodiments of the present invention, an operating system for a firearm comprises: a forward bolt comprising a forward bolt cavity; a carrier disposed on a rear side of the forward bolt, the carrier comprising a carrier cavity; a short cam pin comprising (i) a forward section that is at least partially disposed within the forward bolt cavity and (ii) a rear section that is at least partially disposed within the carrier cavity; a plurality of bearings that interface with the forward bolt; a retracted configuration where the short cam pin is in a rear position relative to the forward bolt; and a deployed configuration where the short cam pin is in a forward position relative to the forward bolt.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-42B illustrate components of various semi-automatic or automatic rifles, the features, concepts, and functions described herein are also applicable (with potential necessary alterations for particular applications) to handguns, rifles, carbines, shotguns, or any other type of firearm.

Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge.

Figure 1:
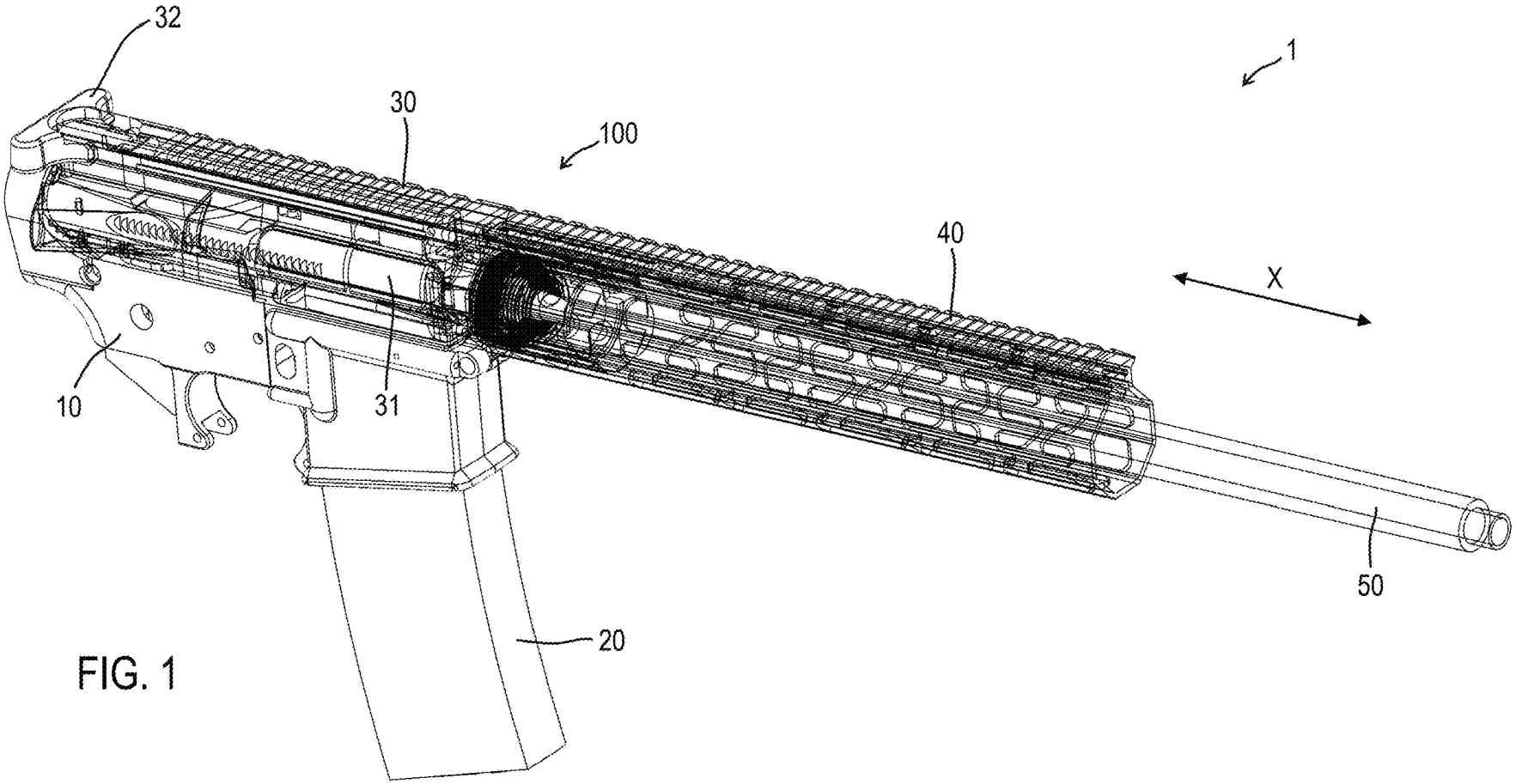
FIG. 1 is a perspective view of a firearm operating system for a firearm according to certain embodiments of the present invention.

According to certain embodiments of the present invention, as shown in FIGS. 1-10, a firearm operating system 100 may include a forward bolt 102, a short cam pin 103, a long cam pin 104, a carrier 105, a barrel extension 106, and a chamber washer 107. As shown in FIG. 1, a firearm 1 may include a lower receiver 10, a magazine 20, an upper receiver 30, a charging handle 32, a handguard 40, and a barrel 50. The magazine 20 may be capable of being inserted into a magazine well 11 of the lower receiver 10 (see FIG. 2). In some cases, the firearm operating system 100 is located within the upper receiver 30. The firearm operating system 100 may be designed as an assembly of components to fit within a standard upper receiver (e.g., upper receiver 30 shown in FIG. 1) for a known modular firearm such that the upper receiver 30 (including the firearm operating system 100) can interface with a standard lower receiver 10. For example, the firearm operating system 100 may be designed to function and engage with (i) components of AR-15 variant (civilian) or M16/M4 (military) firearms; (ii) components of AR-10 variant firearms; or (iii) components of any other relevant firearm. To better illustrate some the relevant components of the firearm operating system 100, in FIG. 1, the upper receiver 30, the handguard 40, and the barrel 50 are transparent. Similarly, in FIG. 2, the magazine 20, the upper receiver 30, and the handguard 40 are not illustrated.

In some embodiments, the firearm operating system 100 is configured to be inserted into a U.S. military specification (milspec) upper receiver for an AR-15 variant (civilian) or M16/M4 (military) firearm (i.e., collectively AR-15 style firearms).

Figure 2:
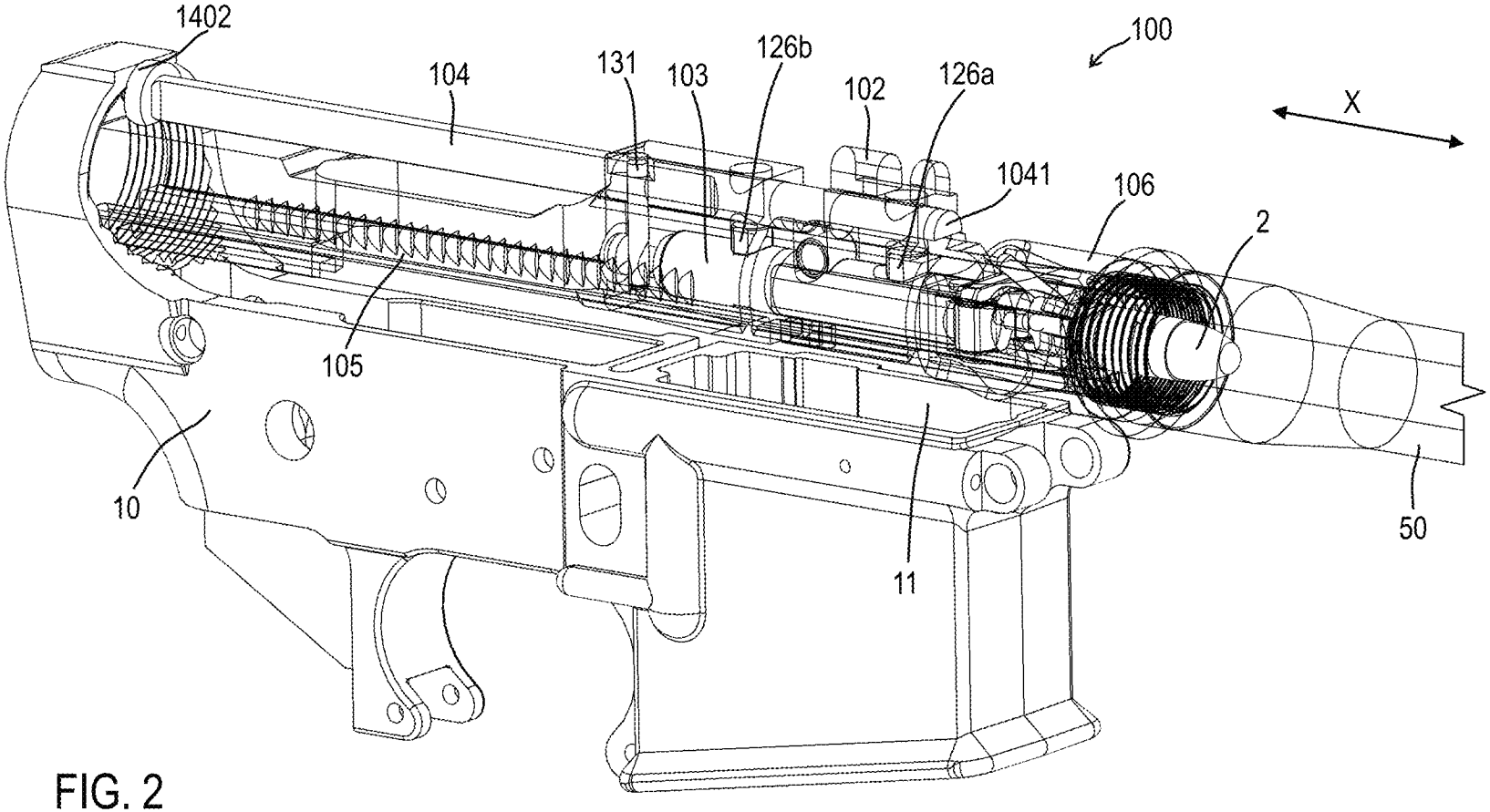
FIG. 2 is a partial right perspective view of the firearm operating system of FIG. 1.

FIG. 2 shows many of the relevant components of the firearm operating system 100 in situ. As described in greater detail below, in some embodiments, at least a portion of a forward section of the short cam pin 103 is disposed within an internal cavity of the forward bolt 102 (e.g., rear cavity 1027) and at least a portion of a rear section of the short cam pin 103 is disposed within an internal cavity of the carrier 105 (e.g., cavity 1057) wherein the forward bolt 102 is located on a forward side of the carrier 105. In addition to not showing the magazine 20, the upper receiver 30, and the handguard 40 (as described above), in FIG. 2, the forward bolt 102, the carrier 105, the barrel extension 106, and the barrel 50 are transparent to better illustrate components of the firearm operating system 100. Cycling of the firearm operating system 100 is based on linear motion of various components in the forward/aft direction X including, for example, the forward bolt 102, the short cam pin 103, the long cam pin 104, the carrier 105, and the firing pin 108.

Figure 3A:
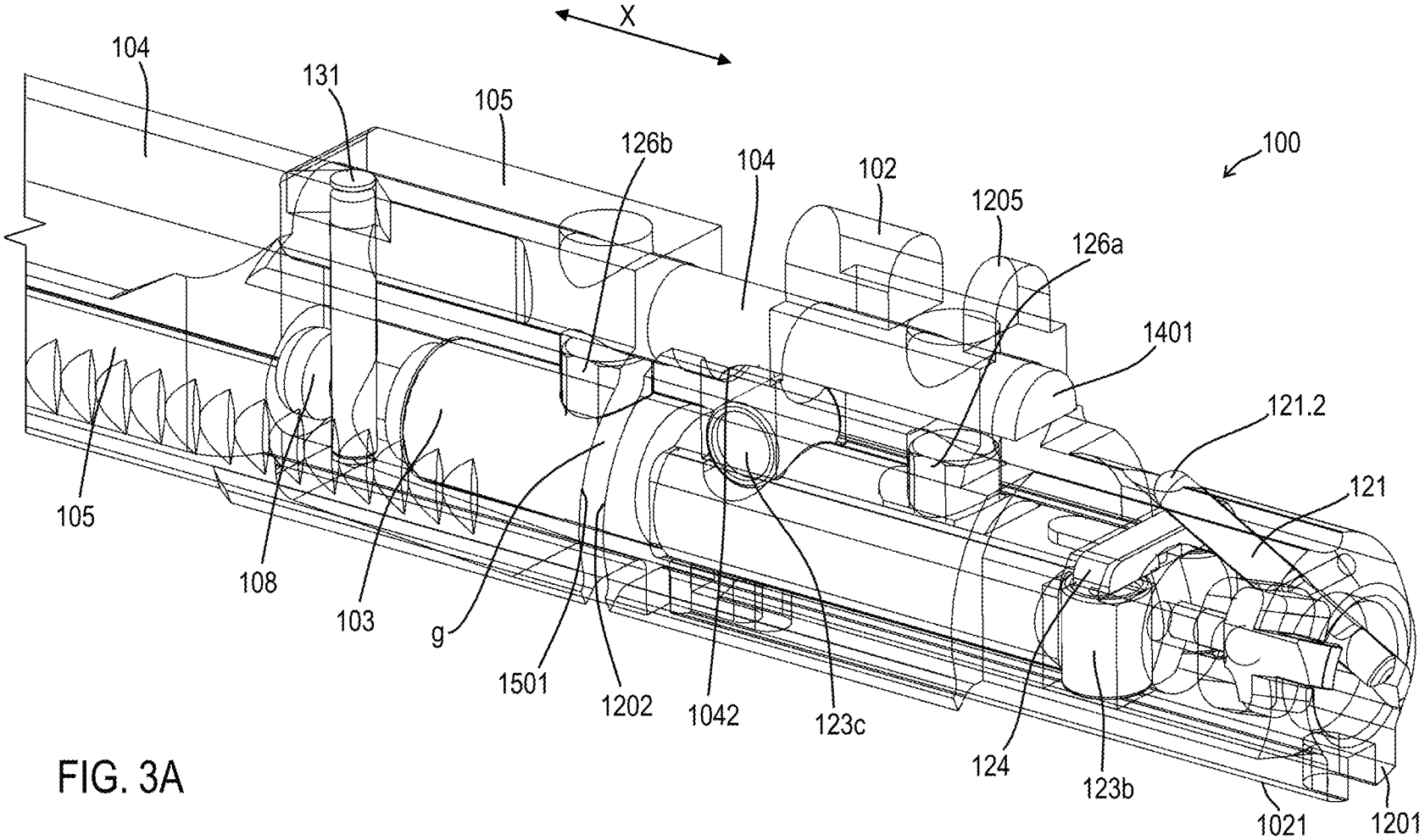
FIG. 3A is a partial right perspective view of the firearm operating system of FIG. 1.

In some embodiments, the forward bolt 102, short cam pin 103, the long cam pin 104, the carrier 105, and the firing pin 108 combine together as one unit within the firearm operating system 100. The forward bolt 102 may slidably engage the long cam pin 104 via long cam pin cavity 1026 and the carrier 105 may slidably engage the long cam pin 104 via long cam pin cavity 1056. As shown in FIG. 3A, the forward bolt 102 may be disposed on a forward side of the carrier 105 such that, in some conditions, there is a gap g between an aft face 1202 of the forward bolt 102 and a forward face 1501 of the carrier 105. The short cam pin 103 and the firing pin 108 may each extend internally through a rear cavity 1027 (see FIGS. 4B and 4C) of the forward bolt 102 and through a cavity 1057 of the carrier 105 (see FIGS. 7A-7C). Although illustrated as a separate component, in some embodiments, the short cam pin 103 may be an integral component of the carrier 105. The firing pin 108 may extend through a cavity 1037 of the short cam pin 103 (see FIG. 5A). The firearm operating system 100 may include at least one retaining pin 126 to constrain movement of the short cam pin 103 relative to the forward bolt 102 and/or the carrier 105.

The forward bolt 102 and the short cam pin 103 may be movable relative to one another in the X-direction such that the firearm operating system 100 has a deployed configuration and a retracted configuration. In some embodiments, in the retracted configuration, the short cam pin 103 is in a rear position relative to the forward bolt 102, which creates the gap g between an aft face 1202 of the forward bolt 102 and a forward face 1501 of the carrier 105. When the firearm operating system 100 moves to the deployed configuration, the short cam pin 103 moves to a forward position relative to the forward bolt 102, which reduces or eliminates the gap g between the aft face 1202 of the forward bolt 102 and the forward face 1501 of the carrier 105.

Figure 3B:
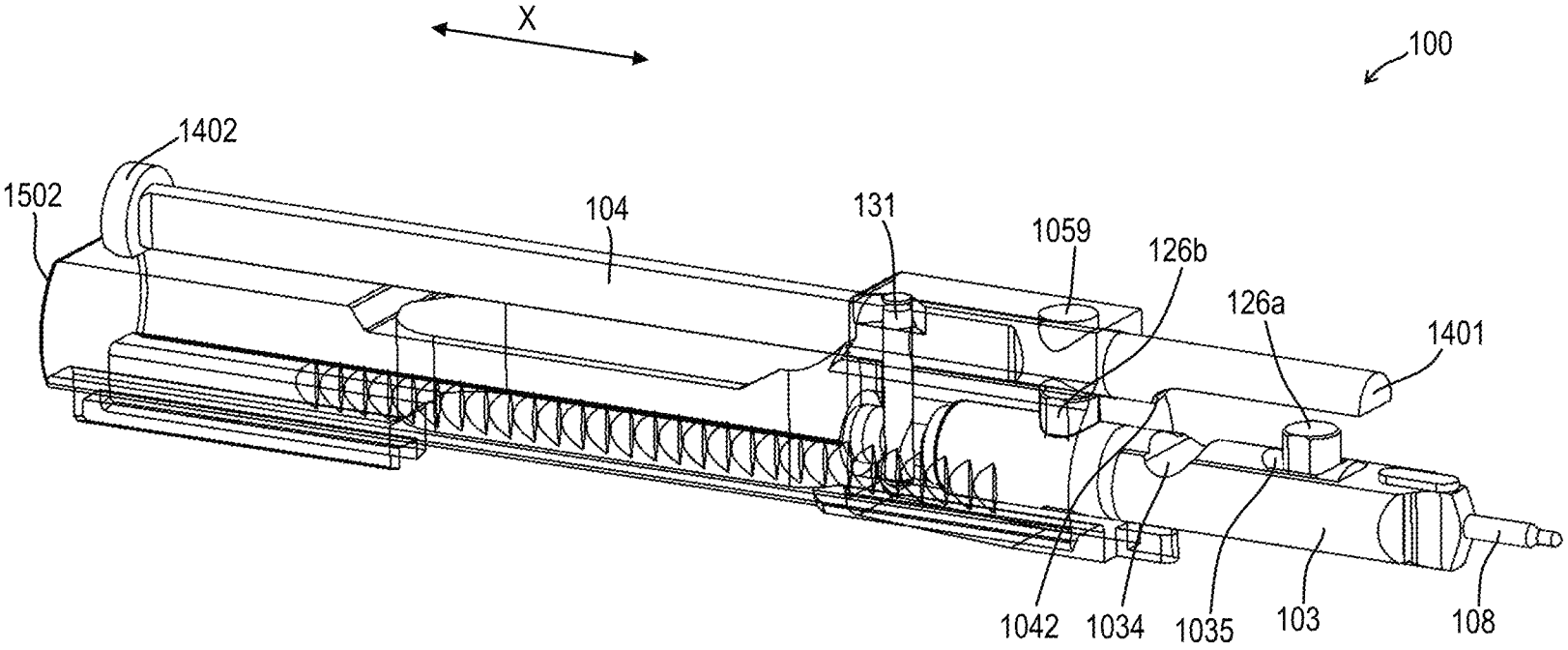
FIG. 3B is a partial right perspective view of the firearm operating system of FIG. 1.
Figure 4A:
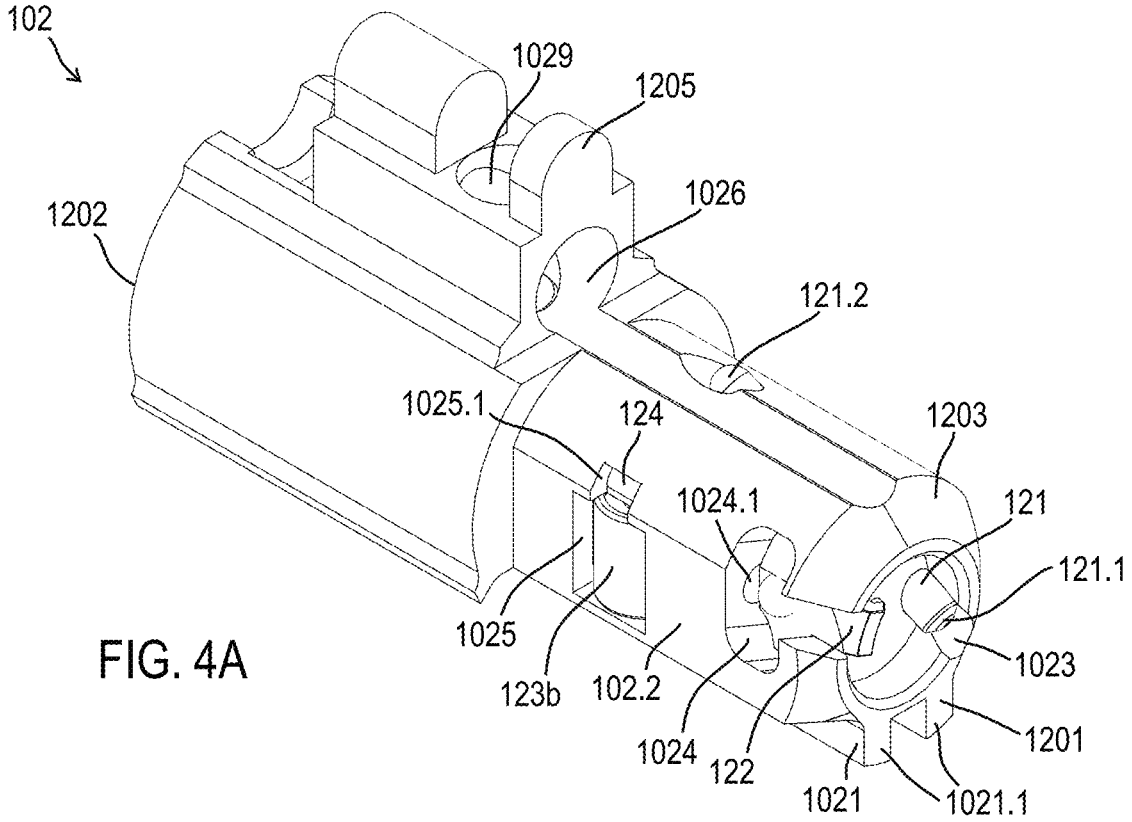
FIG. 4A is a top right perspective view of a forward bolt of the firearm operating system of FIG. 1.
Figure 4B:
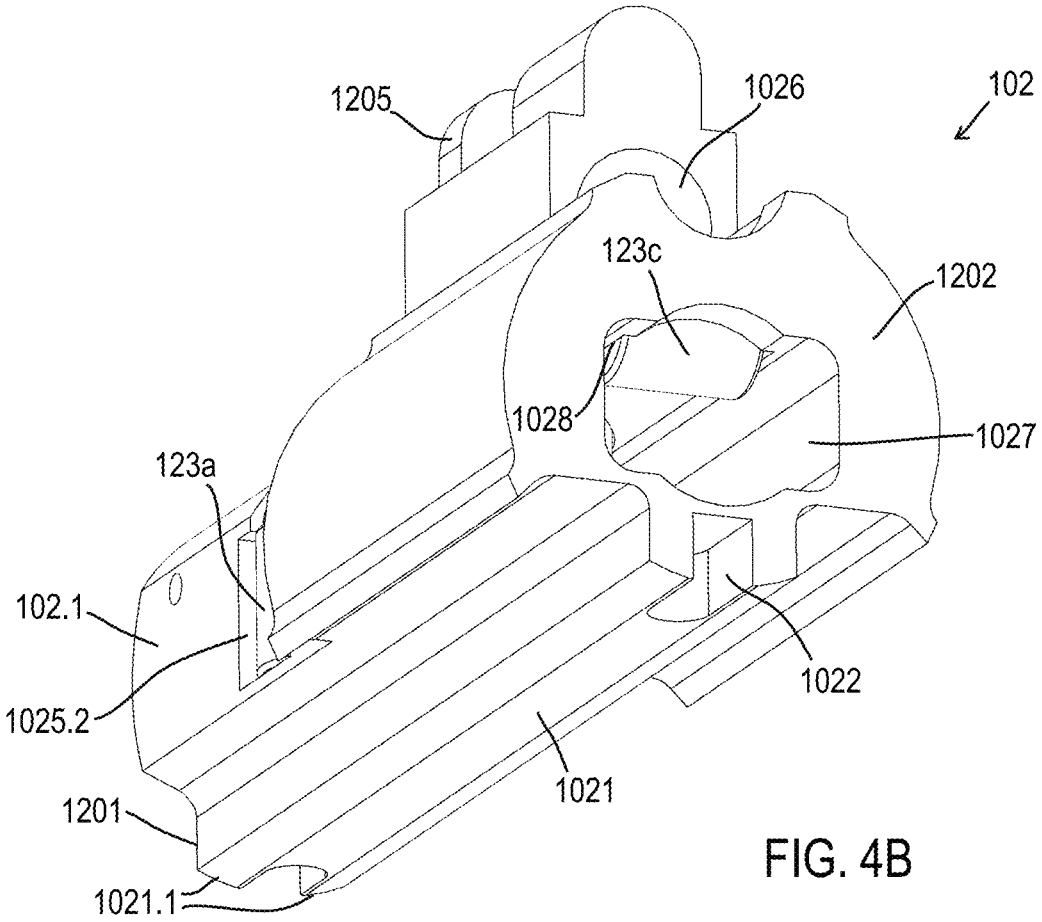
FIG. 4B is a bottom left perspective view of the forward bolt of FIG. 4A.
Figure 4C:
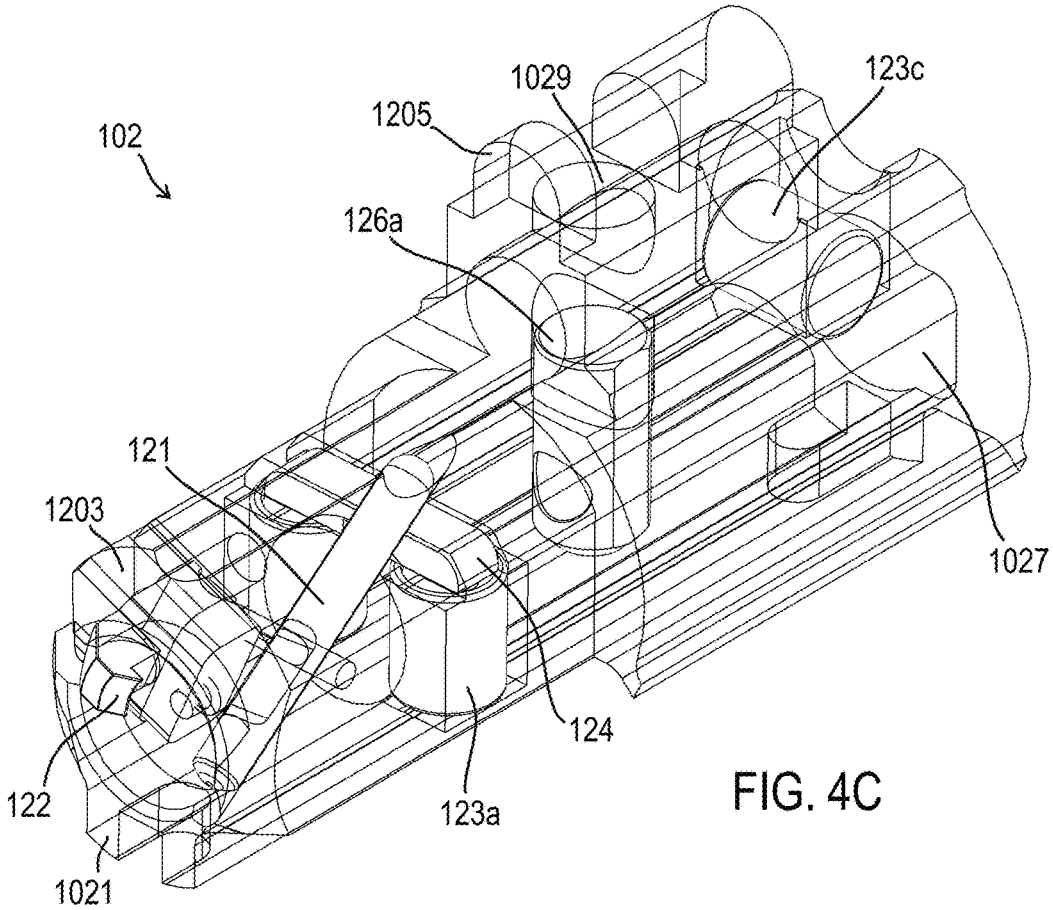
FIG. 4C is a top left perspective view of the forward bolt of FIG. 4A.
Figure 4D:
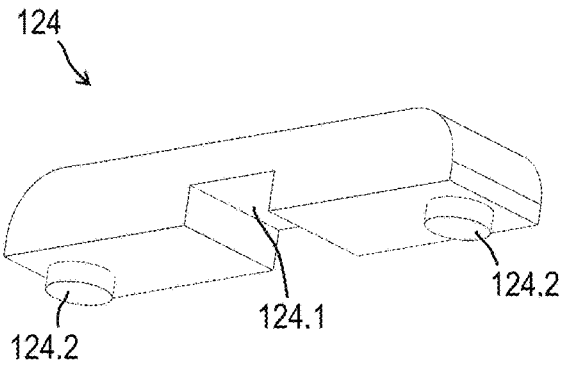
FIG. 4D is a bottom perspective view of a bearing retainer of the forward bolt of FIG. 4A.
Figure 4E:
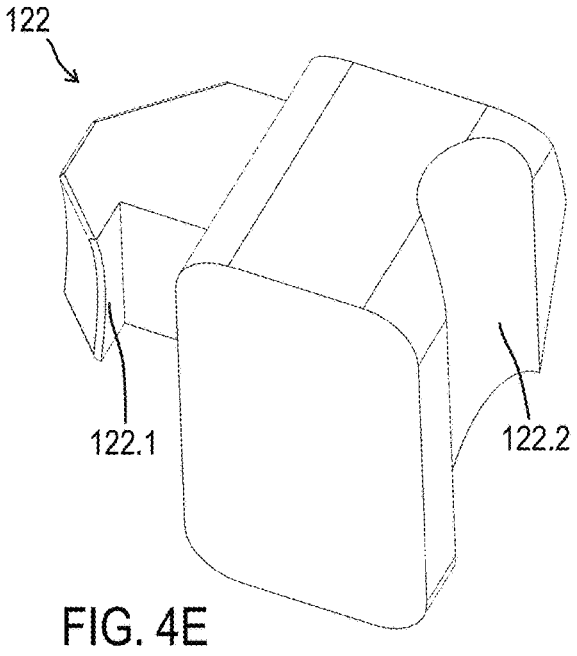
FIG. 4E is a top perspective view of an extractor of the forward bolt of FIG. 4A.
Figure 4F:
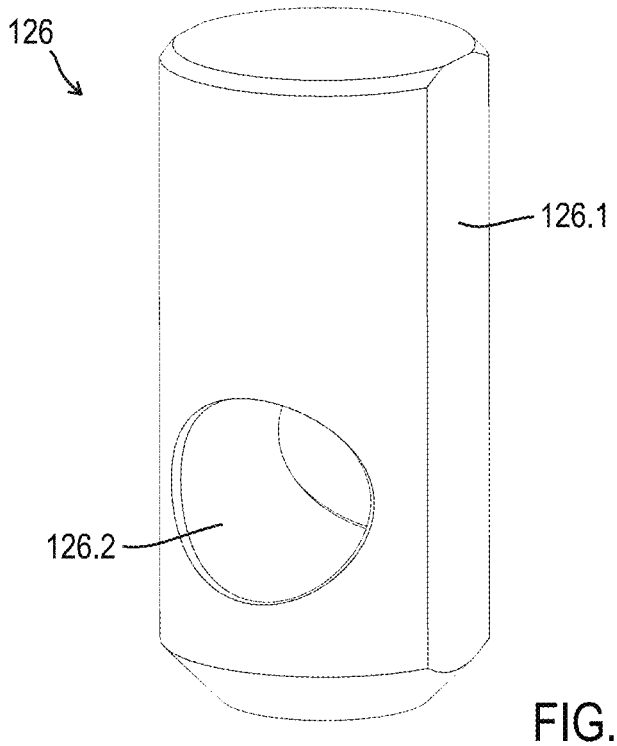
FIG. 4F is a top perspective view of a short cam pin retainer of the forward bolt of FIG. 4A.
Figure 4G:
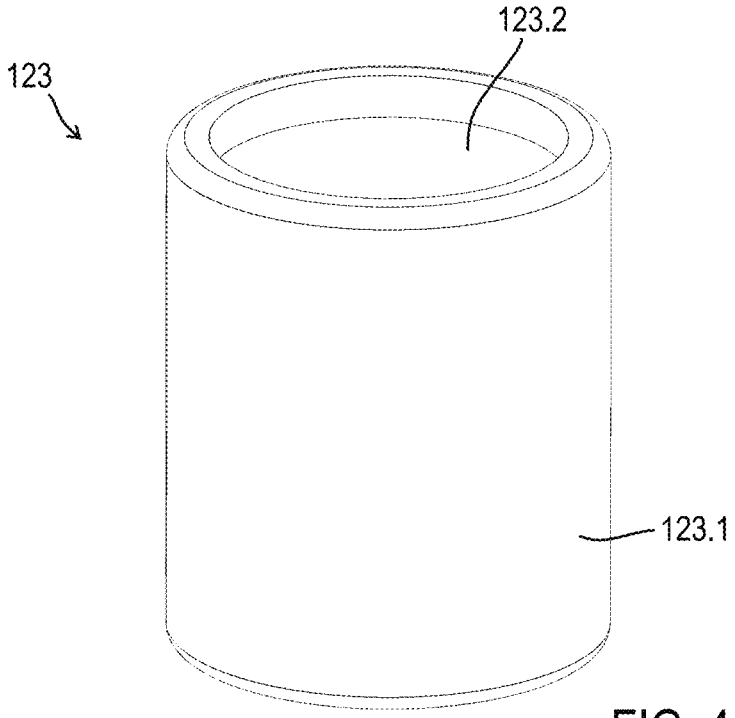
FIG. 4G is a perspective view of a bearing of the forward bolt of FIG. 4A.

An exemplary retaining pin 126, which includes at least one flat surface 126.1 and a hole 126.2, is illustrated in FIG. 4F. As shown in FIGS. 2-3B, 4C, and 5A-5C, the firearm operating system 100 may include a forward retaining pin **126*a* that engages hole 1029 of the forward bolt 102 and hole 1035 of the short cam pin 103 (in the forward section of the short cam pin 103). In some embodiments, the hole 1035 of the short cam pin 103 is a slotted hole such that the forward retaining pin 126*a* can slide in the X-direction to allow the short cam pin 103 and the forward bolt 102 to move in the X-direction relative to one another (i.e., to define the deployed configuration and the retracted configuration). In some embodiments, the geometry of the slotted hole 1035 defines the maximum relative motion between the forward bolt 102 and the short cam pin 103. As described below, the short cam pin 103 and the carrier 105 may be constrained relative to one another such that the geometry of the slotted hole 1035 also defines motion between the forward bolt 102 and the carrier 105 (i.e., the total distance of gap g). The hole 1035 may include flat side surfaces that approximately correspond to and engage the flat surfaces 126.1 of the forward retaining pin 126*a* to ensure that the hole 126.2 remains aligned with the X-direction such that the firing pin 108 passes through hole 126.2. As shown in FIGS. 2-3B and 5A-5C, the firearm operating system 100 may include a rear retaining pin 126*b* that engages hole 1059 of the carrier 105 and hole 1036 of the short cam pin 103 (in the rear section of the short cam pin 103). In some embodiments, the hole 1036 of the short cam pin 103 constrains the short cam pin 103 and the carrier 105 to prevent relative movement between the short cam pin 103 and the carrier 105. The hole 1036 may include flat side surfaces that approximately correspond to and engage the flat surfaces 126.1 of the rear retaining pin 126*b* to ensure that the hole 126.2 remains aligned with the X-direction such that the firing pin 108 passes through hole 126.2. In addition to the rear retaining pin 126*b*, a location between the short cam pin 103 and the carrier 105 may also be defined by an interaction between an internal step 1058 of the carrier 105 (see FIG. 7C) and a rear face 1302 of the short cam pin 103 (see FIGS. 5B and 5C). The internal step 1058 of the carrier 105 is optional and may not be included in some embodiments. The carrier 105 is shown transparent in FIG. 7**C for illustrative purposes.

For the firing pin 108 to function (i.e., for the forward end 1801 of the firing pin 108 to contact and cause the cartridge 2 to discharge), the firearm operating system 100 must be in the deployed configuration (i.e., the short cam pin 103 must be located in a forward position relative to the forward bolt 102). In other words, the forward surfaces 1031*a* and 1031*b* of the short cam pin 103 must be in a forward position, which affects the lateral position of the forward bearings 123*a* and 123*b* thus causing these bearings to interface with recesses 1061*a* and 1061*b*, respectively, of the barrel extension 106. In such a configuration where the forward surfaces 1031*a* and 1031*b* of the short cam pin 103 are in a forward position, the ramp surfaces 1032*a*, 1032*b* (and/or the curved surface in between the forward surfaces 1031*a*, 1031*b* and the ramp surfaces 1032*a*, 1032*b*) interact with the forward bearings 123*a*, 123*b* (and may push the forward bearings 123*a*, 123*b* outward in some cases). These constraints affect the firing pin 108 because the flange 1081 of the firing pin 108 engages the rear face 1302 of the short cam pin 103. Accordingly, a cartridge 2 can only be fired when the firearm operating system 100 is in the deployed configuration. As described in more detail below, the deployed configuration includes a condition where bearings 123*a* and 123*b* are engaged within recesses 1061*a* and 1061*b*, respectively.

The forward retaining pin 126*a* and the rear retaining pin 126*b* may be retained within their respective holes because the firing pin 108 passes through hole 126.2 of each retaining pin 126 (as described above). In addition, the hole 1029 of the forward bolt 102 and the hole 1059 of the carrier 105 may each be blind holes such that the holes are only accessible from an upper surface of the respective component (as shown in the drawings) and the long cam pin 104 blocks access to these holes.

In addition, the firearm operating system 100 allows the firearm 1 to include a barrel 50 without a hole for venting/redirecting gas pressure to the operating system. In other words, another advantage compared to conventional systems is that the barrel 50 of the firearm operating system 100 is simpler and less likely to corrode or otherwise fail due to additional holes thus increasing longevity.

In some embodiments, the firearm operating system 100 includes a assembly pin 131 (see FIGS. 2-3B) that is inserted into hole 1055 of the carrier 105. When the assembly pin 131 is inserted into hole 1055, the assembly pin 131 may be at least partially disposed within cavity 1057 of the carrier 105 such that the assembly pin 131 interacts with the firing pin 108. In particular, the assembly pin 131 is disposed between the rear end 1802 and the flange 1081 of the firing pin 108 such that the firing pin 108 cannot be removed from the cavity 1037 of the short cam pin 103 while the assembly pin 131 is installed. The assembly pin 131 may also interact with the long cam pin 104. For example, when installed, the assembly pin 131 is disposed adjacent to a flat side portion 1045 (i.e., anything between the interface surface 1046 and the aft end 1402 of the long cam pin 104). If the carrier 105 is moved forward relative to the long cam pin 104, the assembly pin 131 will press against the interface surface 1046 and prevent further forward movement of the carrier 105. However, the assembly pin 131 can be removed, which will allow the carrier 105 to move forward such that the long cam pin 104 is removed from the long cam pin cavity 1056 of the carrier 105 (and from long cam pin cavity 1026 of the forward bolt 102). Such an operation would occur outside the firearm 1 due to the length of the long cam pin 104 and the proximity of the barrel extension 106 and the chamber washer 107.

The forward bolt 102 includes a forward face 1201, the aft face 1202, a lower portion 1021, a lower rear cavity 1022, an ejector hole 1023, an extractor cavity 1024, a lateral bearing cavity 1025, a long cam pin cavity 1026, a rear cavity 1027, and an upper bearing cavity 1028 (see FIGS. 4A-4C). The forward bolt 102 is shown transparent in FIG. 4C for illustrative purposes. As shown in FIGS. 4A-4G, the forward bolt 102 may interface with an ejector pin 121, an extractor 122, at least one bearing 123, and a bearing retainer 124. The lower portion 1021 at the forward face 1201 of the forward bolt 102 may include two lugs 1021.1 that engage corresponding recesses 1071 of the chamber washer 107 (see FIGS. 8 and 10) when the forward bolt 102 is in the forward position. When the forward bolt 102 moves forward over the top of the magazine 20 (located in the magazine well 11 of the lower receiver 10), the lugs 1021.1 push the upper-most cartridge 2 out of the magazine 20 and toward the chamber of the firearm 1. FIG. 2 shows the cartridge 2 in the chamber in a firing position such that the cartridge 2 is approximately aligned with a center of the forward face 1201 of the forward bolt 102 and the lugs 1021.1 are engaged with the corresponding recesses 1071 of the chamber washer 107. In addition, when the forward bolt 102 is in the forward position, the beveled surfaces 1203 at the forward face 1201 allow the forward bolt 102 to move close to the chamber washer 107 without interference. When the cartridge 2 is in the firing position, forward motion of a forward end 1801 of the firing pin 108 (e.g., caused by a hammer interacting with the rear end 1802 of the firing pin 108) causes the cartridge 2 to discharge. Based on the geometry of the beveled surfaces 1203, the forward end of the forward bolt 102 can reach a forward position and interface with the chamber washer 107. The chamber washer 107 provides a funnel to direct the cartridge 2 to the firing position.

The ejector pin 121 interfaces with the ejector hole 1023 of the forward bolt 102. When the forward bolt 102 moves rearward due to either (i) manual operation/movement (e.g., operating the charging handle 32) or (ii) cycling of the firearm 1 after firing a cartridge (e.g., cartridge 2), an aft end 121.2 of the ejector pin 121 protrudes out of the ejector hole 1023 until the aft end 121.2 of the ejector pin 121 makes contact with interface surface 1043 of the long cam pin 104. The forward bolt 102 slides along the long cam pin 104 such that the long cam pin 104 extends through long cam pin cavity 1026 of the forward bolt 102. The contact between the aft end 121.2 of the ejector pin 121 and the interface surface 1043 of the long cam pin 104 causes the ejector pin 121 to move through the ejector hole 1023 such that a forward end 121.1 contacts a rear surface of a cartridge 2 (or an empty shell of a cartridge if a round was fired). The location of the interface surface 1043 on the long cam pin 104 is designed such that the contact between the aft end 121.2 of the ejector pin 121 and the interface surface 1043 of the long cam pin 104 occurs while the cartridge 2 (or the empty shell of a cartridge if a round was fired) is located adjacent to the ejection port 31 of the upper receiver 30. Such an arrangement of the long cam pin 104 allows the ejector pin 121, in coordination with the extractor 122 to eject the cartridge 2 (or the empty shell of a cartridge if a round was fired) through the ejection port 31 of the upper receiver 30. The design of the long cam pin 104 can be updated to tune the ejection of cartridge 2 (or empty shell). For example, the location of the interface surface 1043 along the long cam pin 104 can affect ejection of the cartridge 2. Further, the angle or curvature of the surface of the interface surface 1043 can affect the speed or quickness of the ejection. In addition, adjustment to the properties and/or the location of the interface surface 1043 along the long cam pin 104 allows the design of the firearm operating system 100 to be quickly adapted to different calibers.

The extractor 122 may be located within the extractor cavity 1024 of the forward bolt 102 such that the extractor can move based on the geometry of the cavity 1024 and an interface with a spring and/or a spherical bearing inserted into hole 1024.1. In some embodiments, the extractor 122 travels parallel to an internal contoured surface of the cavity 1024. In some cases, the direction of travel for the extractor 122 is approximately radial extending from a center of the forward bolt 102 toward the exterior. In other cases, the extractor 122 pivots based on the geometry of surface 122.2 and the interaction between this surface and the spring and/or a spherical bearing. The extractor 122 may include a hook member 122.1 that engages a cannelure and/or a rim of the cartridge 2 such that the extractor 122 guides the cartridge 2 (or the empty shell of a cartridge if a round was fired) in the direction of the ejection port 31 of the upper receiver 30 using the force provided by the ejector pin 121.

Manual operation/cycling of the firearm operating system 100 may include rearward movement of the charging handle 32 where the charging handle 32 engages a portion of the firearm operating system 100. For example, in some embodiments, the charging handle 32 engages a portion of the forward bolt 102. In some embodiments, the charging handle 32 engages an upper feature 1205 of the forward bolt 102 (see FIGS. 4A-4C).

The firearm operating system 100 may include at least one bearing 123. The bearing(s) 123 may each include an outer surface 123.1 and an upper recess 123.2 (see FIG. 4G). Although the bearing(s) 123 are illustrated as cylindrical rollers, the bearing(s) 123 may have any configuration, including, for example, spherical, tapered, needle, toroidal, annular, etc. In some embodiments, each bearing has a diameter of approximately 0.1" (0.25 cm) to approximately 0.4" (1.02 cm). In other cases, each bearing has a diameter of approximately 0.2" (0.51 cm) to approximately 0.3" (0.76 cm). In other cases, each bearing has a diameter of approximately 0.25" (0.635 cm). In some embodiments, as shown in FIGS. 4A-4C, the firearm operating system 100 may include two forward bearings 123*a* and 123*b* that are disposed within the lateral bearing cavity 1025. The forward bearings 123*a* and 123*b* may be configured such that the upper recess 123.2 engages a lower protrusion 124.2 of the bearing retainer 124. The lower protrusion 124.2 is illustrated as cylindrical; however, the lower protrusion 124.2 may have any appropriate shape including a rectangular or square cross section. The bearing retainer 124 may be inserted into slot 1025.1 of the forward bolt 102 (see FIG. 4A). In addition, the bearing retainer 124 may be secured from moving laterally (i.e., out of slot 1025.1) because the slot 124.1 of the bearing retainer 124 engages a protrusion 1033 of the short cam pin 103 (see FIG. 5A). As shown in FIGS. 3A, 4B, and 4C, the firearm operating system 100 may also include a rear bearing 123*c* disposed within the upper bearing cavity 1028. In some embodiments, the forward bearings 123*a*, 123*b* include an approximately vertical axis while the rear bearing 123*c* includes an axis that is approximately perpendicular to the axes of the forward bearings 123*a*, 123*b*. In some cases, the axis of the rear bearing 123*c* is approximately horizontal.

The bearings 123 may interface with other components of the firearm operating system 100. For example, the forward bearings 123*a* and 123*b* may each have an internal configuration (see FIGS. 4A and 4C) where a surface of each forward bearing 123*a*, 123*b* is approximately flush with a respective side surface of the forward bolt 102. For example, in the internal configuration, a portion of outer surface 123.1 of the forward left bearing 123*a* is approximately flush with left side surface 102.1 of the forward bolt 102 and a portion of outer surface 123.1 of the forward right bearing 123*b* is approximately flush with right side surface 102.2 of the forward bolt 102. In addition, the forward bearings 123*a* and 123*b* may be capable of moving laterally to an extended configuration where the forward bearings 123*a* and 123*b* move laterally out of the lateral bearing cavity 1025 such that at least portions of each of the forward bearings 123*a* and 123*b* extend beyond the respective side surfaces of the forward bolt 102. For example, in the extended configuration, a portion of outer surface 123.1 of the forward left bearing 123*a* protrudes beyond the left side surface 102.1 of the forward bolt 102 and a portion of outer surface 123.1 of the forward right bearing 123*b* protrudes beyond the right side surface 102.2 of the forward bolt 102. In some embodiments, the forward bearings 123*a* and 123*b* may interface with (i) the short cam pin 103 (internal to the forward bolt 102) and (ii) the barrel extension 106 (external to the forward bolt 102). For example, when the forward bearings 123*a* and 123*b* are in the internal configuration (and the retracted configuration for the firearm operating system 100), the short cam pin 103 is in a rearward position relative to the forward bearings 123*a* and 123*b* such that the bearings interface with a forward portion of the short cam pin 103 (i.e., near or adjacent to the forward surfaces 1031*a* and 1031*b*) and/or with the rear surfaces 1062*a* and 1062*b* of the barrel extension 106 (external to the forward bolt 102). In other words, when the firearm operating system 100 is in the retracted configuration and the forward bolt 102 is in a rear position relative to the barrel extension 106 (i.e., the two lugs 1021.1 are offset rearward from and do not engage the corresponding recesses 1071 of the chamber washer 107), the rear surfaces 1062*a* and 1062*b* of the barrel extension 106 constrict and press the forward bearings 123*a* and 123*b* inward to the internal configuration. For example, rear surface 1062*a* presses against bearing 123*a* and rear surface 1062*b* presses against bearing 123*b*.

In some embodiments, multiple actions occur that cause the firearm operating system 100 to move from the retracted configuration to the deployed configuration. The forward bolt 102 must be sufficiently forward relative to the long cam pin 104 such that rear bearing 123*c* (located in upper bearing cavity 1028) interfaces with flat underside portion 1041 of the long cam pin 104. In such a condition, forward momentum of the components (i.e, the forward bolt 102, the carrier 105, etc.) and/or pressure from a buffer spring (not shown), which presses forward on rear face 1502 of the carrier 105, causes the short cam pin 103 to begin moving forward relative to the forward bolt 102 (via rear retaining pin 126*b*). Due to the location relative to the long cam pin 104, forward motion of the short cam pin 103 causes rear bearing 123*c* to move across rear edge 1034.1 of the upper recess 1034 as the short cam pin 103 moves forward relative to the forward bolt 102 (i.e., the rear bearing 123*c* moves upward). The forward bolt 102 is held in position and does not move forward because the seated such that lugs 1021.1 engage the corresponding recesses 1071 of the chamber washer 107 and/or the beveled surfaces 1203 at the forward face 1201 engage corresponding surfaces of the chamber washer 107. The forward motion of the short cam pin 103 relative to the forward bolt 102 also causes the forward bearings 123*a* and 123*b* to move from the internal configuration to the extended configuration. In addition to the forward bolt 102 moving forward relative to the barrel extension 106, the short cam pin 103 moves forward relative to the forward bolt 102. These actions may occur approximately simultaneously or the movement of the forward bolt 102 relative to the barrel extension 106 may occur first. Movement of the forward bolt 102 relative to the barrel extension 106 aligns recess 1061*a* with bearing 123*a* and recess 1061*b* with bearing 123*b* (i.e., such that bearings 123*a* and 123*b* are no longer restricted by rear surfaces 1062*a* and 1062*b*). Forward motion the short cam pin 103 relative to the forward bolt 102 causes left ramp surface 1032*a* to press against bearing 123*a* and right ramp surface 1032*b* to press against bearing 123*b* such that the bearings 123 move outward from the internal configuration to the extended configuration such that bearing 123*a* moves into recess 1061*a* and bearing 123*b* moves into recess 1061*b*.

Figure 6A:
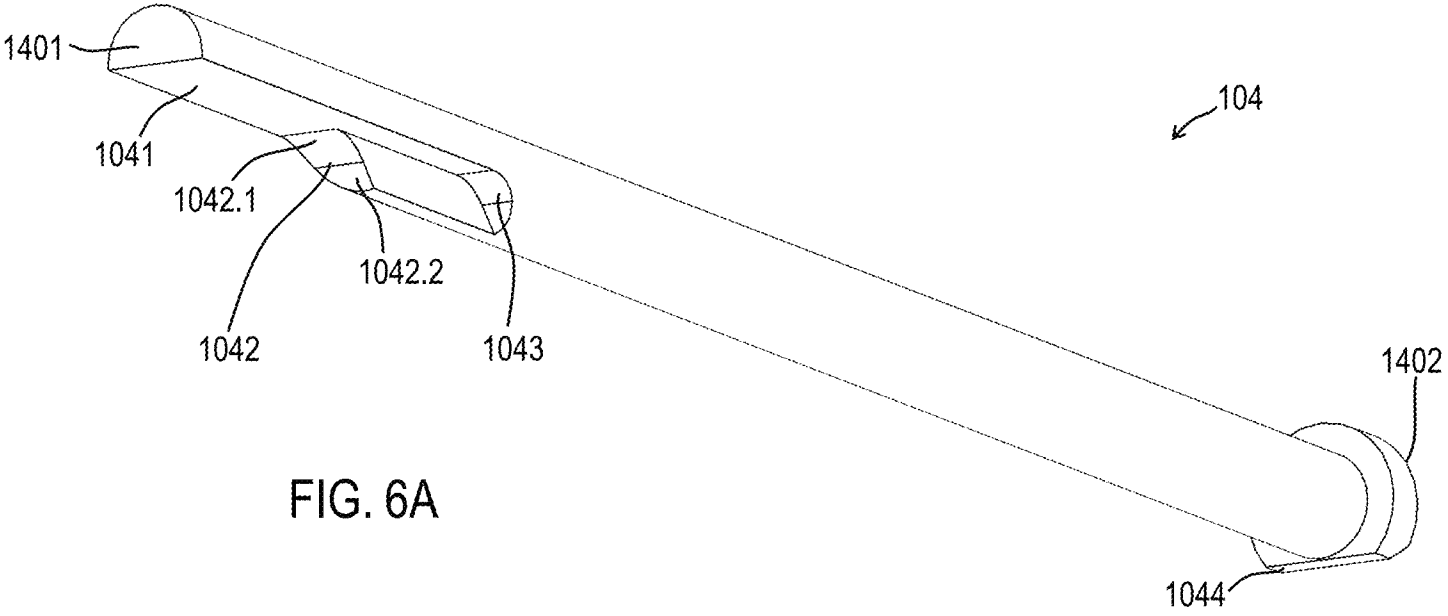
FIG. 6A is a bottom perspective view of a long cam pin of the firearm operating system of FIG. 1.
Figure 6B:
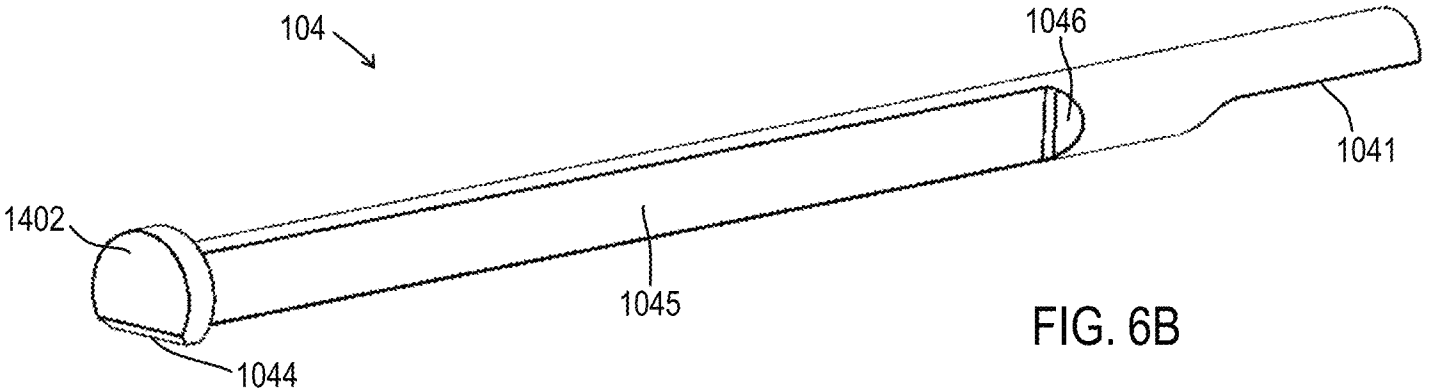
FIG. 6B is a top perspective view of the long cam pin of FIG. 6A.
Figure 7A:
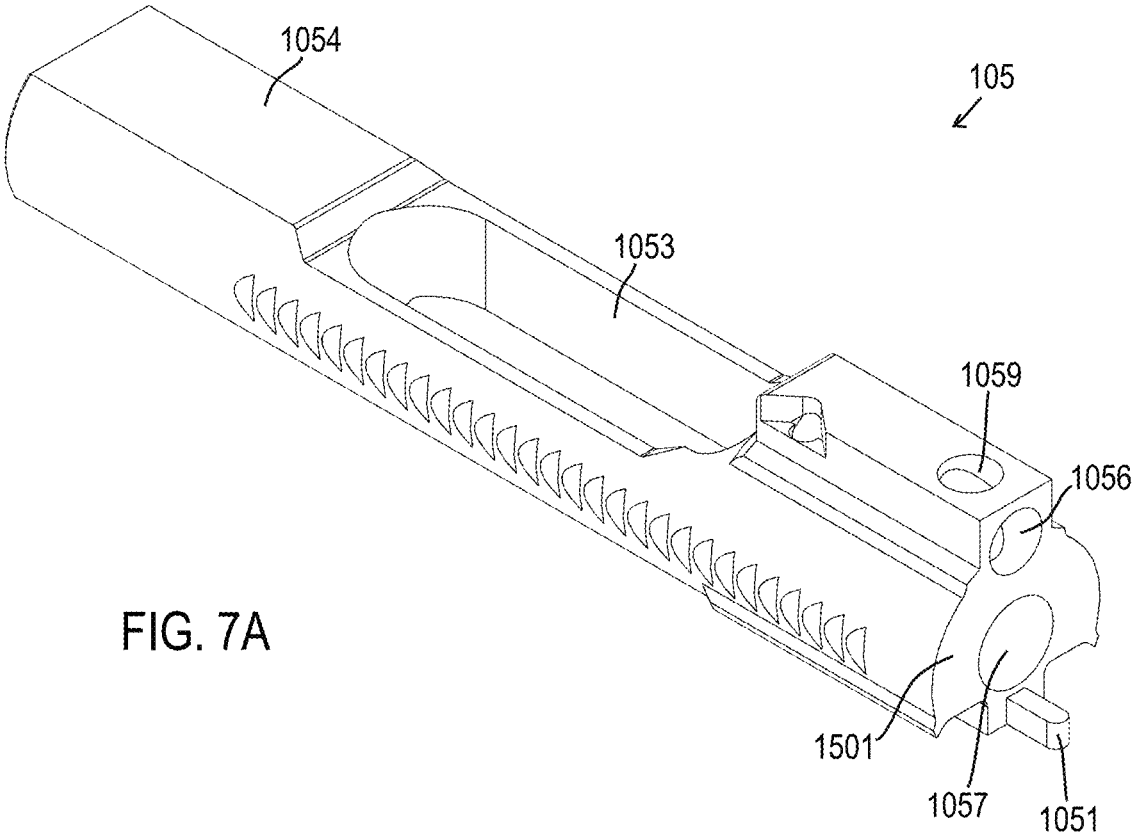
FIG. 7A is a top perspective view of a carrier of the firearm operating system of FIG. 1.
Figure 7B:
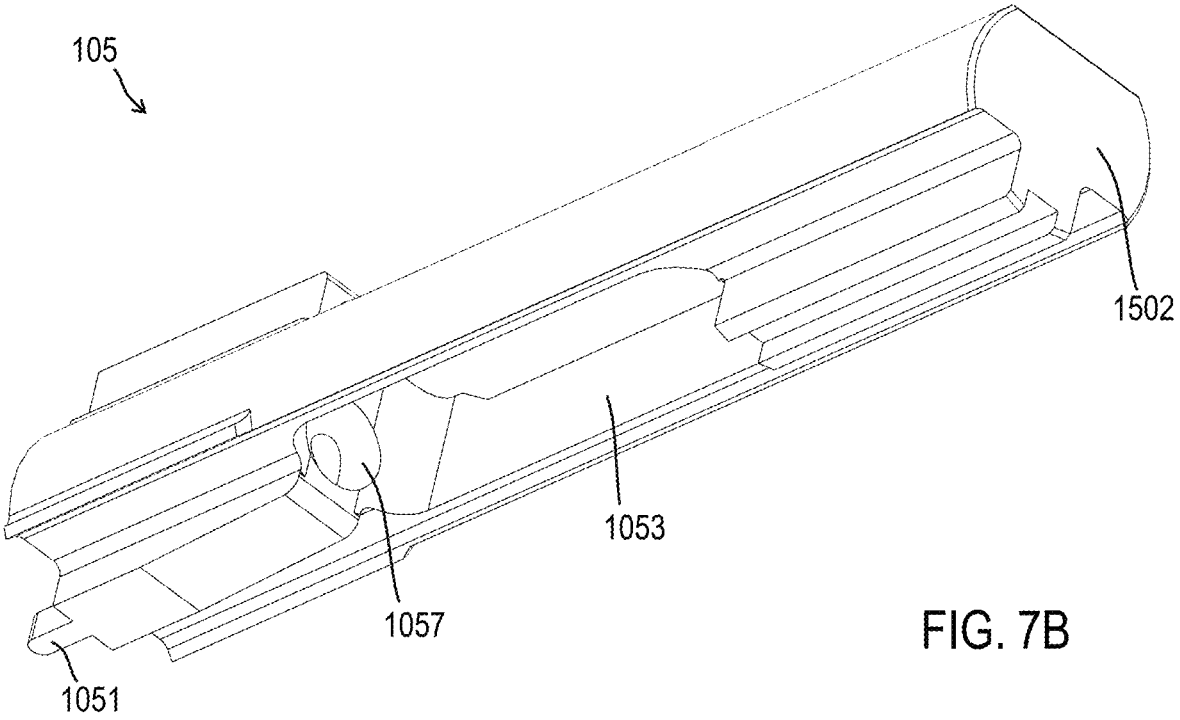
FIG. 7B is a bottom perspective view of the carrier of FIG. 7A.
Figure 7C:
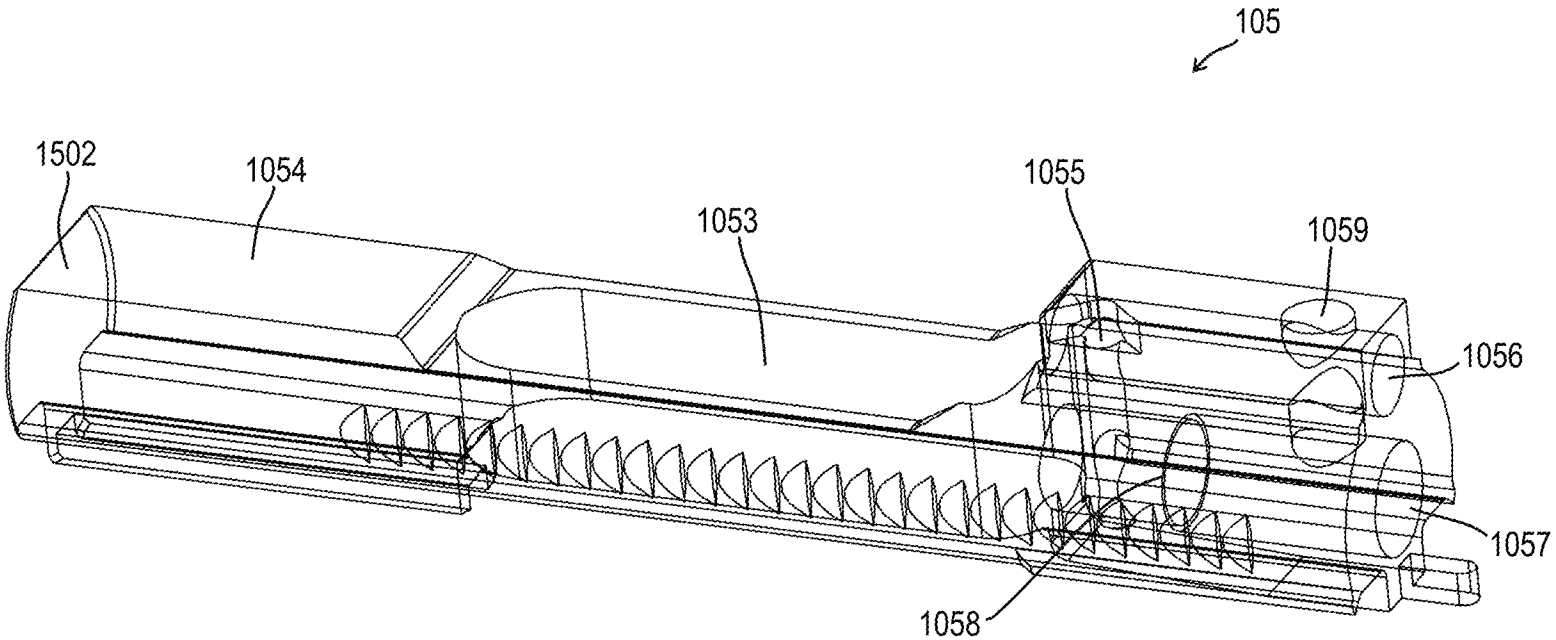
FIG. 7C is a top perspective view of the carrier of FIG. 7A.

The rear bearing 123*c* may also have an internal configuration and an extended configuration such that movement of the rear bearing 123*c* is controlled by the short cam pin 103 and the long cam pin 104. The upper bearing cavity 1028 (of the forward bolt 102), which holds the rear bearing 123*c*, is disposed adjacent to (i.e., immediately underneath) the long cam pin cavity 1026 of the forward bolt 102. When the firearm operating system 100 is in the retracted configuration and the short cam pin 103 is in a rear position relative to the forward bolt 102 (i.e., when the forward bearings 123*a* and 123*b* interface with the forward surfaces 1031*a* and 1031*b* of the short cam pin 103), the upper recess 1034 of the short cam pin 103 is aligned with the upper bearing cavity 1028 such that the rear bearing 123*c* falls into the upper recess 1034 (i.e., the internal configuration). The rear bearing 123*c* is forced to remain in the internal configuration during some functions of the firearm operating system 100. For example, when the rear bearing 123*c* interacts with any portion of the long cam pin 104 other than the flat underside portion 1041 (i.e., anything between the interface surface 1042 and the aft end 1402 of the long cam pin 104) the long cam pin 104 bears against outer surface 123.1 of the rear bearing 123*c* and retains the rear bearing 123*c* within the upper recess 1034 (i.e., the internal configuration). This internal configuration is maintained for all movement of the forward bolt 102 rearward away from chamber (rearward movement due to (i) manual operation of the charging handle 32 and/or bolt release or (ii) cycling of the firearm 1 after firing a projectile) because the aft end 1402 of the long cam pin 104 bears against the lower receiver 10 (see FIG. 2). In some cases, rearward movement of the forward bolt 102 relative to the long cam pin 104 will cause the rear bearing 123*c* to press against the interface surface 1042, which will stop motion of the forward bolt 102 and/or will force the rear bearing 123*c* downward into the upper bearing cavity 1028 and into the upper recess 1034 of the short cam pin 103 (if the short cam pin 103 is in the appropriate position relative to the forward bolt 102). As shown in FIG. 6A, in some embodiments, the interface surface 1042 may include a first portion 1042.1 and a second portion 1042.2. In some cases, the first portion 1042.1 is curved and the second portion 1042.2 is flat.

Figure 5A:
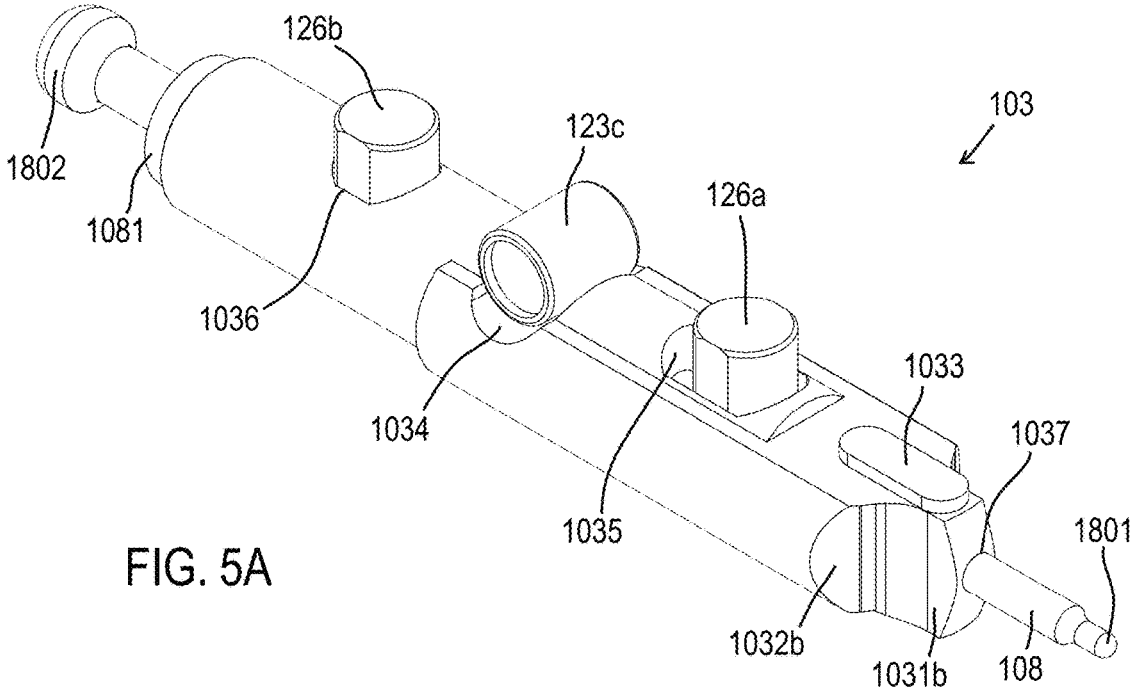
FIG. 5A is a top perspective view of a short cam pin of the firearm operating system of FIG. 1.
Figure 5B:
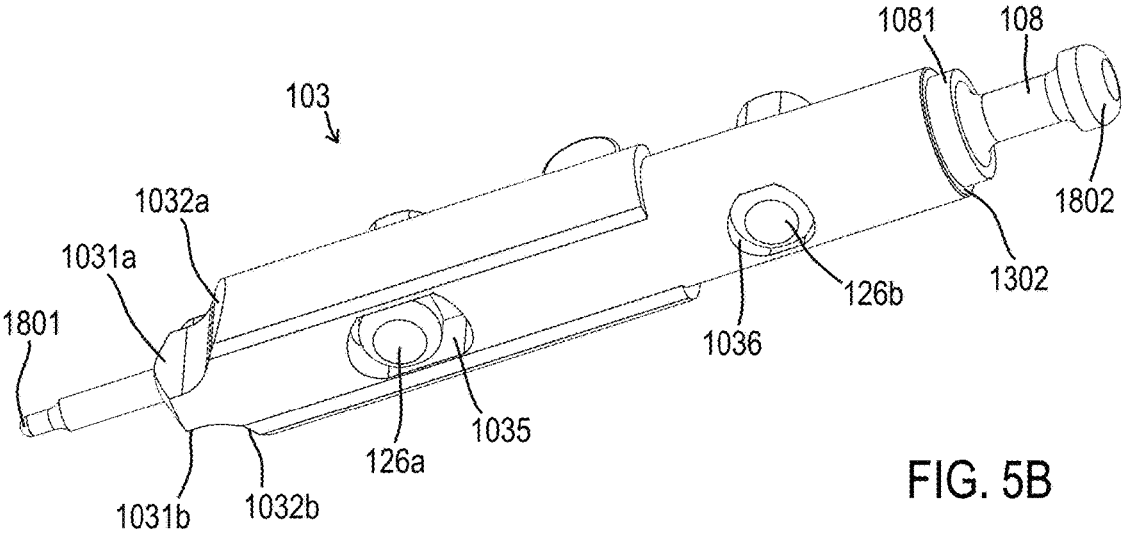
FIG. 5B is a bottom perspective view of the short cam pin of FIG. 5A.
Figure 5C:
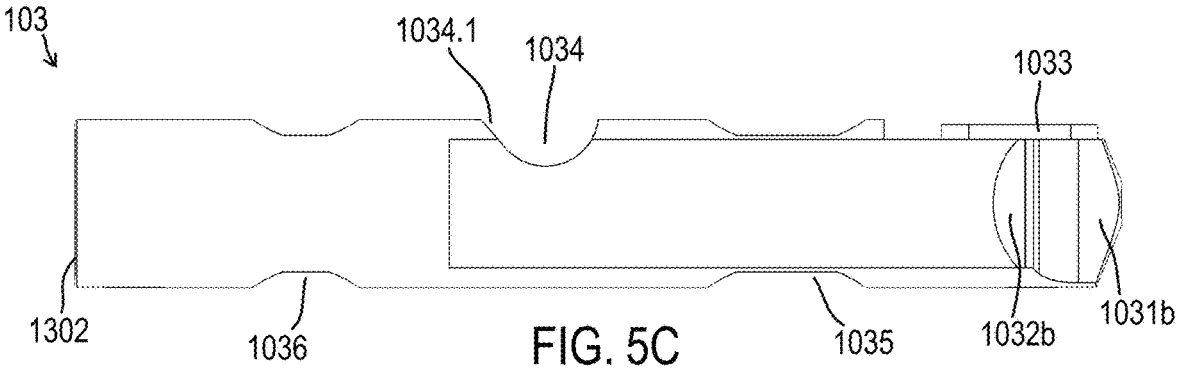
FIG. 5C is a side view of the short cam pin of FIG. 5A.

When the forward bolt 102 is located sufficiently forward relative to the long cam pin 104 such that the flat underside portion 1041 (i.e., anything between the interface surface 1042 and the forward end 1401 of the long cam pin 104) is aligned with the rear bearing 123*c*, forward motion of the short cam pin 103 relative to the forward bolt 102 causes the rear bearing 123*c* to move upward due to an interaction with rear edge 1034.1 of the upper recess 1034 (i.e., the rear bearing 123*c* protrudes at least partially out of upper bearing cavity 1028 into the space adjacent to the flat underside portion 1041 of the long cam pin 104). In some embodiments, as shown in FIG. 5C, the upper recess 1034 is not symmetric such that the rear edge 1034.1 has a gradual transition into the upper surface of the short cam pin 103. This gradual transition facilitates movement of the rear bearing 123*c*, as described above.

The long cam pin 104 may include a lower flat surface 1044 that interfaces with a rear flat surface 1054 of the carrier 105.

In some embodiments, the lower rear cavity 1022 of the forward bolt 102 interacts with a forward protrusion 1051 of the carrier 105. The forward motion of the short cam pin 103 relative to the forward bolt 102 (movement of the firearm operating system 100 to the deployed configuration, as described above) may also cause the forward bolt 102 and the carrier 105 to move closer to one another thus reducing gap g between the aft face 1202 of the forward bolt 102 and the forward face 1501 of the carrier 105. When gap g is reduced, the forward protrusion 1051 of the carrier 105 extends deeper into the lower rear cavity 1022 of the forward bolt 102. In some embodiments, the forward bolt 102 and the carrier 105 are configured such that the forward protrusion 1051 at least partially engages the lower rear cavity 1022 at all times (i.e., including for a maximum value of gap g) such that a hammer for a trigger group of the firearm 1 interacts with an approximately continuous surface on the underside of the forward bolt 102 and the carrier 105. The carrier 105 may also include an internal cavity 1053 that interacts with a trigger group of the firearm 1.

After a cartridge 2 is fired, the mechanisms described above cause a delay before the bolt assembly (the forward bolt 102, the short cam pin 103, the carrier 105, and other related components) can move rearward away from the chamber (in the X-direction). In particular, the forward bearings 123*a* and 123*b* press against the ramped surface on the rear side of the recesses 1061*a* and 1061*b* of the barrel extension 106, respectively. In other words, bearing 123*a* presses against the ramp located between recess 1061*a* and rear surface 1062*a* and bearing 123*b* presses against the ramp located between recess 1061*b* and rear surface 1062*b* (see FIGS. 8 and 9). These ramps of the barrel extension 106 may be linear (flat) and/or may be curved. In some cases, the geometry of these ramps may be designed (along with the geometry of the bearings 123) to determine the distance, time, rate, etc. of the movement of the bearings 123 after the cartridge 2 has been fired. The interaction between these ramps of the barrel extension 106 and the forward bearings 123*a* and 123*b* causes the bearings 123*a* and 123*b* to move inward (toward the interior of the lateral bearing cavity 1025) and press against the left and right ramp surfaces 1032*a* and 1032*b* of the short cam pin 103 (and/or against the curved surface in between the forward surfaces 1031*a*, 1031*b* and the ramp surfaces 1032*a*, 1032*b*). In some cases, in addition to contacting (i) ramp surface 1032*a* of the short cam pin 103 and (ii) the ramp of the barrel extension 106 (as described above), the bearing 123*a* also contacts inner surface 1025.2 of the lateral bearing cavity 1025 (see FIG. 4B). Accordingly, after sufficient force is applied to the left and right ramp surfaces 1032*a* and 1032*b*, the short cam pin 103 moves rearward relative to the forward bolt 102 due to the force applied between the ramps of the barrel extension 106 and the forward bearings 123*a* and 123*b*, which causes the firearm operating system 100 to move from the deployed configuration to the retracted configuration. In some embodiments, the barrel extension 106 includes a plurality of flat portions on an outer surface thereof to facilitate an interface with a tool, such as a wrench. In some cases, the barrel extension 106 is an integral component of the barrel 50.

In some embodiments, the barrel extension 106 is removably attached to the barrel 50 while in other embodiments, the barrel extension 106 is integral or permanently attached to the barrel 50. For embodiments where the barrel extension 106 is removably attached to the barrel 50, the barrel extension 106 may be threaded onto the barrel 50, press-fit on the barrel 50, pinned to the barrel 50, and/or attached in any other appropriate way. Removable attachment of the barrel extension 106 allows a barrel extension 106 to be replaced if/when wear occurs to one or both of the ramps located between recesses 1061 and the rear surfaces 1062.

As the bolt assembly (the forward bolt 102, the short cam pin 103, the carrier 105, and other related components) begins moving rearward away from the chamber (as described above), the rear bearing 123*c* (disposed within the upper bearing cavity 1028 of the forward bolt 102) approaches or reaches the interface surface 1042 of the long cam pin 104. The interaction with the interface surface 1042 may cause the rear bearing 123*c* to move downward. However, downward movement of the rear bearing 123*c* is only possible when the upper recess 1034 of the short cam pin 103 is located adjacent to the rear bearing 123*c*. In other words, if the short cam pin 103 is in the forward position relative to the forward bolt 102 (i.e., when the firing pin 108 is functional, as described above), the rear bearing 123*c* cannot move downward thus preventing rearward movement of the bolt assembly because the rear bearing 123*c* presses against the interface surface 1042 of the long cam pin 104. As described above, firing a cartridge causes bearings 123*a*, 123*b* to press left and right ramp surfaces 1032*a*, 1032*b*, respectively, causing the short cam pin 103 to move rearward relative to the forward bolt 102 and aligning the upper recess 1034 with the rear bearing 123*c*. After the rear bearing 123*c* enters upper recess 1034, the rear bearing 123*c* can move under/past interface surface 1042 of the long cam pin 104 thus allowing the bolt assembly to move further rearward. The interface between the long cam pin 104 and the rear bearing 123*c* locks the firearm operating system 100 in the retracted configuration where the short cam pin 103 is in the rearward position relative to the forward bolt 102 because the outer surface 123.1 of the rear bearing 123*c* bears against an underside of the long cam pin 104 (i.e., anything between the interface surface 1042 and the aft end 1402) to retain the rear bearing 123*c* within the upper recess 1034.

According to certain embodiments of the present invention, as shown in FIGS. 11-25C, a firearm operating system 2000 may include a forward bolt 2020, a short cam pin 2030, a carrier 2050, and a barrel extension 2060. The firearm operating system 2000 may be incorporated into a firearm that includes an upper receiver 30 and a barrel 50 (for example, see firearm 1 shown in FIG. 1). Other components (e.g., lower receiver 10, magazine 20, upper receiver 30, charging handle 32, handguard 40, etc.) which are the same as firearm operating system 100 are not illustrated for simplicity. In some cases, the firearm operating system 2000 is located within the upper receiver 30. The firearm operating system 2000 may be designed as an assembly of components to fit within a standard upper receiver (e.g., upper receiver 30 shown transparent in FIG. 11) for a known modular firearm such that the upper receiver 30 (including the firearm operating system 2000) can interface with a standard lower receiver 10. For example, the firearm operating system 2000 may be designed to function and engage with (i) components of AR-15 variant (civilian) or M16/M4 (military) firearms; (ii) components of AR-10 variant firearms; or (iii) components of any other relevant firearm.

In some embodiments, the firearm operating system 2000 is configured to be inserted into a U.S. military specification (milspec) upper receiver for an AR-15 variant (civilian) or M16/M4 (military) firearm (i.e., collectively AR-15 style firearms).

FIGS. 12A-13B show many of the relevant components of the firearm operating system 2000 in situ. As described in greater detail below, in some embodiments, at least a portion of a forward section 2038 of the short cam pin 2030 is disposed within an internal cavity of the forward bolt 2020 (e.g., rear cavity 2029) and at least a portion of a rear section 2039 of the short cam pin 2030 is disposed within an internal cavity of the carrier 2050 (e.g., cavity 2051) wherein the forward bolt 2020 is located on a forward side of the carrier 2050. The forward section 2038 of the short cam pin 2030 may include a lower flat portion 2035 to match the internal shape of the rear cavity 2029 of the forward bolt 2020. In addition to not showing the magazine 20, the upper receiver 30, and the handguard 40 (as described above), in FIG. 13, the forward bolt 2020 and the carrier 2050 are transparent to better illustrate components of the firearm operating system 2000. Cycling of the firearm operating system 2000 is based on linear motion of various components in the forward/aft direction X including, for example, the forward bolt 2020, the short cam pin 2030, the carrier 2050, and the firing pin 2080.

In some embodiments, the forward bolt 2020, short cam pin 2030, the carrier 2050, and the firing pin 2080 combine together as one unit within the firearm operating system 2000. As shown in FIG. 14B, the forward bolt 2020 may be disposed on a forward side of the carrier 2050 such that, in some conditions, there is a gap g between an rear face 2107 of the forward bolt 2020 and a forward face 2052 of the carrier 2050. The short cam pin 2030 and the firing pin 2080 may each extend internally into and/or through a rear cavity 2029 (see FIGS. 15A-15C) of the forward bolt 2020 and through the cavity 2051 of the carrier 2050 (see FIGS. 18A-18B). In some cases, the firing pin 2080 extends through central hole 2027 of the forward bolt 2020 such that the firing pin 2080 may protrude into forward cavity 2028 of the forward bolt 2020 where the firing pin may interface with a cartridge. Although illustrated as a separate component, in some embodiments, the short cam pin 2030 may be an integral component of the carrier 2050. The firing pin 2080 may extend through a cavity 2033 of the short cam pin 2030 (see FIGS. 13, 16A, and 16B). The firearm operating system 2000 may include at least one forward retaining pin 2261 to constrain movement of the short cam pin 2030 relative to the forward bolt 2020 and/or the carrier 2050. The firearm operating system 2000 may include a vertical cam pin 2271 that extends through the carrier 2050 and the short cam pin 2030. In addition, the firearm operating system 2000 may include a bearing spacer 2040 that is disposed at least partially within a cavity 2059 of the carrier 2050.

Figure 14A:
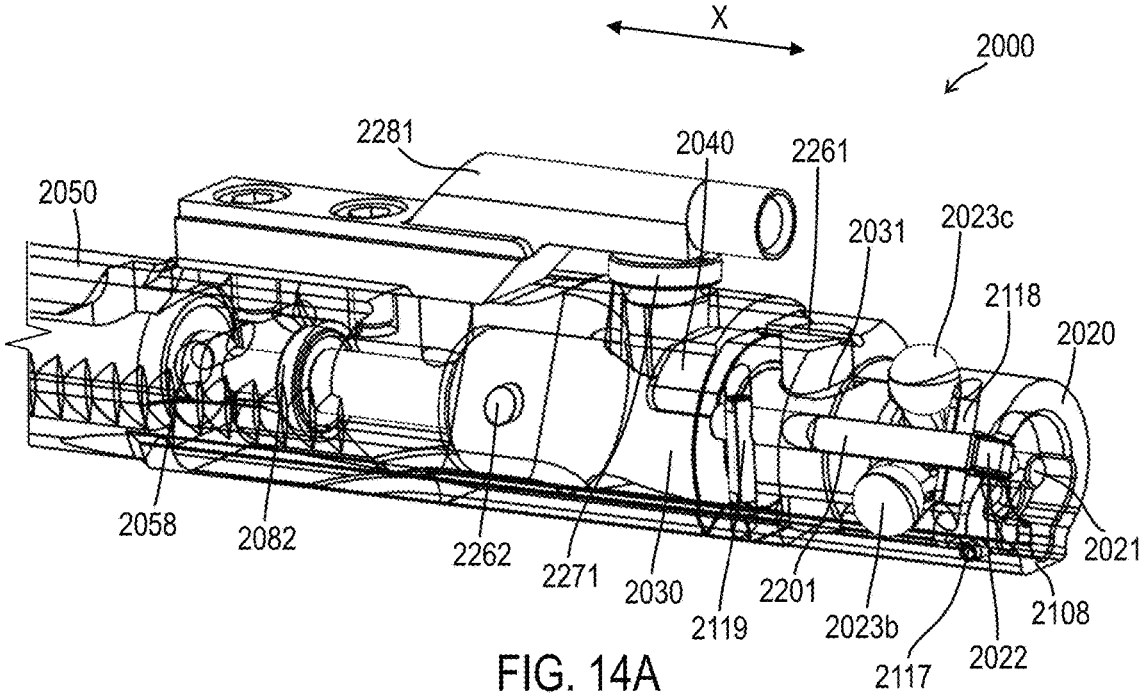
FIG. 14A is a right perspective view of the firearm operating system of FIG. 11.
Figure 14B:
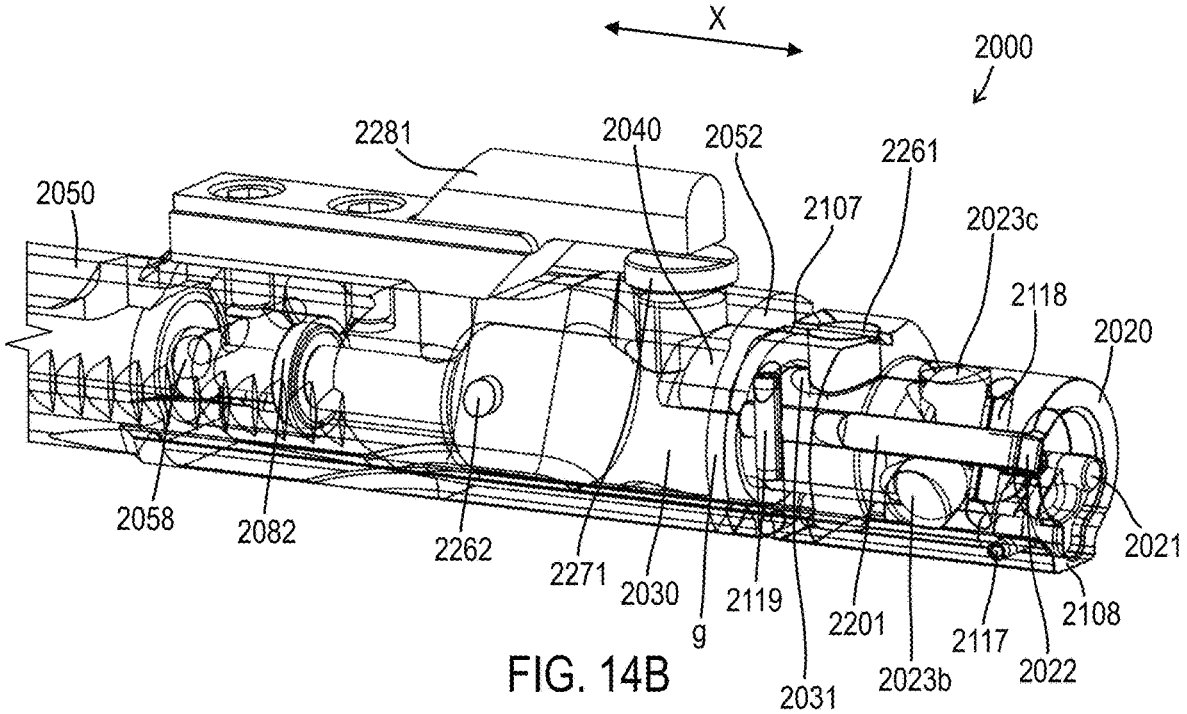
FIG. 14B is a right perspective view of the firearm operating system of FIG. 11.

As shown in FIGS. 14A and 14B, the forward bolt 2020 and the short cam pin 2030 may be movable relative to one another in the X-direction such that the firearm operating system 2000 has a deployed configuration and a retracted configuration. In some embodiments, in the retracted configuration, the short cam pin 2030 is in a rear position relative to the forward bolt 2020, which creates the gap g between an rear face 2107 of the forward bolt 2020 and a forward face 2052 of the carrier 2050 (see FIG. 14B). When the firearm operating system 2000 moves to the deployed configuration, which is illustrated in FIG. 14A, the short cam pin 2030 moves to a forward position relative to the forward bolt 2020, which reduces or eliminates the gap g between the rear face 2107 of the forward bolt 2020 and the forward face 2052 of the carrier 2050.

Figure 22:
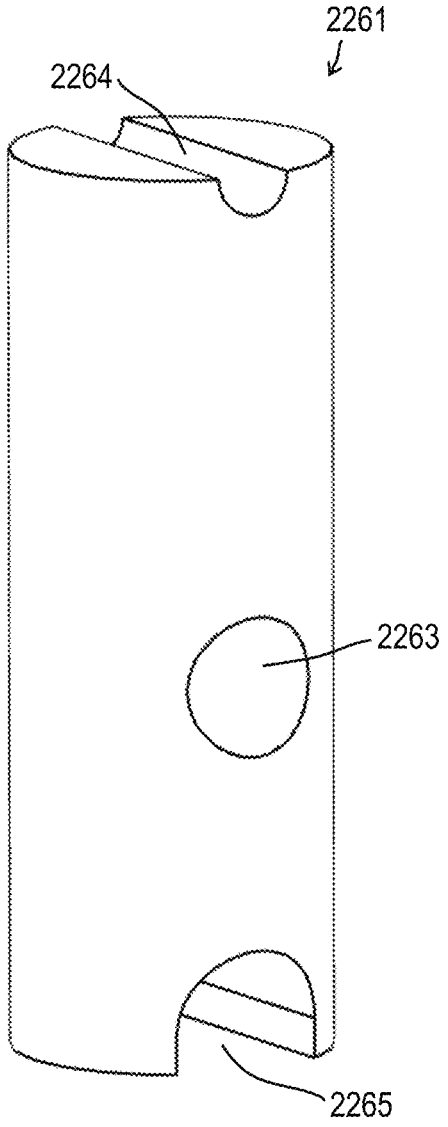
FIG. 22 is a top perspective view of a forward retaining pin of the firearm operating system of FIG. 11.

The distance or magnitude of gap g may be determined by the geometry of the interface between the forward bolt 2020 and the short cam pin 2030. In some embodiments, the interface between the forward bolt 2020 and the short cam pin 2030 is based on forward retaining pin 2261. An exemplary forward retaining pin 2261, which includes at least one hole 2263, is illustrated in FIG. 22. The forward retaining pin 2261 may interface with hole 2112 of the forward bolt 2020, and hole 2112 may be a tight tolerance hole that approximately matches the dimension of the forward retaining pin 2261. The forward retaining pin 2261 may also interface with hole 2031 of the short cam pin 2030 (located in the forward section of the short cam pin 2030). In some embodiments, the hole 2031 of the short cam pin 2030 is a slotted hole such that the forward retaining pin 2261 can slide in the X-direction to allow the short cam pin 2030 and the forward bolt 2020 to move in the X-direction relative to one another (i.e., to define the deployed configuration and the retracted configuration). In some embodiments, the geometry of the slotted hole 2031 defines the maximum relative motion between the forward bolt 2020 and the short cam pin 2030 and thus the carrier 2050 (i.e., the total distance of gap g).

In FIG. 14A, the forward retaining pin 2261 is biased toward the rear end of the slotted hole 2031, which dictates that the short cam pin 2030 and the carrier 2050 are located in a forward position relative to the forward bolt 2020 (i.e., reducing or eliminating the gap g). As discussed in greater detail below, forward movement of the short cam pin 2030 causes the forward surfaces 2036*a*, 2036*b*, and 2036*c* of the short cam pin 2030 to contact and push the bearings 2023*a*, 2023*b*, and 2023*c* (respectively) outward toward the exterior of the forward bolt 2020. In FIG. 14B, the forward retaining pin 2261 is biased toward the front end of the slotted hole 2031, which dictates that the short cam pin 2030 and the carrier 2050 are located in a rear position relative to the forward bolt 2020 (i.e., increasing the gap g). As discussed in greater detail below, rearward movement of the short cam pin 2030 causes the forward surfaces 2036*a*, 2036*b*, and 2036*c* of the short cam pin 2030 to move away from and thus allow the bearings 2023*a*, 2023*b*, and 2023*c* (respectively) to retract and move inward toward the interior of the forward bolt 2020.

In some embodiments, the forward retaining pin 2261 is cylindrical (e.g., see FIG. 22) such that rotation may occur within hole 2112 and/or hole 2031. In other embodiments, the forward retaining pin 2261 includes a shape that limits rotation within hole 2112 and/or hole 2031 (e.g., see flat surface 126.1 of the retaining pin 126). As shown in FIG. 22, the forward retaining pin 2261 may include an upper slot 2264 and a lower slot 2265 to ensure that the hole 2263 remains aligned with the X-direction such that the firing pin 2080 passes through hole 2263. In particular, the lower slot 2265 may be aligned with hole 2111 of the forward bolt 2020 such that the lower slot 2265 engages the spring for ejector 2021. In other words, if the forward retaining pin 2261 was not properly aligned, the ejector 2021 and the related spring (within hole 2111) would not be capable of being installed properly (i.e., the forward retaining pin 2261 would block the spring for seating properly). The upper slot 2264 may act as a visual indicator for proper alignment and/or may be an interface for a flat-head screwdriver for rotating the forward retaining pin 2261.

As shown in FIGS. 12A-14B, 16A-16B, and 18A-18B, the firearm operating system 2000 may include a rear retaining pin 2262 that engages hole 2056 of the carrier 2050 and hole 2034 of the short cam pin 2030 (in the rear section 2039 of the short cam pin 2030). In some embodiments, the hole 2034 and the hole 2056 are both tight tolerance holes such that relative motion of the short cam pin 2030 and the carrier 2050 is constrained to prevent movement between the short cam pin 2030 and the carrier 2050. The rear retaining pin 2262 may include a first end 2267, a second end 2268, and a notch 2266 that engages the firing pin 2080 (see FIG. 24). The first end 2267 may include a contoured or angled surface to match an outer surface of the carrier 2050. As shown in FIG. 12B, the second end 2268 may be a flat surface that (when the rear retaining pin 2262 is installed) is disposed within a recess or counterbored area of the carrier 2050. In some embodiments, in addition to the rear retaining pin 2262, a location between the short cam pin 2030 and the carrier 2050 may also be defined by an interaction between an internal step 2054 of the carrier 2050 (see FIG. 18B) and a rear face 2037.2 of the short cam pin 2030 (see FIGS. 16A and 16B). The internal step 2054 of the carrier 2050 is optional and may not be included in some embodiments. The carrier 2050 is shown transparent in FIG. 18B for illustrative purposes.

Figure 23:
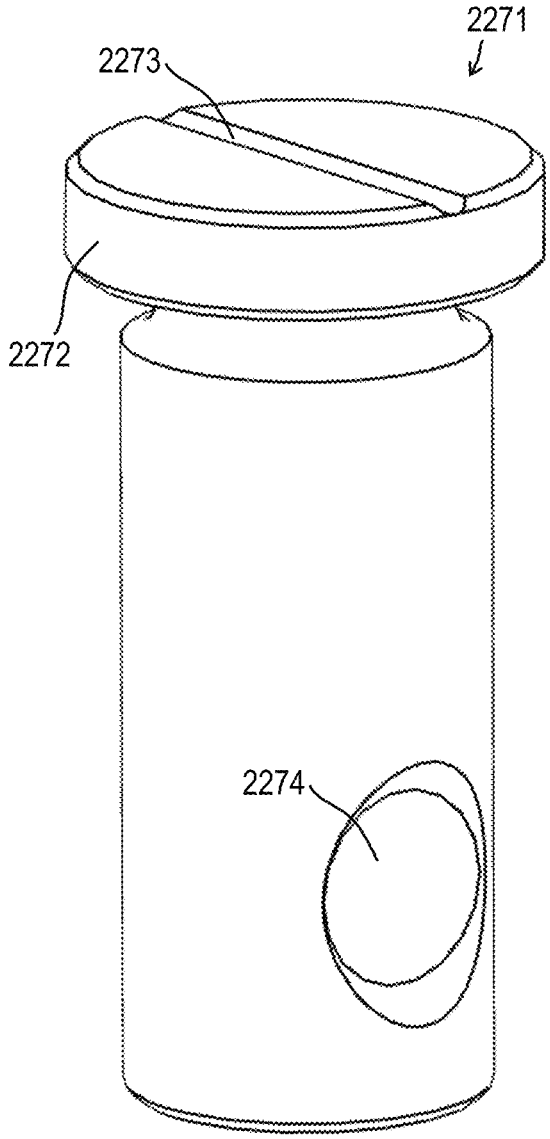
FIG. 23 is a top perspective view of a vertical cam pin of the firearm operating system of FIG. 11.
Figure 24:
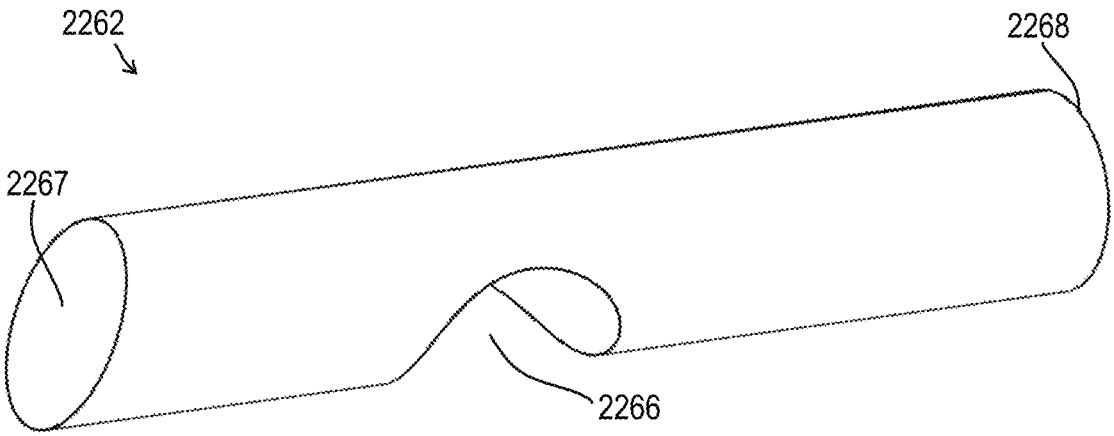
FIG. 24 is a perspective view of a rear retaining pin of the firearm operating system of FIG. 11.
Figure 25:
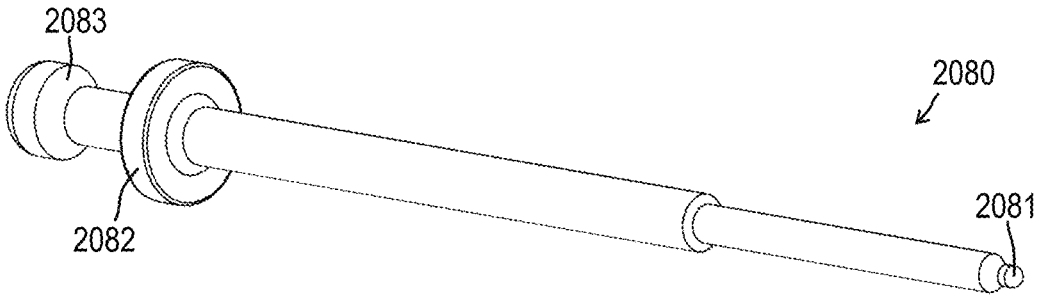
FIG. 25 is a front perspective view of a firing pin of the firearm operating system of FIG. 11.

The firearm operating system 2000 may also include a vertical cam pin 2271 that engages hole 2055 of the carrier 2050 and hole 2032 of the short cam pin 2030 (in the rear section 2039 of the short cam pin 2030). As shown in FIG. 23, the vertical cam pin 2271 may include a head 2272, at least one hole 2274 and a slot 2273 to ensure that the hole 2274 remains aligned with the X-direction such that the firing pin 2080 passes through hole 2274. The slot 2273 may act as a visual indicator for proper alignment and/or may be an interface for a flat-head screwdriver for rotating the vertical cam pin 2271. In some embodiments, the hole 2055 of the carrier 2050 and/or the hole 2032 of the short cam pin 2030 is contoured such that the vertical cam pin 2271 can rotate about hole 2274 (i.e., about the firing pin 2080).

Figure 17:
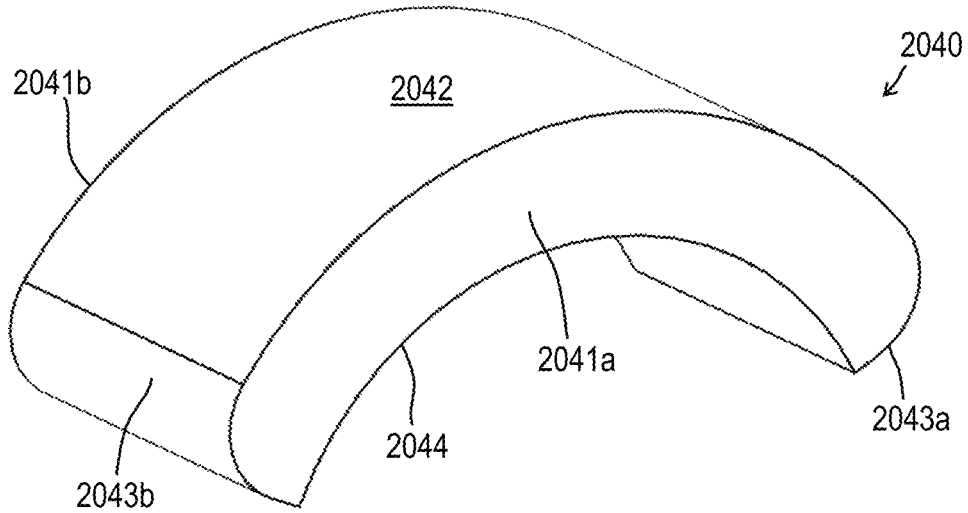
FIG. 17 is a top perspective view of a bearing retractor of the firearm operating system of FIG. 11.

In some embodiments, the vertical cam pin 2271 interacts with the bearing spacer 2040. As shown in FIG. 17, the bearing spacer 2040 may be a partially annular shape (i.e., a partial annular rod) that includes a forward surface 2041*a*, a rear surface 2041*b*, an outer surface 2042, an inner surface 2044, a left end 2043*a*, and a right end 2043*b*. The bearing spacer 2040 may be at least partially disposed within the cavity 2059 of the carrier 2050. In some embodiments, the shape of the cavity 2059 corresponds to the bearing spacer 2040 such that the left end 2043*a* and the right end 2043*b* engage with the outer edges of the cavity 2059 while at least part of the outer surface 2042 slides against the underside of the cavity 2059.

For the firing pin 2080 to function (i.e., for the forward end 2081 of the firing pin 2080 to contact and cause the cartridge 2 to discharge), the firearm operating system 2000 must be in the deployed configuration (i.e., the short cam pin 2030 must be located in a forward position relative to the forward bolt 2020 as shown in FIG. 14A). In other words, the forward surfaces 2036*a*, 2036*b*, and 2036*c* of the short cam pin 2030 must be in a forward position, which affects the position of the bearings 2023*a*, 2023*b*, and 2023*c* thus causing these bearings to interface with recesses 2061*a*,

2061*b*, and 2061*c*, respectively, of the barrel extension 2060. In some cases, forward movement of the short cam pin 2030 relative to the forward bolt 2020 is constrained by (i) the bearing spacer 2040 pressing against the rear face 2107 of the forward bolt 2020, (ii) the front face 2037.1 of the short cam pin 2030 pressing against the rear face 2107 of the forward bolt 2020, and/or (iii) any other appropriate way. These constraints affect the firing pin 2080 because the flange 2082 of the firing pin 2080 engages at least one of (in some cases both) the rear portion 2302 of the short cam pin 2030 and internal step 2057 of the carrier 2050. Accordingly, a cartridge 2 can only be fired when the firearm operating system 2000 is in the deployed configuration. As described in more detail below, the deployed configuration includes a condition where bearings 2023*a*, 2023*b*, and 2023*c* are engaged within recesses 2061*a*, 2061*b*, and 2061*c*, respectively.

The forward retaining pin 2261, the rear retaining pin 2262, and the vertical cam pin 2271 may be retained within their respective holes because the firing pin 2080 passes through hole 2263 of forward retaining pin 2261, through notch 2266 of rear retaining pin 2262, and through hole 2274 of vertical cam pin 2271 (as described above). Based on this configuration, to remove the forward retaining pin 2261, the rear retaining pin 2262, and/or the vertical cam pin 2271, the firing pin 2080 must first be removed. In addition, the hole 2112 of the forward bolt 2020 may be a blind hole such that the hole is only accessible from above (as shown in the drawings).

In addition, the firearm operating system 2000 allows the firearm 1 to include a barrel 50 without a hole for venting/redirecting gas pressure to the operating system. In other words, another advantage compared to conventional systems is that the barrel 50 of the firearm operating system 2000 is simpler and less likely to corrode or otherwise fail due to additional holes thus increasing longevity.

Figure 18A:
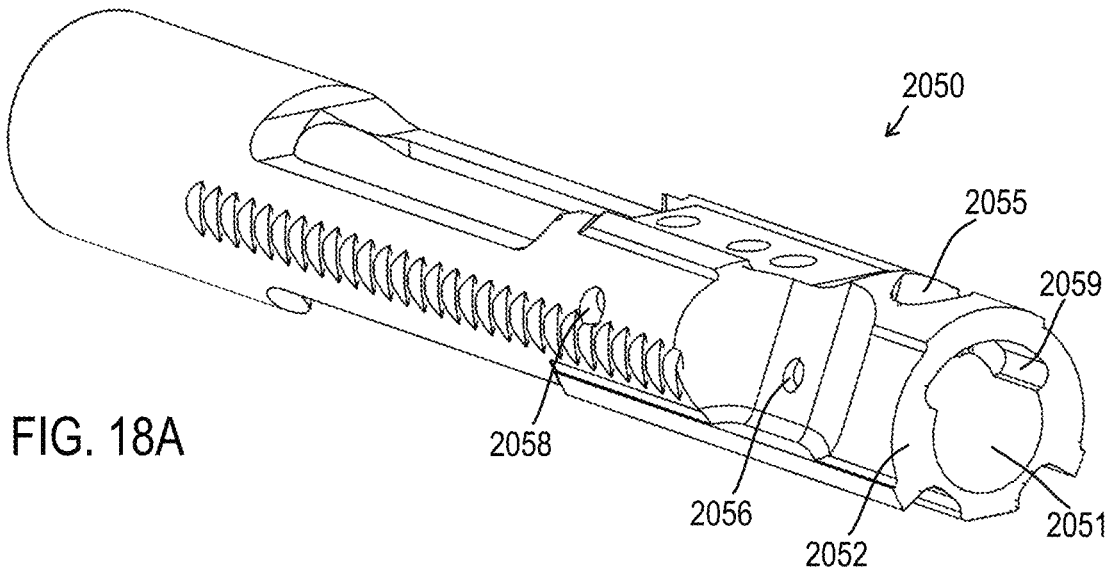
FIG. 18A is a front right perspective view of a carrier of the firearm operating system of FIG. 11.
Figure 18B:
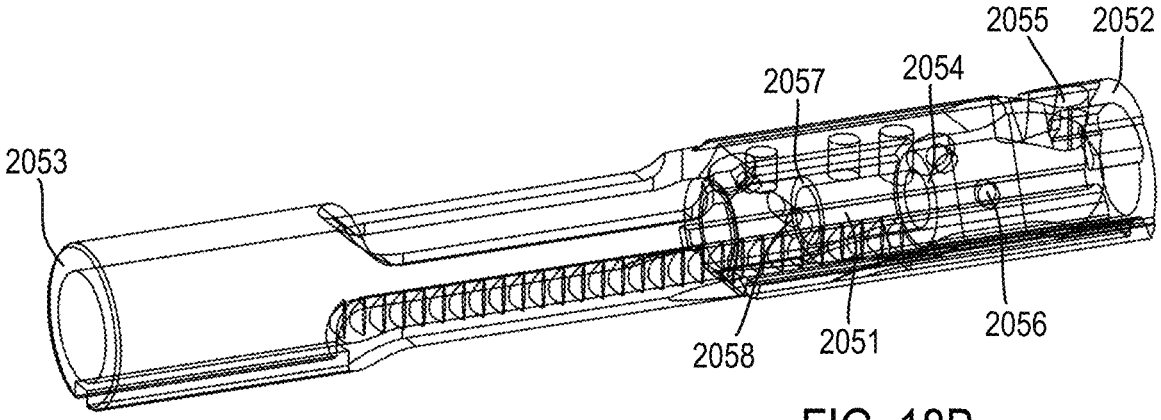
FIG. 18B is a rear right perspective view of the carrier of FIG. 18A.

In some embodiments, the firearm operating system 2000 includes an assembly pin that is inserted into hole 2058 of the carrier 2050 (see FIGS. 18A and 18B). When the assembly pin is inserted into hole 2058, the assembly pin may be at least partially disposed within cavity 2051 of the carrier 2050 such that the assembly pin interacts with the firing pin 2080. In particular, the assembly pin is disposed between the rear end 2083 and the flange 2082 of the firing pin 2080 such that the firing pin 2080 cannot be removed from the cavity 2033 of the short cam pin 2030 while the assembly pin is installed. In some cases, the assembly pin is similar to assembly pin 131.

Figure 12A:
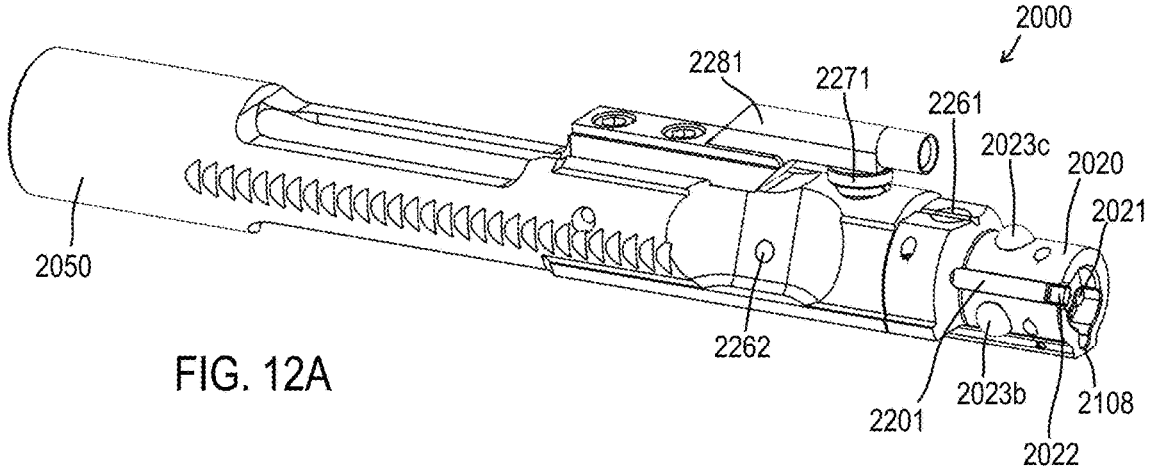
FIG. 12A is a right perspective view of the firearm operating system of FIG. 11.
Figure 12B:
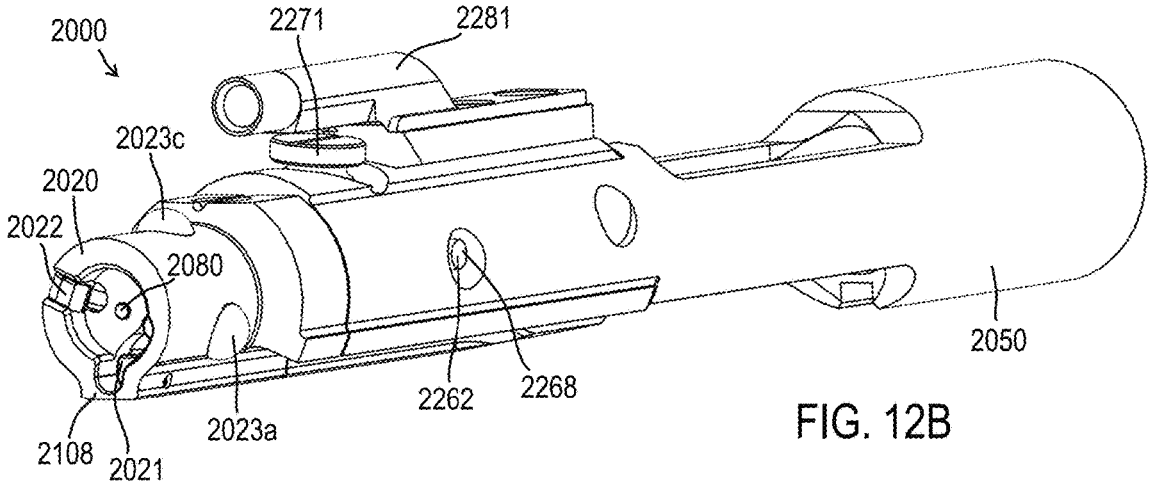
FIG. 12B is a left perspective view of the firearm operating system of FIG. 11.
Figure 13:
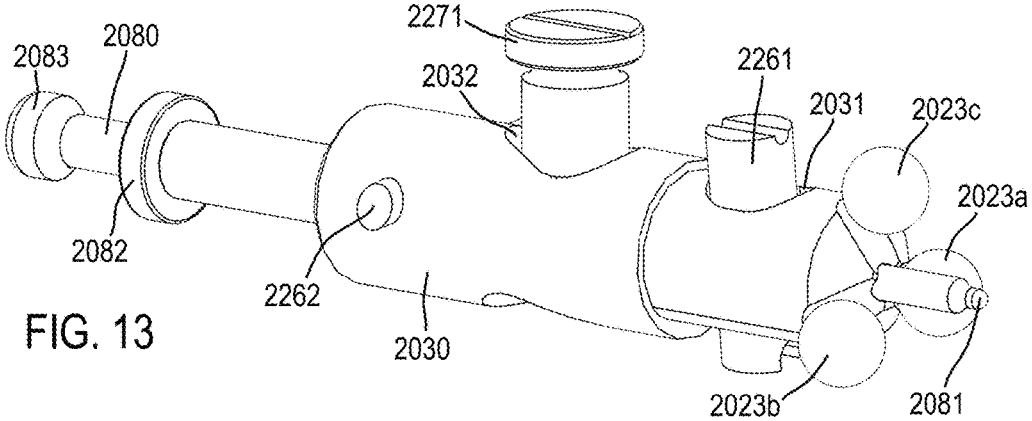
FIG. 13 is a top perspective view of a short cam pin of the firearm operating system of FIG. 11.
Figure 15A:
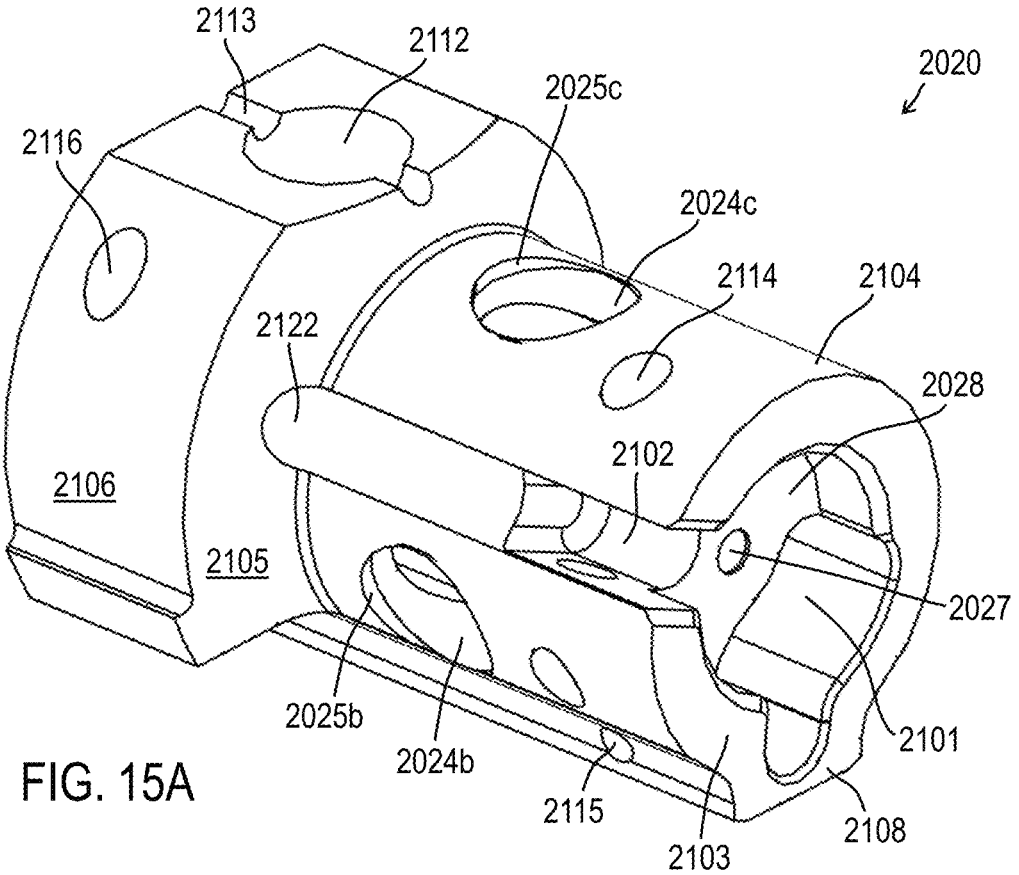
FIG. 15A is a front right perspective view of a forward bolt of the firearm operating system of FIG. 11.
Figure 15B:
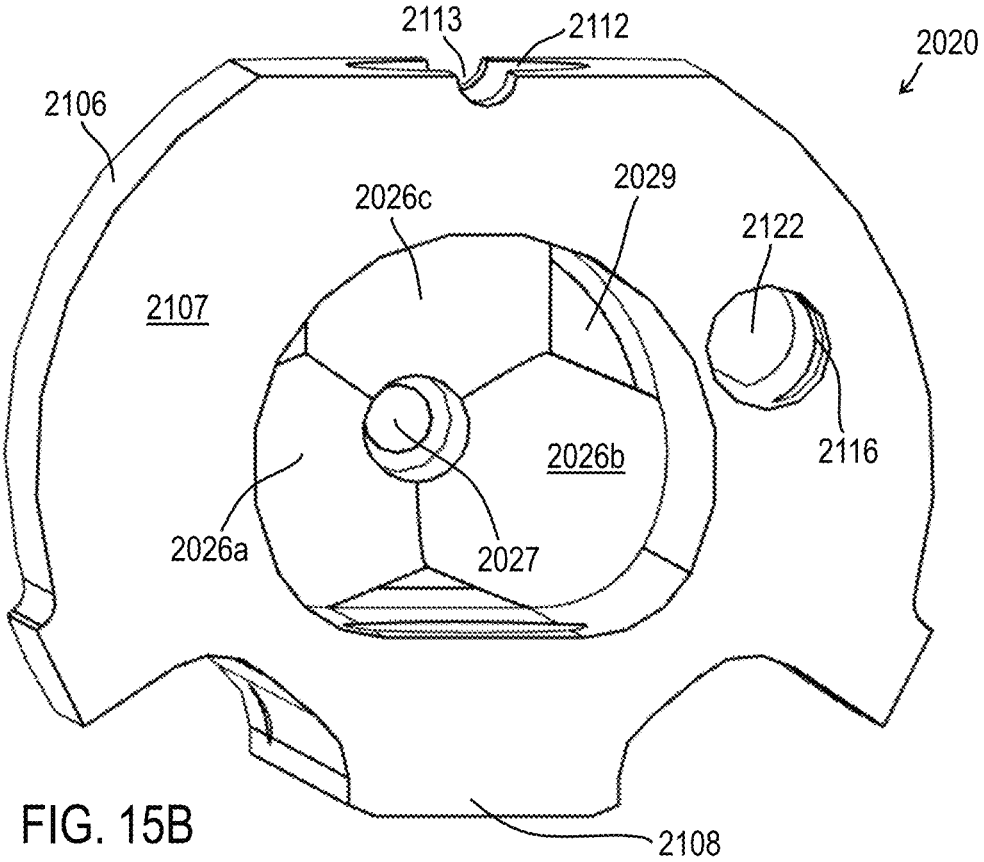
FIG. 15B is a rear left perspective view of the forward bolt of FIG. 15A.
Figure 15C:
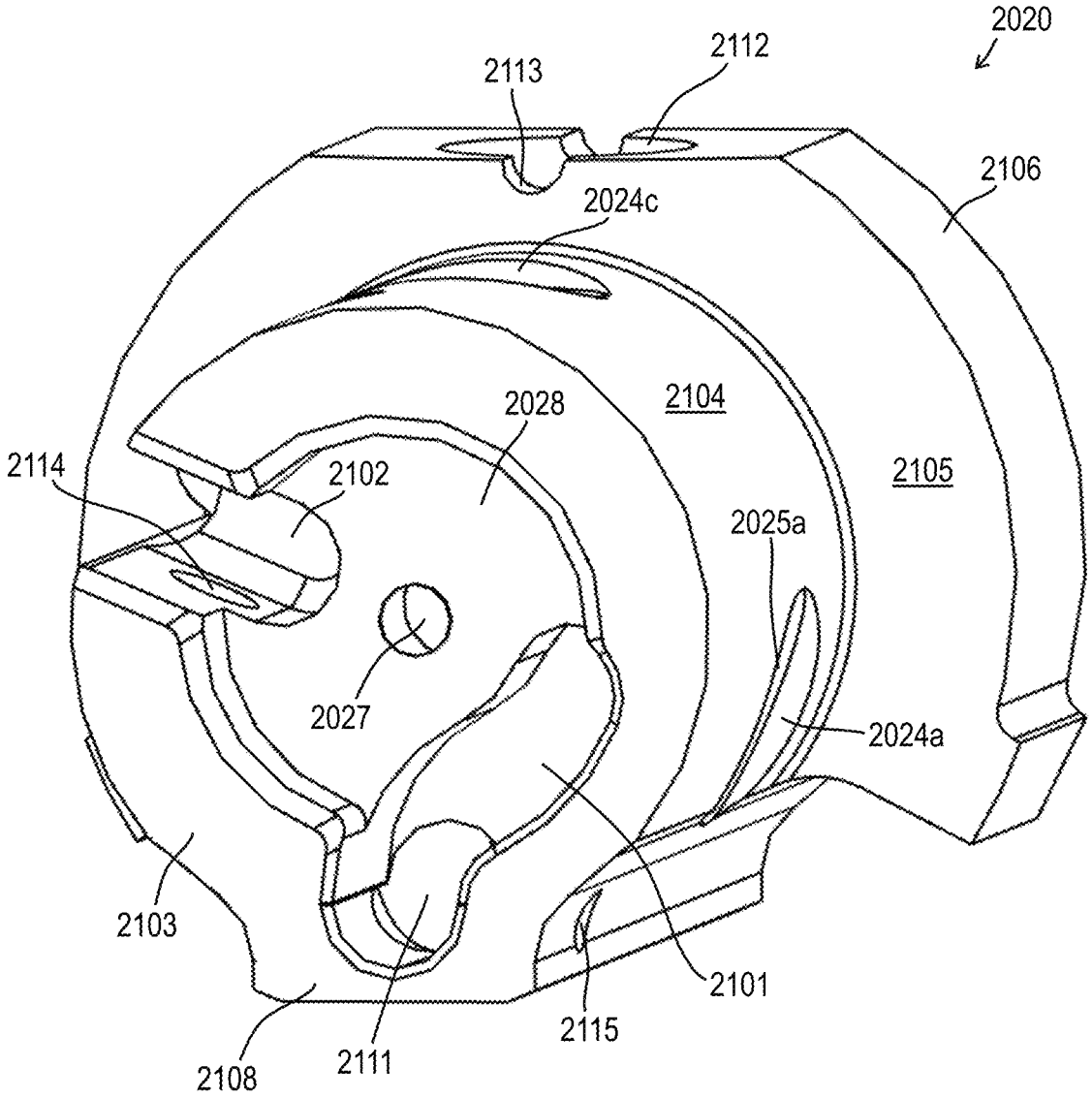
FIG. 15C is a front left perspective view of the forward bolt of FIG. 15A.

The forward bolt 2020 includes a forward face 2103, a rear face 2107, a lower portion 2108, a rear cavity 2029, an ejector hole 2101, an extractor cavity 2102, at least one bearing cavity 2024, and a forward cavity 2028, (see FIGS. 15A-15C). In some embodiments, the at least one bearing cavity 2024 includes a first bearing cavity 2024*a*, a second bearing cavity 2024*b*, and an third bearing cavity 2024*c*. As shown in FIGS. 12A and 12B, the forward bolt 2020 may interface with an ejector 2021, an extractor 2022, and at least one bearing 2023. In some embodiments, the at least one bearing 2023 includes a first bearing 2023*a*, a second bearing 2023*b*, and a third bearing 2023*c*. Although the bearings 2023 are illustrated as spherical (ball) bearings, the bearings 2023 may have any configuration, including, for example, cylindrical, tapered, needle, toroidal, annular, etc. In some cases, the first bearing 2023*a* is disposed in the first bearing cavity 2024*a*, the second bearing 2023*b* is disposed in the second bearing cavity 2024*b*, and the third bearing 2023*c* is disposed in the third bearing cavity 2024*c*. The bearings may be retained within their respective cavities. For example, each cavity 2024 may include a retaining portion 2025 that prevents the bearing 2023 from passing entirely through the cavity 2024 (i.e., where the bearing 2023 can partially protrude but cannot move entirely through the cavity 2024). The first bearing cavity 2024*a* may include a first retaining portion 2025*a*, the second bearing cavity 2024*b* may include a second retaining portion 2025*b*, and the third bearing cavity 2024*c* may include a third retaining portion 2025*c*. As one example, each retaining portion 2025 may include a machined profile near the outer edge where the dimension (e.g., diameter) of the cavity 2024 decreases when nearing the outer portion of the cavity 2024. The retaining portion 2025 may be an integral feature (e.g., a machined feature as described above, a welded feature, etc.) or may be an additional component added to the forward bolt 2020.

Figure 28A:
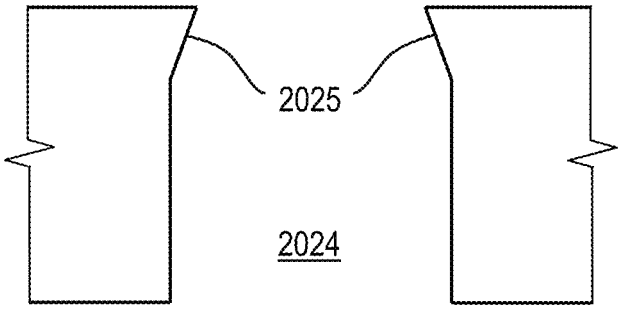
FIG. 28A is a schematic section view of a bearing cavity of the firearm operating system of FIG. 11.
Figure 28B:
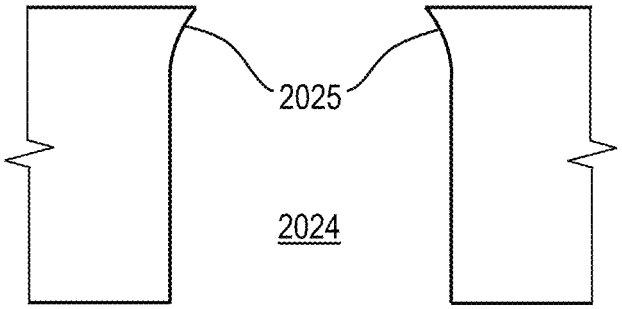
FIG. 28B is a schematic section view of a bearing cavity of the firearm operating system of FIG. 11.

FIGS. 28A and 28B each show schematic cross-section examples of a cavity 2024 that includes a retaining portion 2025. As shown in FIG. 28A, in some embodiments, the retaining portion 2025 is a tapered surface that reduces the size of the cavity 2024 linearly. For examples where the cavity 2024 has a circular cross-section, retaining portion 2025 is a tapered surface that reduces the diameter of the cavity 2024 and results in a conical profile. If the bearing 2023 is a spherical bearing (i.e., the illustrated embodiment for bearings 2023), the engagement between the retaining portion 2025 and the bearing 2023 may be formed as a curve (e.g., a circle). FIG. 28B shows embodiments where the retaining portion 2025 is a tapered surface that reduces the size of the cavity 2024 non-linearly. For examples where the cavity 2024 has a circular cross-section, retaining portion 2025 is a curved surface that reduces the diameter of the cavity 2024. In some examples, the interior of the retaining portion 2025 results in a spherical profile. If the bearing 2023 is a spherical bearing (i.e., the illustrated embodiment for bearings 2023), the engagement between the retaining portion 2025 and the bearing 2023 may be formed as a surface and/or a series of curves/circles.

Based on the configuration of the cavities 2024 and the retaining portions 2025, the bearings 2023 cannot exit outward through the cavities 2024. In some embodiments, the only option for removing the bearings 2023 is to disassemble the forward bolt 2020 and the short cam pin 2030 (which would require removing the firing pin 2080 and the forward retaining pin 2261). The bearings 2023 could then be removed through rear cavity 2029.

In some embodiments, the three bearings 2023 are evenly distributed around the surface of the forward bolt 2020 (i.e., approximately 120° apart from one another). In other cases, the bearings 2023 are not equally distributed in order to avoid features of the forward bolt 2020 (e.g., the ejector 2021, the extractor 2022, etc.). As one example, the first bearing 2023*a* is located at the 4 o'clock position when viewing the forward face 2103 of the forward bolt 2020 while the second bearing 2023*b* is located at the 8 o'clock position and the third bearing 2023*c* is located at the 12 o'clock position. Such an arrangement avoids the lower portion 2108 and the extractor cavity 2102 of the forward bolt 2020.

When the forward bolt 2020 moves forward over the top of the magazine 20 (located in the magazine well 11 of the lower receiver 10), the lower portion 2108 pushes the upper-most cartridge 2 out of the magazine 20 and toward the chamber of the firearm 1. When the cartridge 2 is in the chamber in a firing position, the cartridge 2 is approximately aligned with a center of the forward face 2103 of the forward bolt 2020 such that the central hole 2027 of the forward bolt 2020 is aligned with the primer of the cartridge 2 (to align the firing pin 2080 with the cartridge 2). When the cartridge 2 is in the firing position, forward motion of a forward end 2081 of the firing pin 2080 (e.g., caused by a hammer interacting with the rear end 2083 of the firing pin 2080) causes the cartridge 2 to discharge.

Figure 19A:
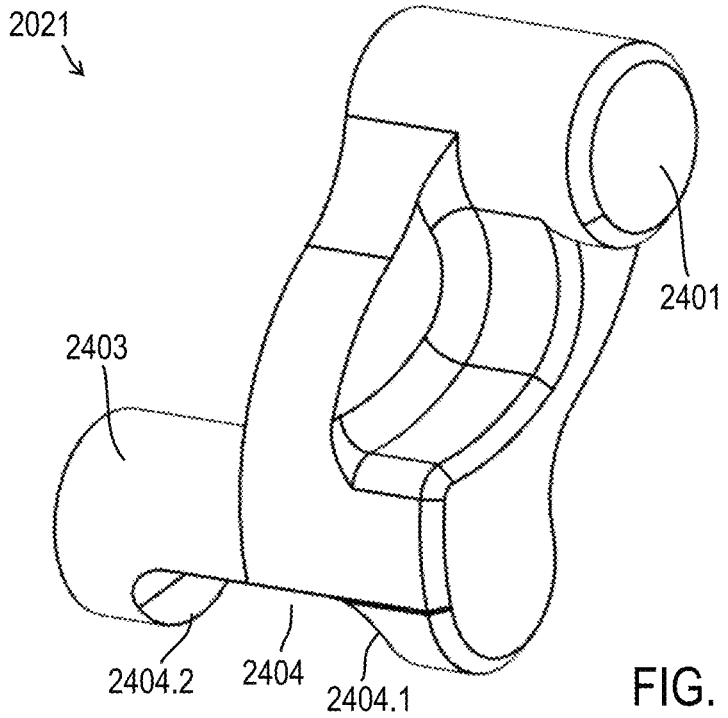
FIG. 19A is a front top perspective view of an ejector of the firearm operating system of FIG. 11.
Figure 19B:
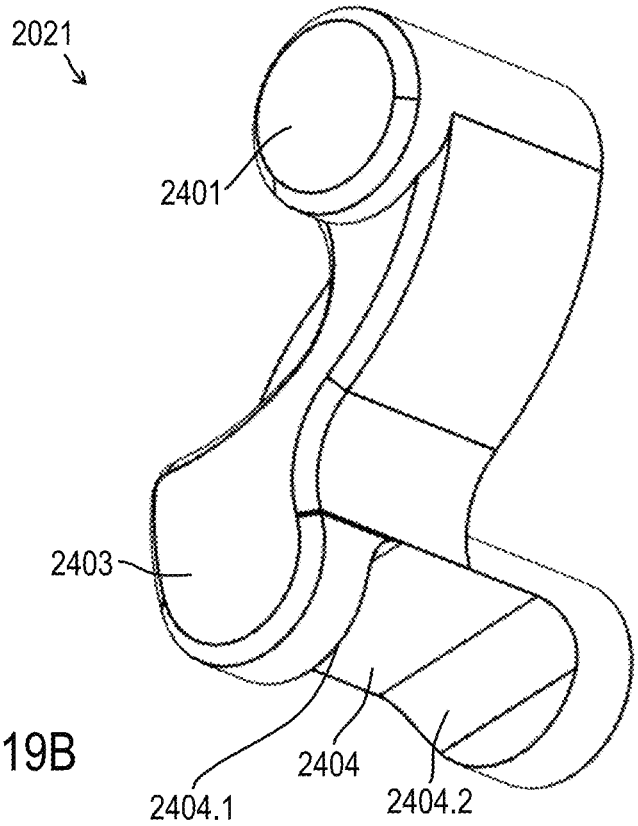
FIG. 19B is a front bottom perspective view of the ejector of FIG. 19A.

The ejector 2021 interfaces with the ejector hole 2101 of the forward bolt 2020. As shown in FIGS. 19A and 19B, in some embodiments, the ejector 2021 includes a forward interface 2401, a rear protrusion 2403, and a notch 2404. The forward interface 2401 may protrude forward relative to the other portions of the ejector 2021 such that the forward interface 2401 is the only portion of the ejector 2021 that contacts a cartridge disposed adjacent to a forward side of the forward bolt 2020. In some embodiments, the forward interface 2401 is disposed approximately 180° from the extractor 2022. However, based on the arrangement of the bearings 2023 described above, extending the ejector 2021 directly rearward from the forward interface 2401 would interfere with first bearing cavity 2024*a*. Accordingly, the ejector 2021 may be designed such that the rear protrusion 2403 extends rearward at the 6 o'clock position when viewing the forward face 2103 of the forward bolt 2020. To install the ejector 2021 into the forward bolt 2020, a spring is inserted into hole 2111, which will compress when the ejector 2021 is pushed rearward (see FIG. 15C). After inserting the ejector 2021 into the ejector hole 2101, the ejector 2021 is adjusted such that a portion of the notch 2404 is aligned with hole 2115 of the forward bolt 2020 and a pin 2117 is then inserted into hole 2115 (see FIGS. 14A and 14B). The pin 2117 may be a roll pin, a solid pin, or any other appropriate configuration used to retain the ejector 2021. The ejector spring is compressed within hole 2111 when the ejector 2021 is pushed rearward. For example, when a rim of a cartridge 2 is retained by extractor 2022, the rear surface of the cartridge presses the extractor rearward such that the forward interface 2401 is approximately flush with a rear wall or floor of the forward cavity 2028. In some embodiments, when the forward interface 2401 is approximately flush with the rear wall of the forward cavity 2028, the forward end 2404.1 of notch 2404 is adjacent to or in contact with pin 2117. When the forward bolt 2020 moves rearward due to either (i) manual operation/movement (e.g., operating the charging handle 32) or (ii) cycling of the firearm 1 after firing a cartridge (e.g., cartridge 2), the spring in hole 2111 pushes the ejector 2021 forward such that once the forward face 2103 reaches the ejection port 31 of the upper receiver 30, the ejector 2021 pushes the rear surface of a cartridge 2 (or an empty shell of a cartridge if a round was fired) causing the cartridge/shell to pivot about the extractor 2022 and exit the firearm 1.

Figure 20A:
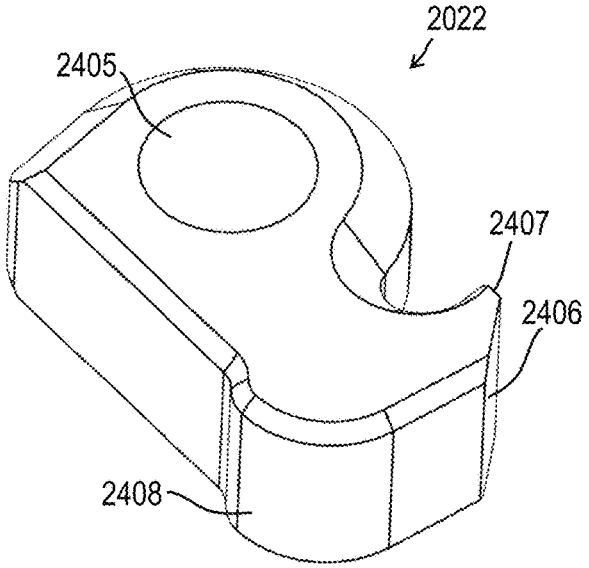
FIG. 20A is a front perspective view of an extractor of the firearm operating system of FIG. 11.
Figure 20B:
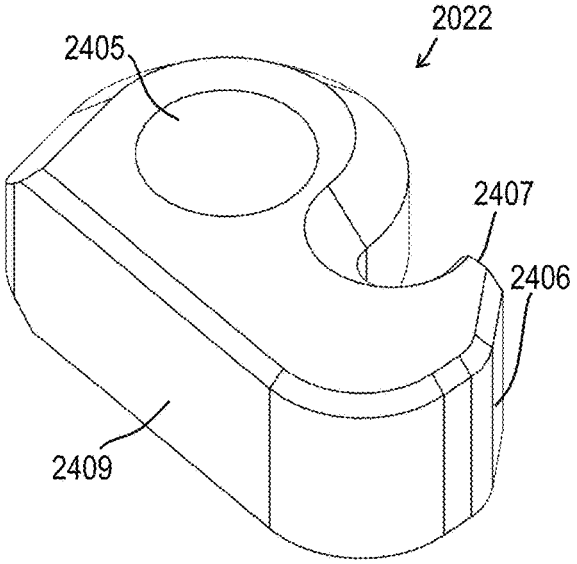
FIG. 20B is a front perspective view of an extractor of the firearm operating system of FIG. 11.
Figure 21:
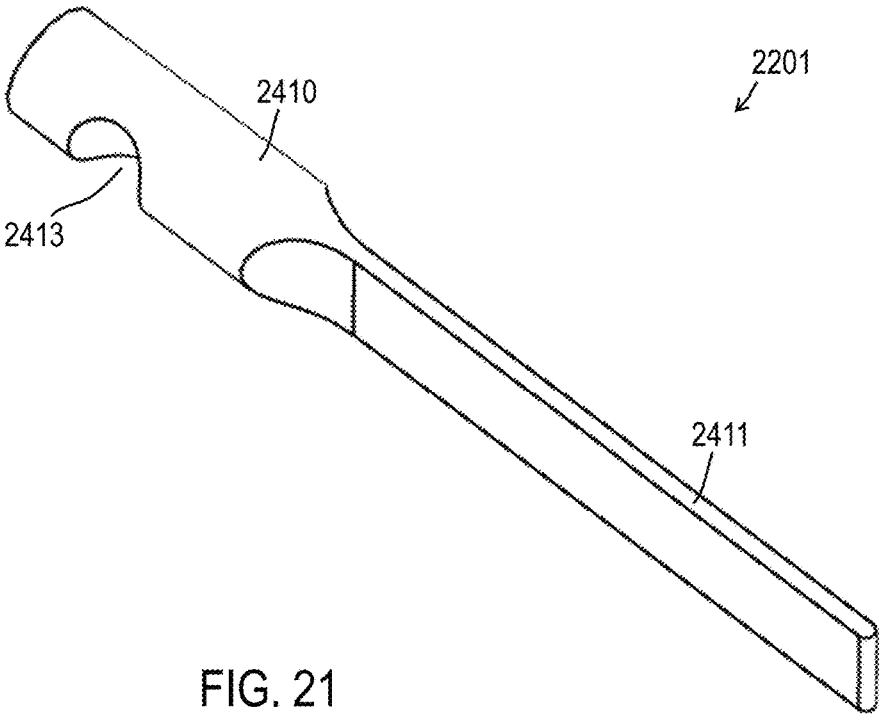
FIG. 21 is a front perspective view of an extractor spring of the firearm operating system of FIG. 11.

The extractor 2022 may be located within the extractor cavity 2102 of the forward bolt 2020 such that the extractor 2022 can move based on the geometry of the cavity 2102 and an interface with an extractor spring 2201 inserted into extractor spring cavity 2122. As shown in FIGS. 20A and 20B, the extractor 2022 may include a hole 2405, a front surface 2406, and a hook member 2407. In some embodiments, the extractor 2022 rotates about hole 2405 and lip 2407 engages the rim of a cartridge or empty shell. The extractor 2022 may be arranged such that the hole 2405 is aligned and/or coaxial with hole 2114 of the forward bolt 2020 (see FIGS. 15A and 15C). After inserting the extractor 2022 into the extractor cavity 2102, the extractor 2022 is adjusted such that hole 2405 is aligned with hole 2114 of the forward bolt 2020 and a pin 2118 is then inserted through hole 2114 and into hole 2405 (see FIGS. 14A and 14B). The pin 2118 may be a roll pin, a solid pin, or any other appropriate configuration used to retain the extractor 2022. The hook member 2407 of extractor 2022 may be configured to engage a cannelure and/or a rim of the cartridge 2 such that the extractor 2022 guides the cartridge 2 (or the empty shell of a cartridge if a round was fired) in the direction of the ejection port 31 of the upper receiver 30 using the force provided by the ejector 2021. The extractor 2022 may include an outer protrusion 2408 as shown in FIG. 20A, which acts as a cam surface. In some cases, the extractor 2022 may include a continuous or flat outer surface 2409 (see FIG. 20B). The barrel extension 2060 may include a corresponding recess 2064 for the extractor 2022 when the firearm operating system 2000 is in battery (see FIGS. 26A-26D).

In some embodiments, rotation of the extractor 2022 depends on an interface with the extractor spring 2201. The extractor spring 2201 may include a rear portion 2410, a front portion 2411, and a notch 2413. In some cases, the rear portion 2410 may be cylindrical and the front portion 2411 may include a blade shape having a rectangular cross section. The front portion 2411 may function similar to a leaf spring. The extractor spring 2201 is inserted into hole 2122 of the forward bolt 2020 such that the notch 2413 is aligned with hole 2116 of the forward bolt 2020. A pin 2119 is then inserted through hole 2116 and into notch 2413 (see FIGS. 14A-15B). The pin 2119 may be a roll pin, a solid pin, or any other appropriate configuration used to retain the extractor spring 2201.

Manual operation/cycling of the firearm operating system 2000 may include rearward movement of the charging handle 32 where the charging handle 32 engages a portion of the firearm operating system 2000. For example, in some embodiments, the charging handle 32 engages a portion of the forward bolt 2020. In some embodiments, the charging handle 32 engages a gas key 2281. The gas key 2281 may include a cylindrical protrusion with an open cavity, as shown in FIG. 14A. In other cases, the gas key 2281 has a shorter overall length without any cylindrical protrusion, as shown in FIG. 14B.

As described above, the firearm operating system 2000 may include at least one bearing 2023. In some embodiments, each bearing 2023 has a diameter of approximately 0.1" (0.25 cm) to approximately 0.4" (1.02 cm). In other cases, each bearing 2023 has a diameter of approximately 0.2" (0.51 cm) to approximately 0.3" (0.76 cm). In other cases, each bearing has a diameter of approximately 0.25" (0.635 cm).

The bearings 2023 may interface with other components of the firearm operating system 2000. For example, the bearings 2023*a*, 2023*b*, and 2023*c* may each have an internal configuration (see FIG. 14B) where a surface of each bearing 2023 is approximately flush with a respective surface of the forward bolt 2020. For example, in the internal configuration, a portion of the surface of the first bearing 2023*a* is approximately flush with the left side surface of the forward bolt 2020. Similarly, a portion of the outer surface of the second bearing 2023*b* is approximately flush with the right side surface of the forward bolt 2020 and a portion of the outer surface of the third bearing 2023*c* is approximately flush with the upper surface of the forward bolt 2020. The bearings 2023*a*, 2023*b*, and 2023*c* may be capable of moving outward to an extended configuration where the bearings 2023*a*, 2023*b*, and 2023*c* move outward relative to their respective cavity 2024 such that at least a portion of each of the bearings 2023*a*, 2023*b*, and 2023*c* extend beyond the respective surfaces of the forward bolt 2020. For example, in the extended configuration, a portion of the surface of the first bearing 2023*a* protrudes beyond the left side surface of the forward bolt 2020, a portion of the surface of the second bearing 2023*b* protrudes beyond the right side surface of the forward bolt 2020, and a portion of the surface of the third bearing 2023*c* protrudes beyond the upper surface of the forward bolt 2020. In some embodiments, the bearings 2023*a*, 2023*b*, and 2023*c* may interface with (i) the short cam pin 2030 (internal to the forward bolt 2020) and/or (ii) the barrel extension 2060 (external to the forward bolt 2020).

Figure 11:
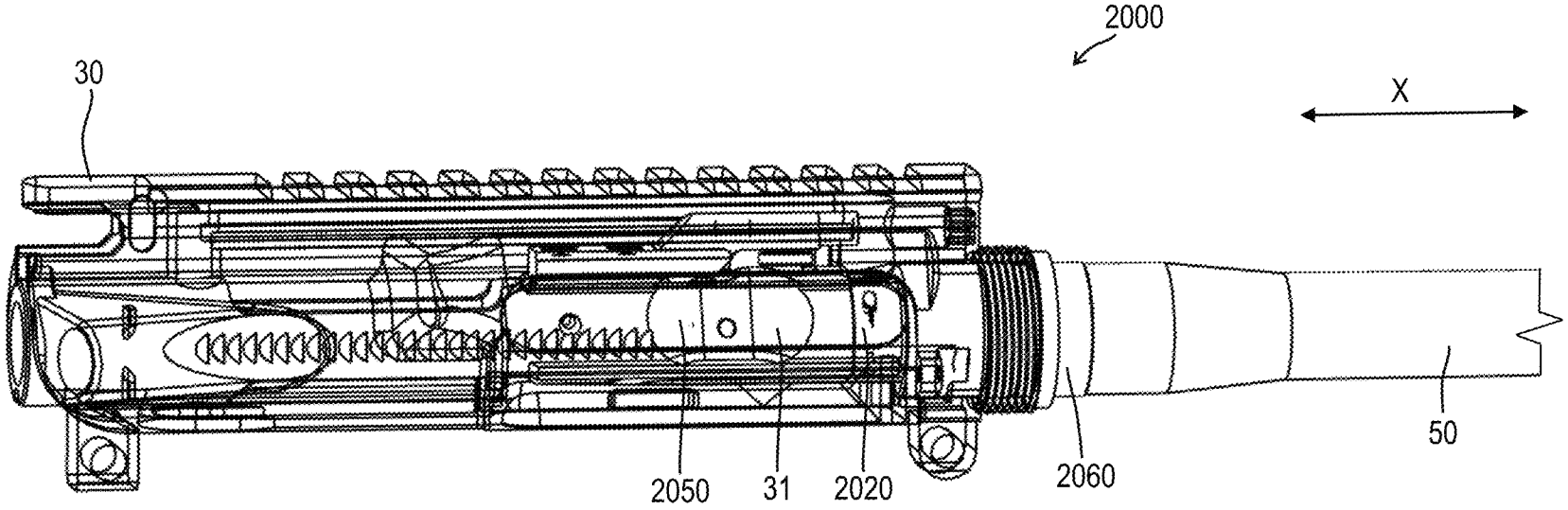
FIG. 11 is a perspective view of a firearm operating system for a firearm according to certain embodiments of the present invention.

When the firearm operating system 2000 is in the forwardmost configuration relative to the firearm 1 (see FIG. 11), the bearings 2023 interface with both the short cam pin 2030 and the barrel extension 2060. There is forward pressure on the rear portion 2053 of the carrier 2050 (e.g., due to forward momentum of the components of firearm operating system 2000 and/or pressure from a buffer spring, which is not shown), which consequently pushes the short cam pin 2030 in the forward direction. The forward end 2301 of the short cam pin 2030 may include a tapered or narrowed portion. In some embodiments, the forward end 2301 includes a conical profile that narrows toward the front. Forward pressure on the short cam pin 2030 causes the forward surfaces 2036*a*, 2036*b*, and 2036*c* to push the bearings 2023*a*, 2023*b*, and 2023*c* outward (respectively). Outward pressure on the bearings 2023*a*, 2023*b*, and 2023*c* causes each bearing to engage the relevant recess 2061 of the barrel extension 2060. Specifically, outward pressure from forward surface 2036*a* pushes bearing 2023*a* into recess 2061*a*, outward pressure from forward surface 2036*b* pushes bearing 2023*b* into recess 2061*b*, and outward pressure from forward surface 2036*c* pushes bearing 2023*c* into recess 2061*c*. Accordingly, when the firearm operating system 2000 is in the deployed configuration (see FIG. 14) and located in a forward position as shown in FIG. 11, the bearing(s) 2036 engage the barrel extension 2060 to lock the firearm operating system 2000 in a condition ready to fire (i.e., in battery). In some embodiments, when the firearm operating system 2000 is in battery, the profile surface 2105 of the forward bolt 2020 is approximately in contact with the rear ramp surface 2062 of the barrel extension 2060. In other words, when the bearings 2023 engage the recesses 2061, these two surfaces (profile surface 2105 and rear ramp surface 2062) may be approximately line to line. The two surfaces (profile surface 2105 and rear ramp surface 2062) may be parallel to one another. When the firearm operating system 2000 is in battery, the lower portion 2108 of the forward bolt 2020 may be disposed in the corresponding recess 2063 of the barrel extension.

After a cartridge 2 is fired, the mechanisms described above cause a delay before the bolt assembly (the forward bolt 2020, short cam pin 2030, the carrier 2050, and other related components) can move rearward away from the chamber (in the X-direction). In particular, the bearings 2023*a*, 2023*b*, and 2023*c* press against the curved/tapered surface on the rear side of the recesses 2061*a*, 2061*b*, and 2061*c*, respectively, of the barrel extension 2060. In other words, bearing 2023*a* presses against the surface of recess 2061*a*, bearing 2023*b* presses against the surface of recess 2061*b*, and bearing 2023*c* presses against the surface of recess 2061*c* (see FIGS. 26A-26C). Each of the recesses 2061 tapers to a smaller diameter when moving rearward. The rearward taper of these surfaces of the recesses 2061 may be linear and/or may be curved. The interaction between these recesses 2061 of the barrel extension 2060 and the bearings 2023 presses the bearings 2023 inward (toward the interior of the forward bolt 2020) while other portions of the bearings 2023 press against the forward surfaces 2036 of the short cam pin 2030. In some cases, the surface geometry of (i) the recesses 2061, (ii) the bearings 2023, and/or (iii) the forward surfaces 2036 may be designed to determine the distance, time, rate, force, etc. of the movement of the bearings 2023 after the cartridge 2 has been fired. For example, the geometry of the recesses 2061 and/or the forward surfaces 2036 may be changed to increase/decrease cycling rate, adapt for different ammunition (e.g., caliber, powder charge, etc.), optimize for suppressed/unsuppressed, or any other appropriate purpose. Although the recesses 2061 are illustrated as being oriented in the radial direction (perpendicular to the outer surface of the forward bolt 2020 and intersecting a center), the recesses 2061 may be oriented in any other appropriate direction.

Accordingly, after sufficient force is applied to the forward surfaces 2036*a*, 2036*b*, and 2036*c*, the short cam pin 2030 moves rearward relative to the forward bolt 2020 due to the force applied between the recesses 2061 of the barrel extension 2060 and the bearings 2023, which causes the firearm operating system 2000 to move from the deployed configuration (FIG. 14A) to the retracted configuration (FIG. 14B). Once the bearings 2023 have moved inward a sufficient distance to allow clearance through the barrel extension 2060, the delay is over and the bolt assembly moves rearward into the upper receiver 30. As described above, the subsequent cycling includes extracting/ejecting a cartridge or empty shell, compressing a buffer spring (not shown), pushing the upper-most cartridge 2 out of the magazine 20 and toward the chamber of the firearm 1, etc.

In some embodiments, the barrel extension 2060 includes a plurality of flat portions on an outer surface thereof to facilitate an interface with a tool, such as a wrench. The barrel extension 2060 may be removably attached to the barrel 50 while in other embodiments, the barrel extension 2060 is integral or permanently attached to the barrel 50. For embodiments where the barrel extension 2060 is removably attached to the barrel 50, the barrel extension 2060 may be threaded onto the barrel 50, press-fit on the barrel 50, pinned to the barrel 50, and/or attached in any other appropriate way. Removable attachment of the barrel extension 2060 allows a barrel extension 2060 to be replaced if/when wear occurs to one or more of the recesses 2061.

Figure 16A:
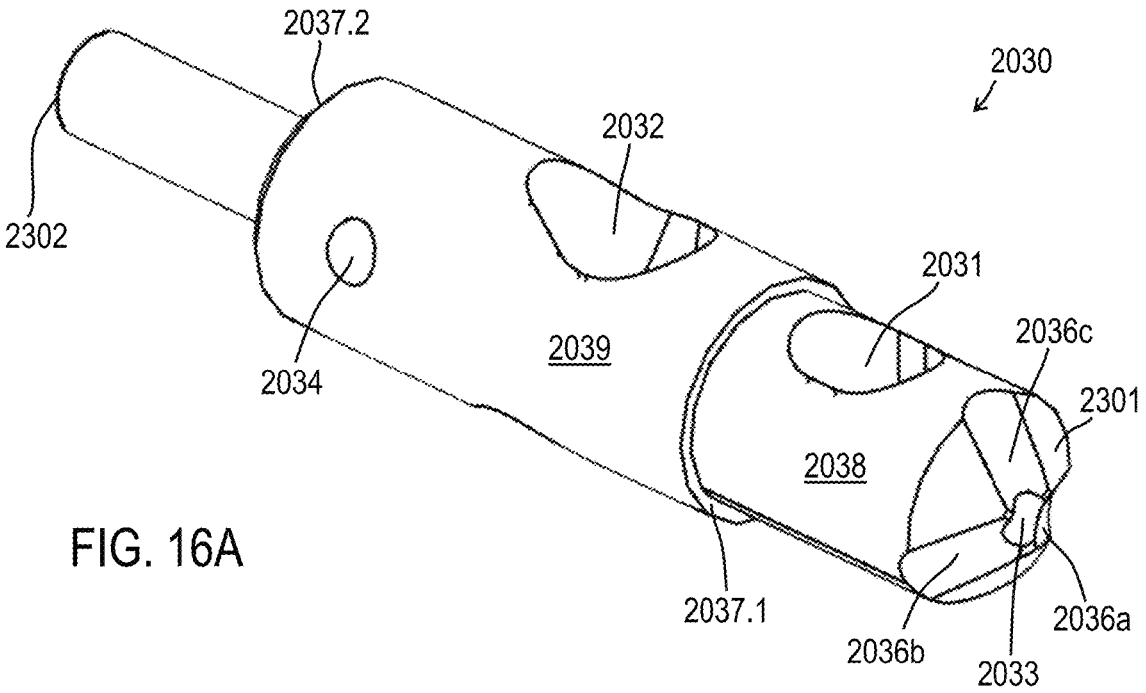
FIG. 16A is a top right perspective view of a short cam pin of the firearm operating system of FIG. 11.
Figure 16B:
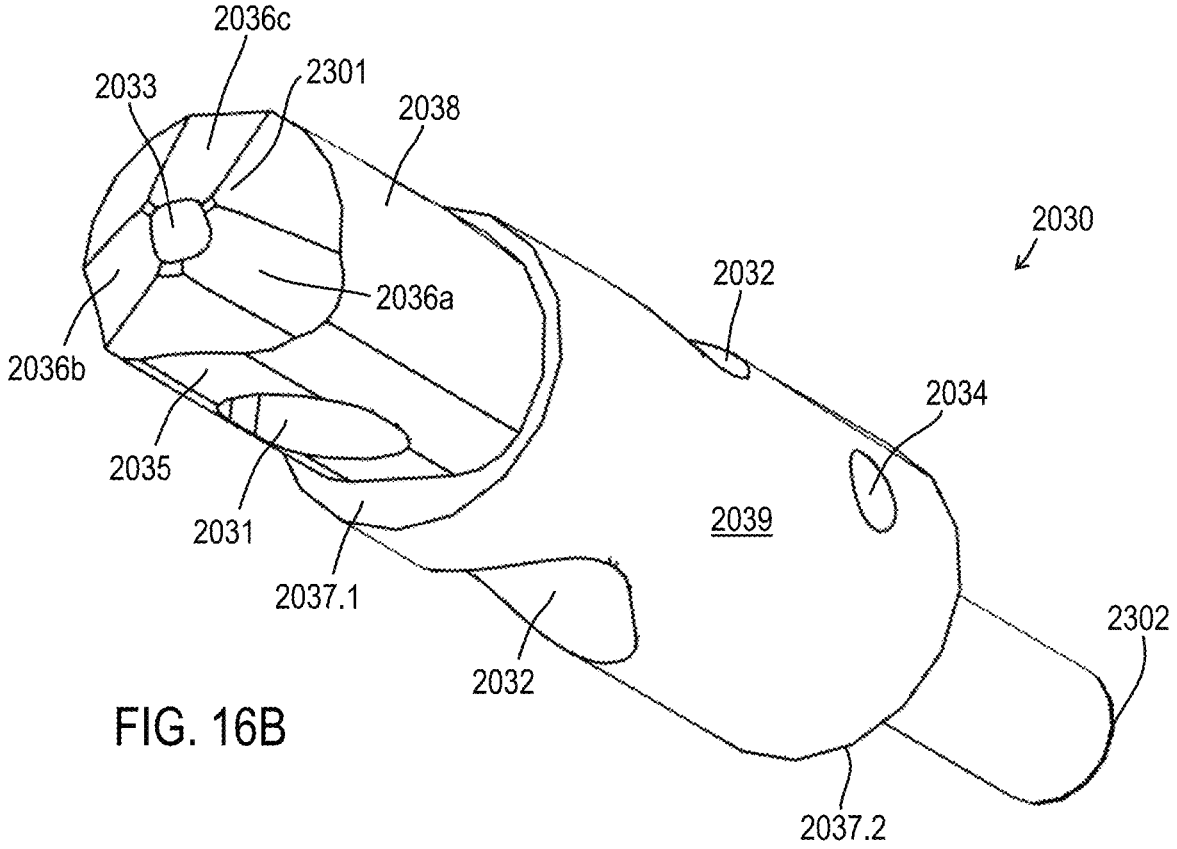
FIG. 16B is a bottom left perspective view of the short cam pin of FIG. 15A.

As shown in FIGS. 16A and 16B, the forward surfaces 2036*a*, 2036*b*, and 2036*c* of the short cam pin 2030 may include concave surfaces. To promote continuous contact with the surface of the bearings 2023, each of the forward surfaces 2036 may include a curved surface that approximately matches the shape of the bearing 2023. For example, if one of the bearings 2023 is spherical, the corresponding forward surface 2036 may be concave with a partially cylindrical shape (i.e., a partially circular cross section) to interface with the bearing 2023. In some cases, the corresponding forward surface 2036 may be concave with a partially conical shape (i.e., a partially circular cross section) to interface with the bearing 2023. In other embodiments, the corresponding forward surface 2036 may have other shapes including, for example, planar, a curved surface with a partially elliptical shape, or any other appropriate shape. The dimensions of the corresponding forward surface 2036 may be similar to the bearing 2023 (e.g., similar diameter) or, in some cases, may be larger than the bearing 2023 to ensure the bearing 2023 remains in contact with the forward surface 2036.

Figure 26A:
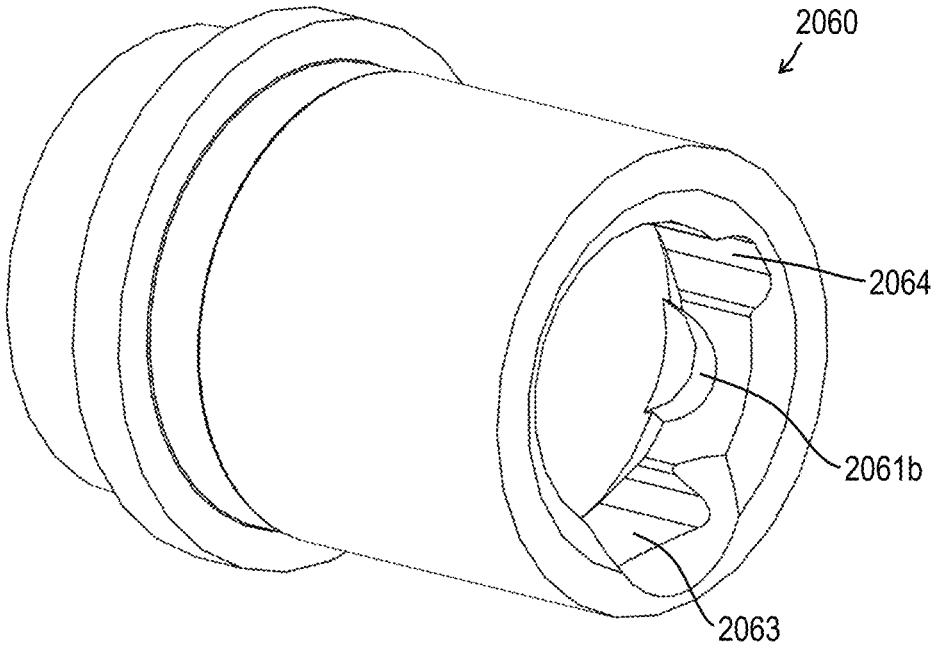
FIG. 26A is a left rear perspective view of a barrel extension of the firearm operating system of FIG. 11.
Figure 26B:
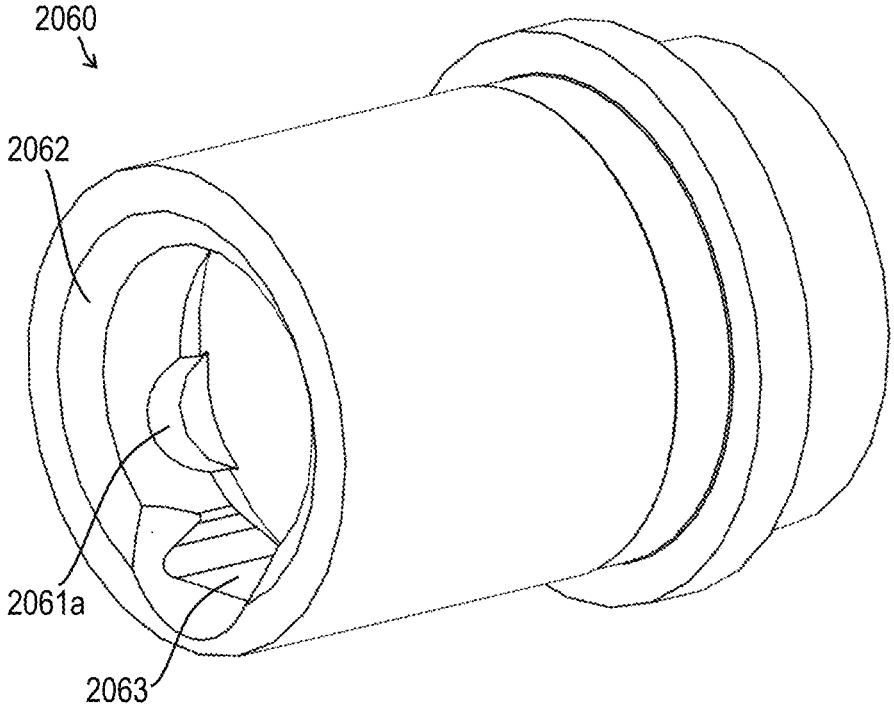
FIG. 26B is a right rear perspective view of the barrel extension of FIG. 26A.
Figure 26C:
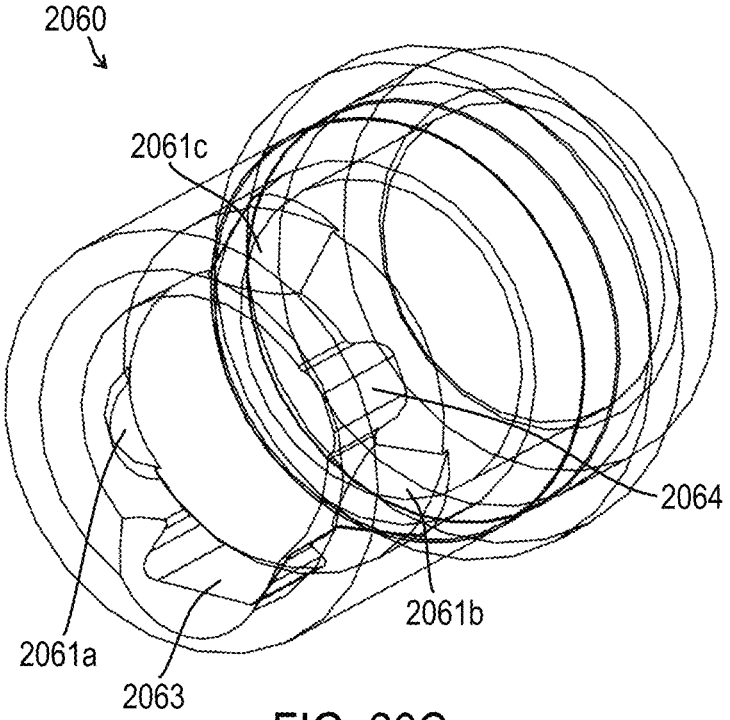
FIG. 26C is a right rear perspective transparent view of the barrel extension of FIG. 26A.
Figure 26D:
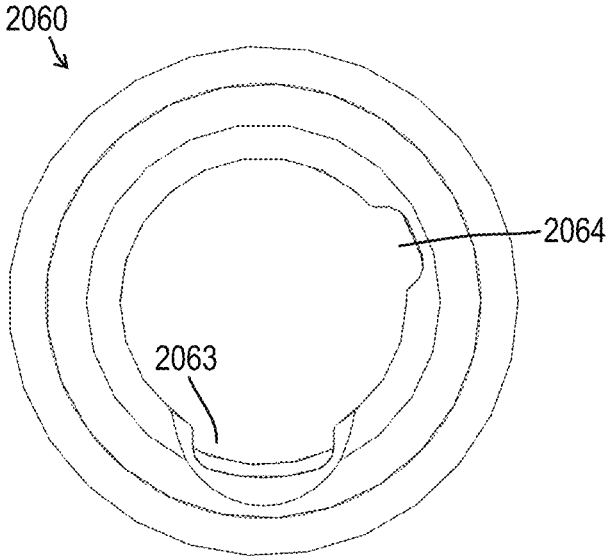
FIG. 26D is a rear view of the barrel extension of FIG. 26A.

Similarly, as shown in FIGS. 26A-26C, the recesses 2061*a*, 2061*b*, and 2061*c* of the barrel extension 2060 may include concave surfaces. To promote continuous contact with the surface of the bearings 2023, each of the recesses 2061 may include a curved surface that approximately matches the shape of the bearing 2023. For example, if one of the bearings 2023 is spherical, the corresponding recess 2061 may be concave with a partially cylindrical shape (i.e., a partially circular cross section) to interface with the bearing 2023. In some cases, the corresponding recess 2061 may be concave with a partially conical shape (i.e., a partially circular cross section) to interface with the bearing 2023. In other embodiments, the corresponding recess 2061 may have other shapes including, for example, planar, a curved surface with a partially elliptical shape, or any other appropriate shape. The dimensions of the corresponding recess 2061 may be similar to the bearing 2023 (e.g., similar diameter) or, in some cases, may be larger than the bearing 2023 to ensure the bearing 2023 remains in contact with the recess 2061.

In some embodiments, in addition to the movement and subsequent operations due to the bearing(s) 2023 (as described above), cycling of the firearm operating system 2000 may also include function of the vertical cam pin 2271. The bolt assembly (the forward bolt 2020, short cam pin 2030, the carrier 2050, and other related components) move rearward away from the barrel extension 2060 in the retracted configuration with gap g between the forward bolt 2020 and the carrier 2050. As described above, there is minimal movement between the short cam pin 2030 and the carrier 2050 due to rear retaining pin 2262. Movement of the vertical cam pin 2271 is dependent on the inner surface of the upper receiver 30. For example, in some embodiments, the inner surface of the upper receiver 30 includes a recessed area surrounding the head 2272 that corresponds to the location of the vertical cam pin 2271 when the firearm operating system 2000 is in the forwardmost configuration relative to the firearm 1 (in both the retracted configuration and the deployed configuration). The vertical cam pin 2271, which also passes through both the forward bolt 2020 and the carrier 2050, is free to move within the contoured hole 2055 of the carrier 2050 and/or the contoured hole 2032 of the short cam pin 2030 such that the vertical cam pin 2271 can rotate about hole 2274 (i.e., about the firing pin 2080). Based on the contoured shape of hole 2055 and/or the hole 2032, any movement of the vertical cam pin 2271 would be rearward and toward the left side of the firearm 1 (i.e., away from the ejection port 31 of the upper receiver 30). However, when the bolt assembly moves rearward, the head 2272 of the vertical cam pin 2271 interacts with other portions of the inner surface of the upper receiver 30 such that the head 2272 is pushed laterally inward toward a center of the firearm 1. Based on the contoured shape of the hole 2055 and/or the hole 2032, any inward movement would move the vertical cam pin 2271 forward toward the front of the firearm 1.

Although the head 2272 of the vertical cam pin 2271 is illustrated having a circular profile, the head 2272 may have any appropriate shape. For example, the head 2272 may have a square or rectangular shape. In other embodiments, the head 2272 may have a oval, elliptical, pentagonal, hexagonal, heptagonal, octagonal, polygonal, or any other appropriate shape.

Figure 27:
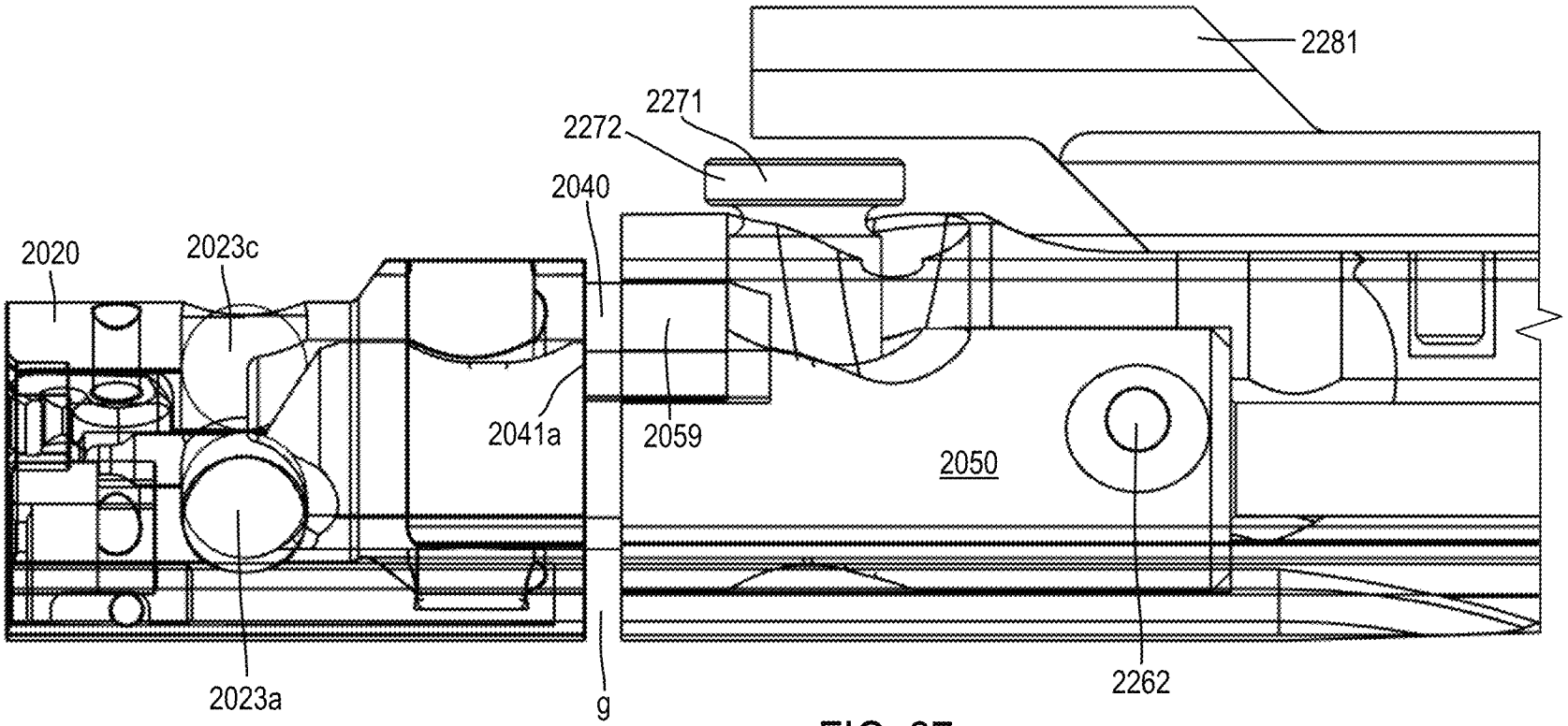
FIG. 27 is a partial left view of the firearm operating system of FIG. 11.

FIG. 27 shows an example of the firearm operating system 2000 located in a rearward position (i.e., offset toward the rear of the firearm 1 away from the barrel extension 2060) where the head 2272 of the vertical cam pin 2271 is pushed inward (and thus forward) due to interaction with the inner surface of the upper receiver 30. In this condition, the vertical cam pin 2271 is located at or near a forward edge of the hole 2055 and/or the hole 2032 such that the vertical cam pin 2271 presses against the bearing spacer 2040. As shown in FIG. 27, forward pressure from the vertical cam pin 2271 pushes the rear surface 2041*b* which causes the bearing spacer 2040 to move forward at least partially into gap g such that the forward surface 2041*a* presses against the rear face 2107 of the forward bolt 2020. In other words, forward movement/pressure from the vertical cam pin 2271 pushes the bearing spacer 2040 against the forward bolt 2020, which maintains gap g between the forward bolt 2020 and the carrier 2050. Maintaining the gap g ensures that there is nothing pushing the bearings 2023 outward because there is no forward pressure on the short cam pin 2030 (i.e., the forward surfaces 2036 are not pushing the bearings 2023 outward).

As the firearm operating system 2000 moves back forward (toward the barrel extension 2060), the head 2272 of the vertical cam pin 2271 interacts with a portion the inner surface of the upper receiver 30 that no longer applies pressure inward (i.e., a recess) and allows the vertical cam pin 2271 to move rearward and to the left side of the firearm 1 within the hole 2055 and/or the hole 2032. Rearward movement of the vertical cam pin 2271 removes pressure on rear surface 2041*b* and allows the bearing spacer 2040 to move toward the carrier 2050. In such a condition, forward momentum of the bolt assembly and/or pressure from a buffer spring (not shown), which presses forward on rear face 2053 of the carrier 2050, causes the short cam pin 2030 and the carrier 2050 to begin moving forward relative to the forward bolt 2020. The bearing spacer 2040 will move into the cavity 2059 due to the movement of the vertical cam pin 2271 and/or due to pressure from the forward bolt 2020 on the forward surface 2041*a*. In some embodiments, when the bearing spacer 2040 is seated in the cavity 2059, the forward surface 2041*a* is approximately flush or coplanar with the forward face 2052 of the carrier 2050. In some cases, the firearm operating system 2000 is configured such that as the bolt assembly moves forward, the head 2272 reaches the recessed area of the inner surface of the upper receiver 30 concurrent with the bearings 2023 reaching the rear ramp surface 2062 of the barrel extension 2060.

Figure 29:
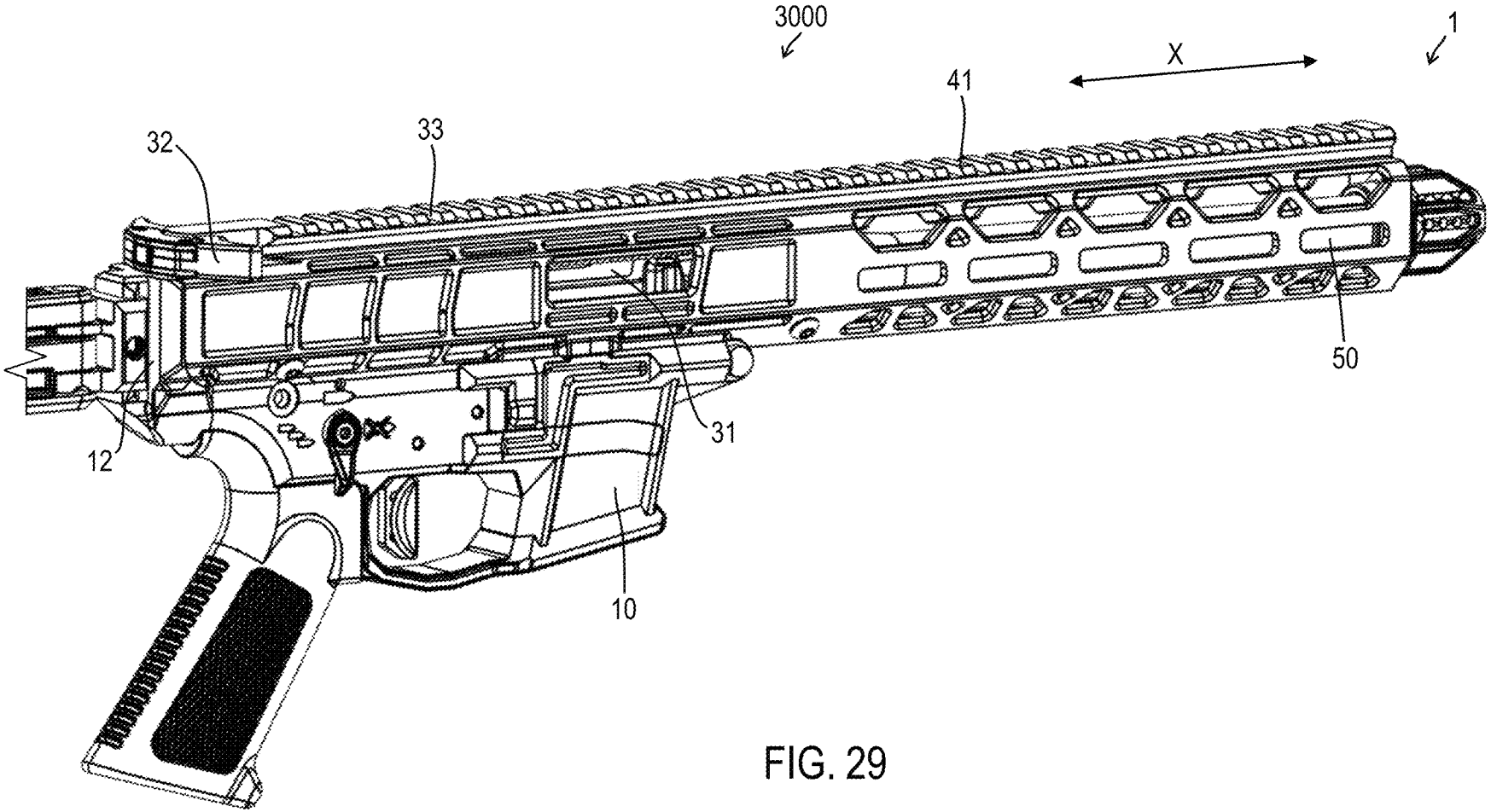
FIG. 29 is a perspective view of a firearm with a firearm operating system according to certain embodiments of the present invention.
Figure 30:
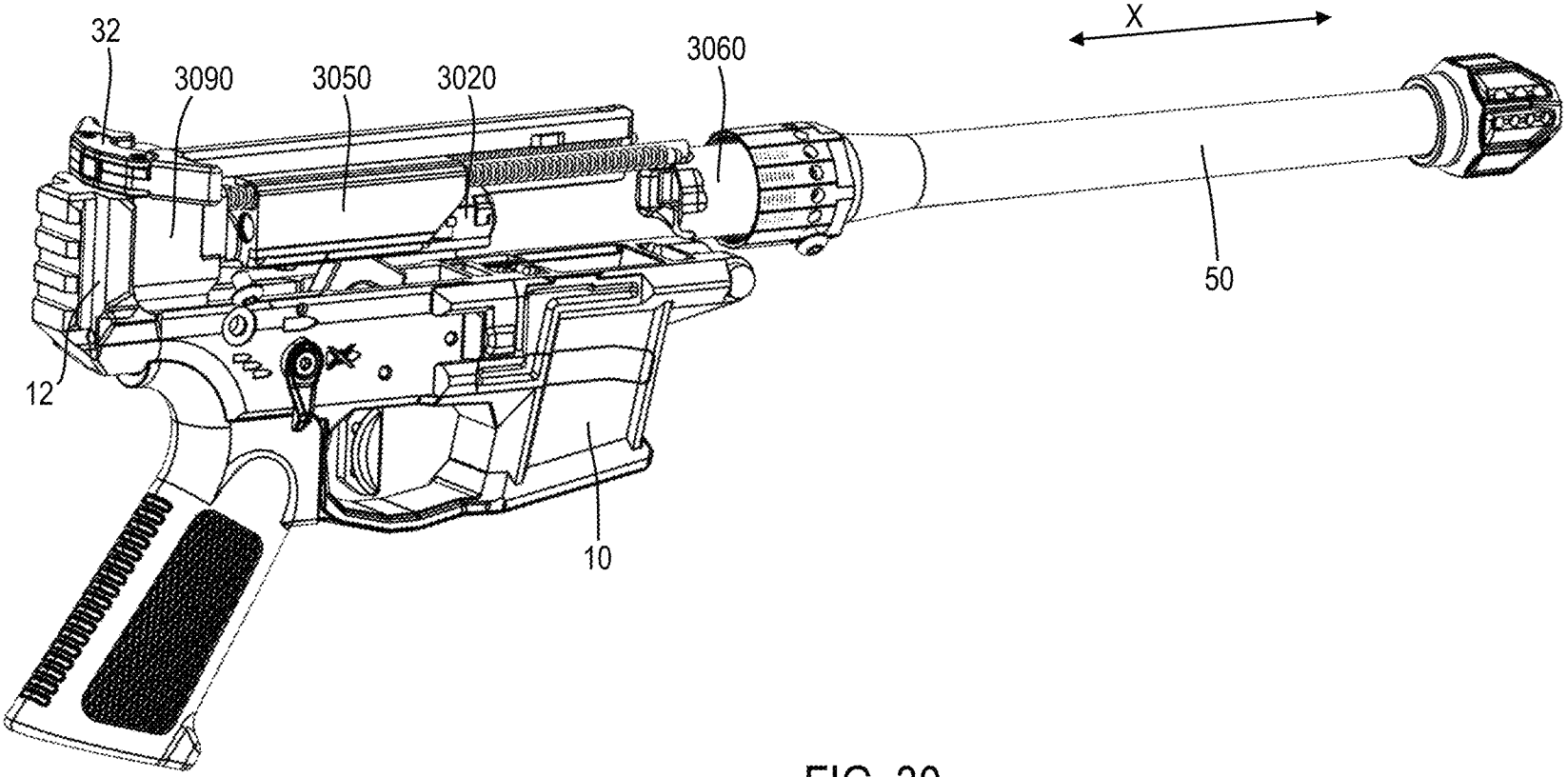
FIG. 30 is a perspective view of the firearm operating system of FIG. 29 with the upper receiver and handguard not shown.
Figure 31:
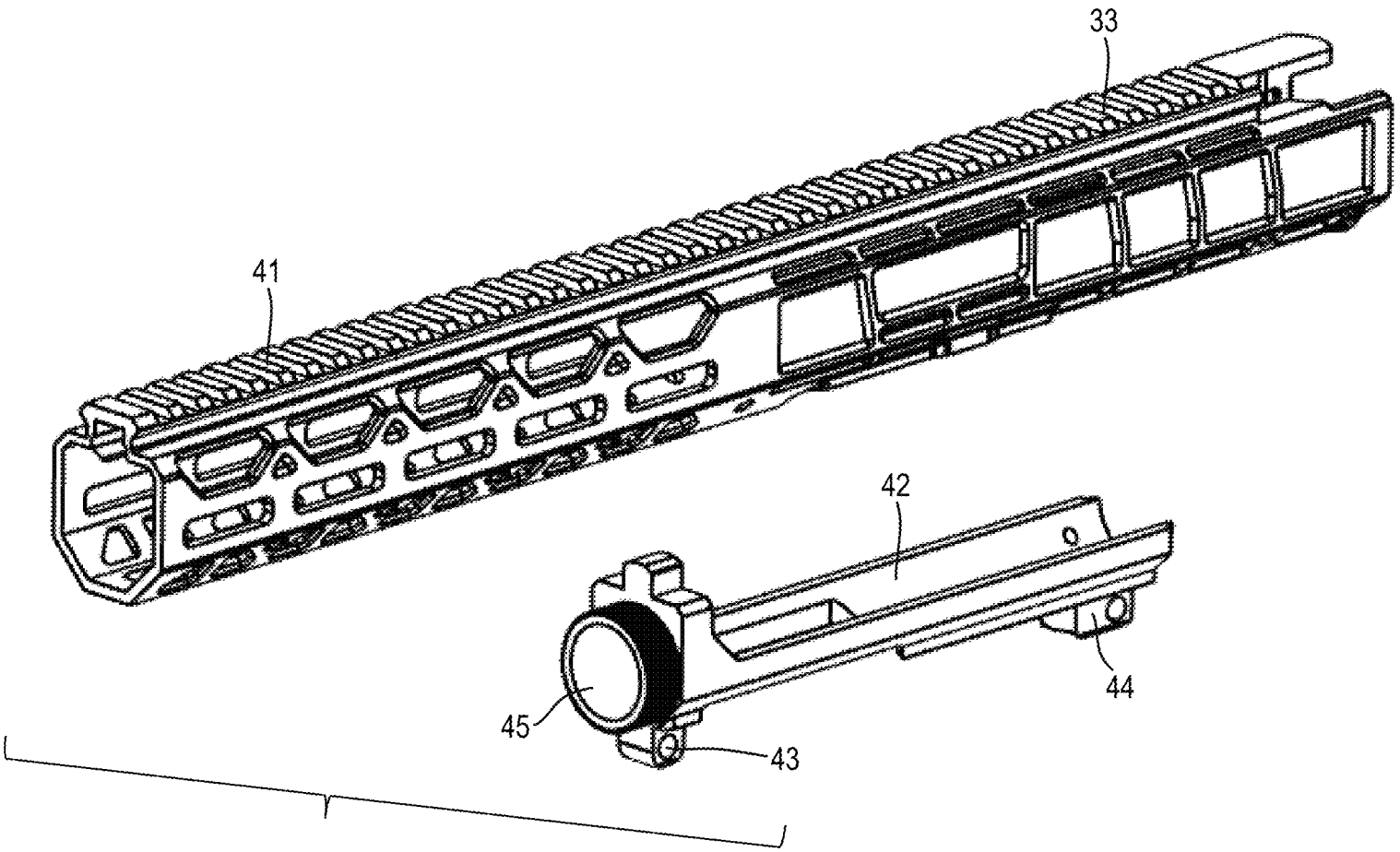
FIG. 31 is an exploded perspective view of a upper receiver and handguard assembly of the firearm shown in FIG. 29

According to certain embodiments of the present invention, as shown in FIGS. 29-42B, a firearm operating system 3000 may include a forward bolt 3020, a short cam pin 3030, a long cam pin 3040, a carrier 3050, a barrel extension 3060, and a chamber washer 3070. As shown in FIG. 29, a firearm 1 may include a lower receiver 10, an upper receiver 33, a charging handle 32, a handguard 41, and a barrel 50. In some cases, the firearm operating system 3000 is located within the upper receiver 33. As shown in FIGS. 29 and 31, the upper receiver 33 and the handguard 41 may be combined into a single component that may be combined with an internal portion 42. The internal portion 42 may include at least one of the mechanical features typically associated with an upper receiver including, for example, a forward lug 43 for attaching to the lower receiver 10, a rear lug 44 for attaching to the lower receiver 10, and a threaded member 45 for attaching to a barrel nut. In some cases, the internal portion 42 is a metallic component designed for distributing critical forces of an upper receiver while the component that includes the upper receiver 33 and the handguard 41 may be a different material including, for example, polymer, carbon composite, a metallic material with less structural capability, or any other appropriate material. The firearm operating system 3000 may be designed as an assembly of components to fit within a standard upper receiver (e.g., upper receiver 33 shown in FIG. 29 or upper receiver 30 shown in FIG. 1) for a known modular firearm such that the upper receiver 33 (including the firearm operating system 3000) can interface with a standard lower receiver 10. In some cases, the firearm operating system 3000 is compatible with a lower receiver 10 that includes a rear insert 12 where the rear insert 12 is metallic and other portions of the receiver 10 are polymer. The rear insert 12 may include a buffer hoop similar to typical AR-15 receivers or, as shown in FIGS. 29-30, the rear insert 12 may include an internal rib for interfacing with a rear member 3090 and a rear attachment (e.g., a picatinny rail). The firearm operating system 3000 may be designed to function and engage with (i) components of AR-15 variant (civilian) or M16/M4 (military) firearms; (ii) components of AR-10 variant firearms; or (iii) components of any other relevant firearm.

In some embodiments, the firearm operating system 3000 is configured to be inserted into a U.S. military specification (milspec) upper receiver for an AR-15 variant (civilian) or M16/M4 (military) firearm (i.e., collectively AR-15 style firearms).

FIG. 30 shows many of the relevant components of the firearm operating system 3000 in situ. In some embodiments, at least a portion of a forward section of the short cam pin 3030 is disposed within an internal cavity of the forward bolt 3020 (e.g., rear cavity 3027) and at least a portion of a rear section of the short cam pin 3030 is disposed within an internal cavity of the carrier 3050 (e.g., cavity 3057) wherein the forward bolt 3020 is located on a forward side of the carrier 3050. In FIG. 30, the magazine 20, the upper receiver 33, and the handguard 41 are not shown to better illustrate components of the firearm operating system 3000. Cycling of the firearm operating system 3000 is based on linear motion of various components in the forward/aft direction X including, for example, the forward bolt 3020, the short cam pin 3030, the long cam pin 3040, the carrier 3050, and the firing pin 3080.

Some of the components of firearm operating system 3000 may be similar to corresponding components of firearm operating system 100. The firing pin 3080 may be similar to firing pin 108. The forward bearings 323*a*, 323*b* may be similar to forward bearings 123*a*, 123*b* while rear bearing 323*c* may be similar to rear bearing 123*c*. The bearing retainer 324 may be similar to bearing retainer 124. The barrel extension 3060 may be similar to barrel extension 106. The at least one retaining pin 3126 may be similar to retaining pin(s) 126. The ejector pin 321 may be similar to ejector pin 121, and the extractor 322 may be similar to extractor 122. The structure and function of the short cam pin 3030 may be similar to the short cam pin 103. In addition, the structure and function of the long cam pin 3040 may be similar to the long cam pin 104. Accordingly, a more detailed description of each of these components can be found above in the description and context of firearm operating system 100.

In some embodiments, the forward bolt 3020, short cam pin 3030, the long cam pin 3040, the carrier 3050, and the firing pin 3080 combine together as one unit within the firearm operating system 3000. The forward bolt 3020 may slidably engage the long cam pin 3040 via long cam pin cavity 3026 and the carrier 3050 may slidably engage the long cam pin 3040 via long cam pin cavity 3056. As shown in FIGS. 32, 36A, 36B, and 37A, the forward bolt 3020 may be disposed on a forward side of the carrier 3050 such that, in some conditions, there is a gap a between an aft face 3202 of the forward bolt 3020 and a forward face 3501 of the carrier 3050. The short cam pin 3030 and the firing pin 3080 may each extend internally through a rear cavity 3027 (see FIG. 36B) of the forward bolt 3020 and through a cavity 3057 of the carrier 3050 (see FIGS. 37A and 37B). Although illustrated as a separate component, in some embodiments, the short cam pin 3030 may be an integral component of the carrier 3050. The firing pin 3080 may extend through the short cam pin 3030 (see FIGS. 35 and 39B). The firearm operating system 3000 may include at least one retaining pin 3126 to constrain movement of the short cam pin 3030 relative to the forward bolt 3020 and/or the carrier 3050 (see FIG. 34).

The forward bolt 3020 and the short cam pin 3030 may be movable relative to one another in the X-direction such that the firearm operating system 3000 has a deployed configuration and a retracted configuration. In some embodiments, in the retracted configuration, the short cam pin 3030 is in a rear position relative to the forward bolt 3020, which increases the size of the gap a between an aft face 3202 of the forward bolt 3020 and a forward face 3501 of the carrier 3050. When the firearm operating system 3000 moves to the deployed configuration, the short cam pin 3030 moves to a forward position relative to the forward bolt 3020, which reduces or eliminates the gap a between the aft face 3202 of the forward bolt 3020 and the forward face 3501 of the carrier 3050.

As described above, the at least one retaining pin 3126 may be similar to retaining pin 126. For example, the retaining pin 126 may include at least one flat surface 126.1 and a hole 126.2 (see FIG. 4F). As shown in FIGS. 34, 36A, 39A, and 39B, the firearm operating system 3000 may include a forward retaining pin 3126*a* that engages hole 3029 of the forward bolt 3020 and hole 3035 of the short cam pin 3030 (in the forward section of the short cam pin 3030). In some embodiments, the hole 3035 of the short cam pin 3030 is a slotted hole such that the forward retaining pin 3126*a* can slide in the X-direction to allow the short cam pin 3030 and the forward bolt 3020 to move in the X-direction relative to one another (i.e., to define the deployed configuration and the retracted configuration). In some embodiments, the geometry of the slotted hole 3035 defines the maximum relative motion between the forward bolt 3020 and the short cam pin 3030. As described below, the short cam pin 3030 and the carrier 3050 may be constrained relative to one another such that the geometry of the slotted hole 3035 also defines motion between the forward bolt 3020 and the carrier 3050 (i.e., the total distance of gap a). The hole 3035 may include flat side surfaces that approximately correspond to and engage the flat surfaces 126.1 of the forward retaining pin 3126*a* to ensure that the hole 126.2 remains aligned with the X-direction such that the firing pin 3080 passes through hole 126.2. As shown in FIGS. 34, 37B, 37C, 39A, and 39B, the firearm operating system 3000 may include a rear retaining pin 3126*b* that engages hole 3059 of the carrier 3050 and hole 3036 of the short cam pin 3030 (in the rear section of the short cam pin 103). In some embodiments, the hole 3036 of the short cam pin 3030 constrains the short cam pin 3030 and the carrier 3050 to prevent relative movement between the short cam pin 3030 and the carrier 3050. The hole 3036 may include flat side surfaces that approximately correspond to and engage the flat surfaces 126.1 of the rear retaining pin 3126*b* to ensure that the hole 126.2 remains aligned with the X-direction such that the firing pin 3080 passes through hole 126.2.

Figure 8:
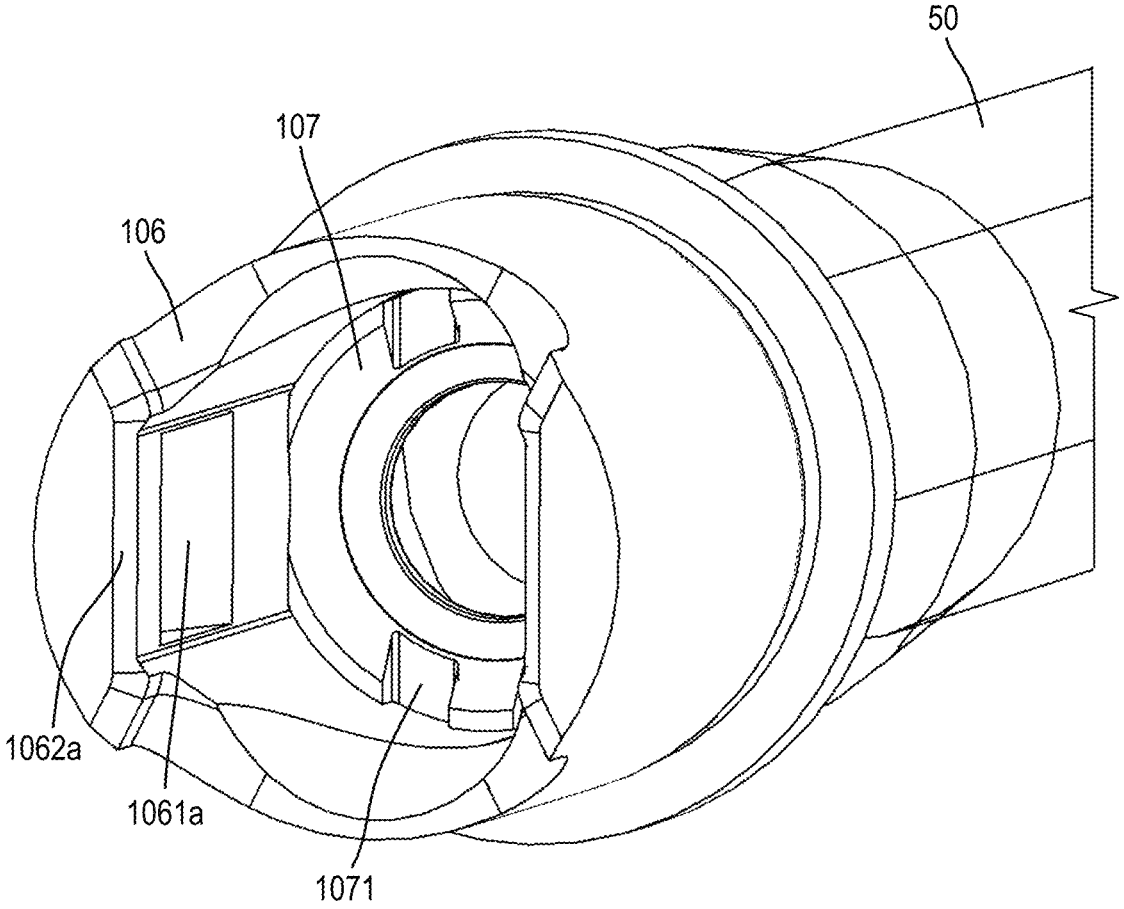
FIG. 8 is a partial perspective view of the firearm operating system of FIG. 1.
Figure 9:
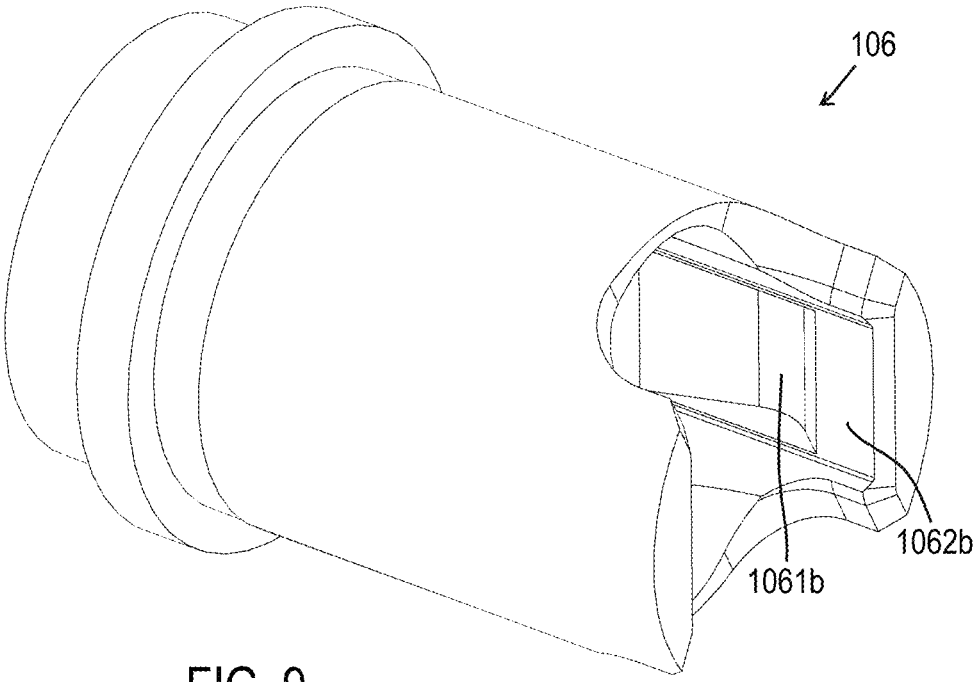
FIG. 9 is a perspective view of a barrel extension of the firearm operating system of FIG. 1.
Figure 10:
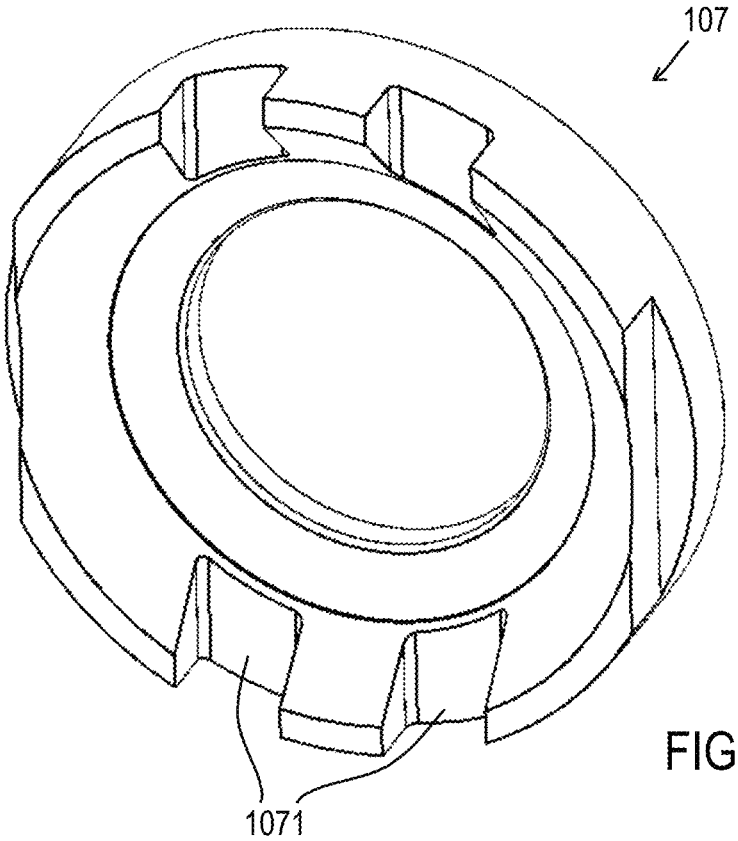
FIG. 10 is a perspective view of a chamber washer of the firearm operating system of FIG. 1.
Figure 41:
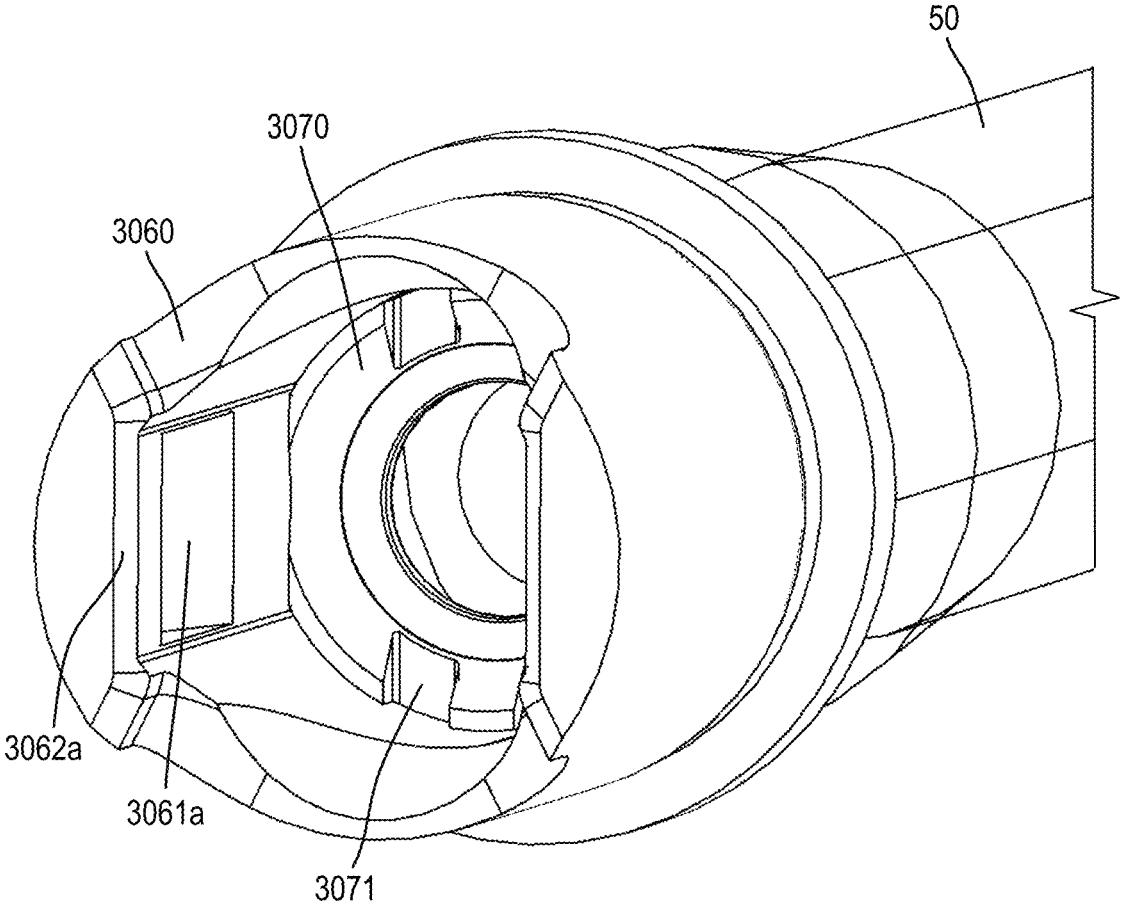
FIG. 41 is a perspective view of a barrel extension of the firearm operating system of FIG. 29.
Figure 42A:
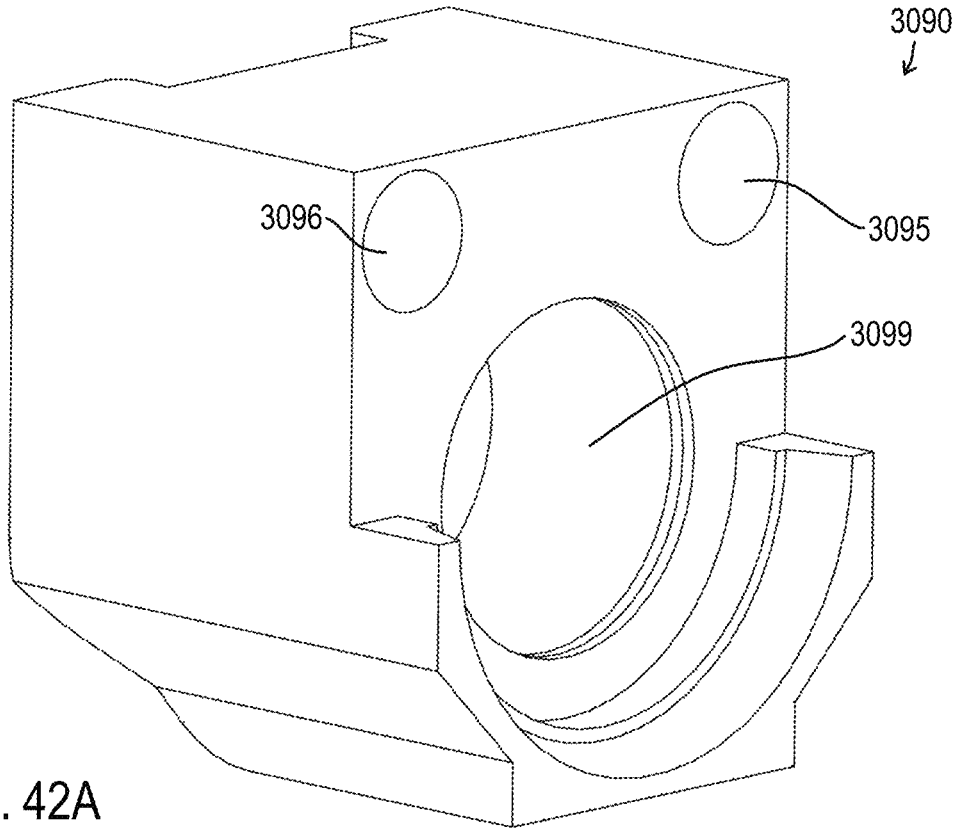
FIG. 42A is a front right perspective view of a rear member of the firearm operating system of FIG. 29.
Figure 42B:
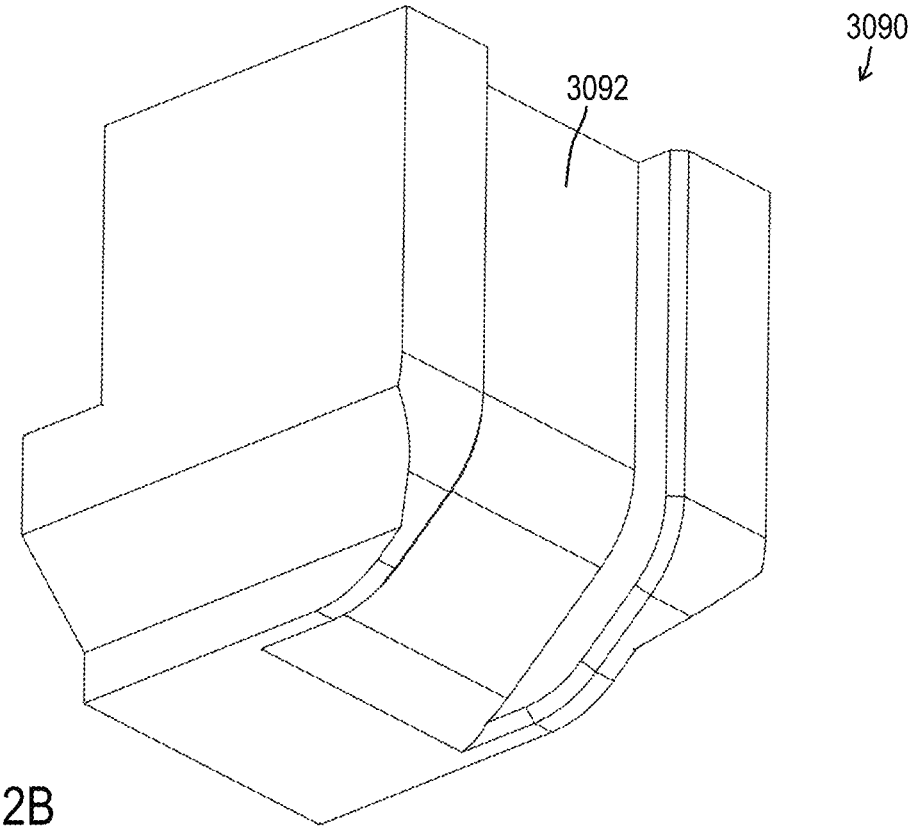
FIG. 42B is a rear left perspective view of the rear member of FIG. 42A.

For the firing pin 3080 to function (i.e., for the forward end 3801 of the firing pin 3080 to contact and cause the cartridge 2 to discharge), the firearm operating system 3000 must be in the deployed configuration (i.e., the short cam pin 3030 must be located in a forward position relative to the forward bolt 3020). In other words, the forward surfaces 3031*a* and 3031*b* of the short cam pin 3030 must be in a forward position, which affects the lateral position of the forward bearings 323*a* and 323*b* thus causing these bearings to interface with recesses 3061*a* and 3061*b*, respectively, of the barrel extension 3060. In such a configuration where the forward surfaces 3031*a* and 3031*b* of the short cam pin 3030 are in a forward position, the ramp surfaces 3032*a*, 3032*b* (and/or the curved surface in between the forward surfaces 3031*a*, 3031*b* and the ramp surfaces 3032*a*, 3032*b*) interact with the forward bearings 323*a*, 323*b* (and may push the forward bearings 323*a*, 323*b* outward in some cases). For example, FIG. 41 illustrates one example of barrel extension 3060 (see also FIGS. 8 and 9 showing barrel extension 106, which may be similar to barrel extension 3060). These constraints affect the firing pin 3080 because the flange 3081 of the firing pin 3080 engages the rear face 3302 of the short cam pin 3030. Accordingly, a cartridge 2 can only be fired when the firearm operating system 3000 is in the deployed configuration. As described in more detail below, the deployed configuration includes a condition where bearings 323*a* and 323*b* are engaged within recesses 3061*a* and 3061*b*, respectively.

The forward retaining pin 3126*a* and the rear retaining pin 3126*b* may be retained within their respective holes because the firing pin 3080 passes through hole 126.2 of each retaining pin 3126 (as described above). In addition, the hole 3029 of the forward bolt 3020 and the hole 3059 of the carrier 3050 may each be blind holes such that the holes are only accessible from an upper surface of the respective component (as shown in the drawings) and the long cam pin 3040 blocks access to these holes.

In addition, the firearm operating system 3000 allows the firearm 1 to include a barrel 50 without a hole for venting/redirecting gas pressure to the operating system. In other words, another advantage compared to conventional systems is that the barrel 50 of the firearm operating system 3000 is simpler and less likely to corrode or otherwise fail due to additional holes thus increasing longevity.

In some embodiments, the firearm operating system 3000 includes an assembly pin that is inserted into hole 3055 of the carrier 3050. The assembly pin may be similar in shape and function to assembly pin 131, which is shown in FIGS. 2-3B. When the assembly pin is inserted into hole 3055, the assembly pin may be at least partially disposed within cavity 3057 of the carrier 3050 such that the assembly pin interacts with the firing pin 3080. In particular, the assembly pin is disposed between the rear end 3802 and the flange 3081 of the firing pin 3080 such that the firing pin 3080 cannot be removed from the cavity 3037 of the short cam pin 3030 while the assembly pin is installed. The assembly pin may also interact with the long cam pin 3040. For example, when installed, the assembly pin is disposed adjacent to a flat side portion 3045 (i.e., anything between the interface surface 3046 and the aft end 3402 of the long cam pin 3040). If the carrier 3050 is moved forward relative to the long cam pin 3040, the assembly pin will press against the interface surface 3046 and prevent further forward movement of the carrier 3050. However, the assembly pin can be removed, which will allow the carrier 3050 to move forward such that the long cam pin 3040 is removed from the long cam pin cavity 3056 of the carrier 3050 (and from long cam pin cavity 3026 of the forward bolt 3020). Such an operation would occur outside the firearm 1 due to the length of the long cam pin 3040 and the proximity of the barrel extension 3060 and the chamber washer 3070.

Figure 34:
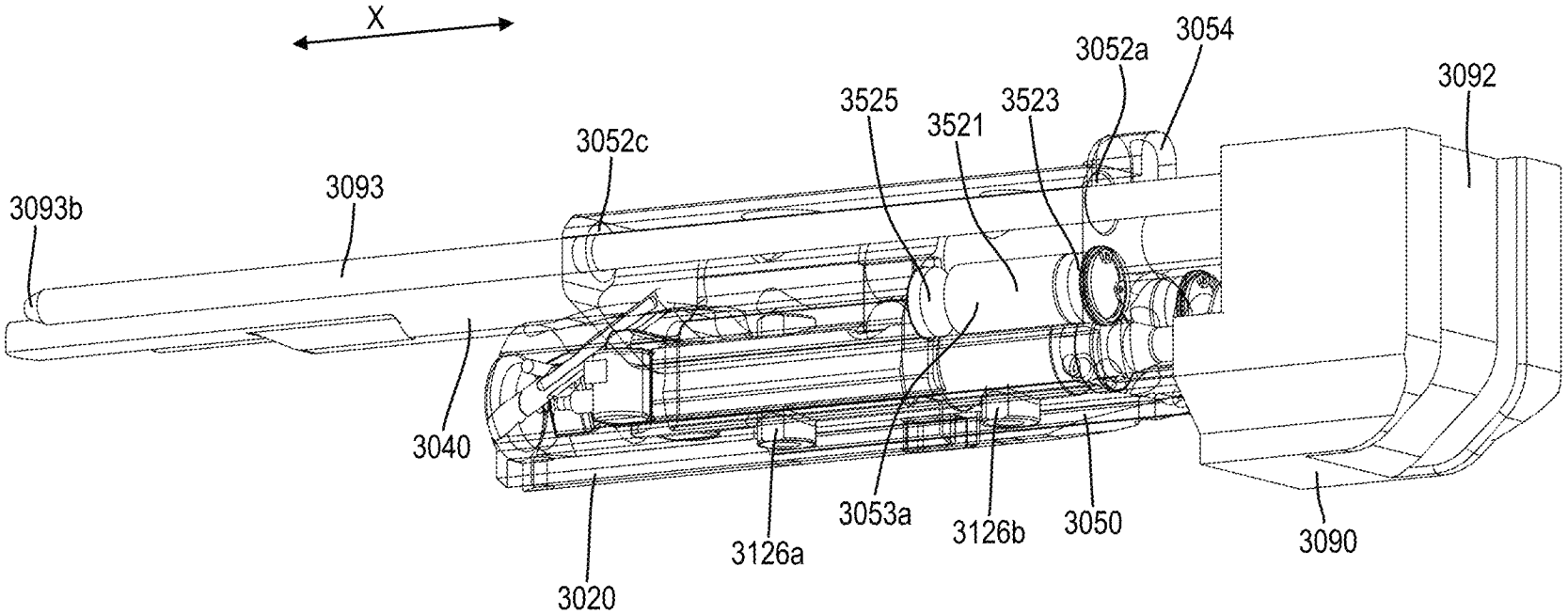
FIG. 34 is a left perspective view of the firearm operating system of FIG. 29.
Figure 36A:
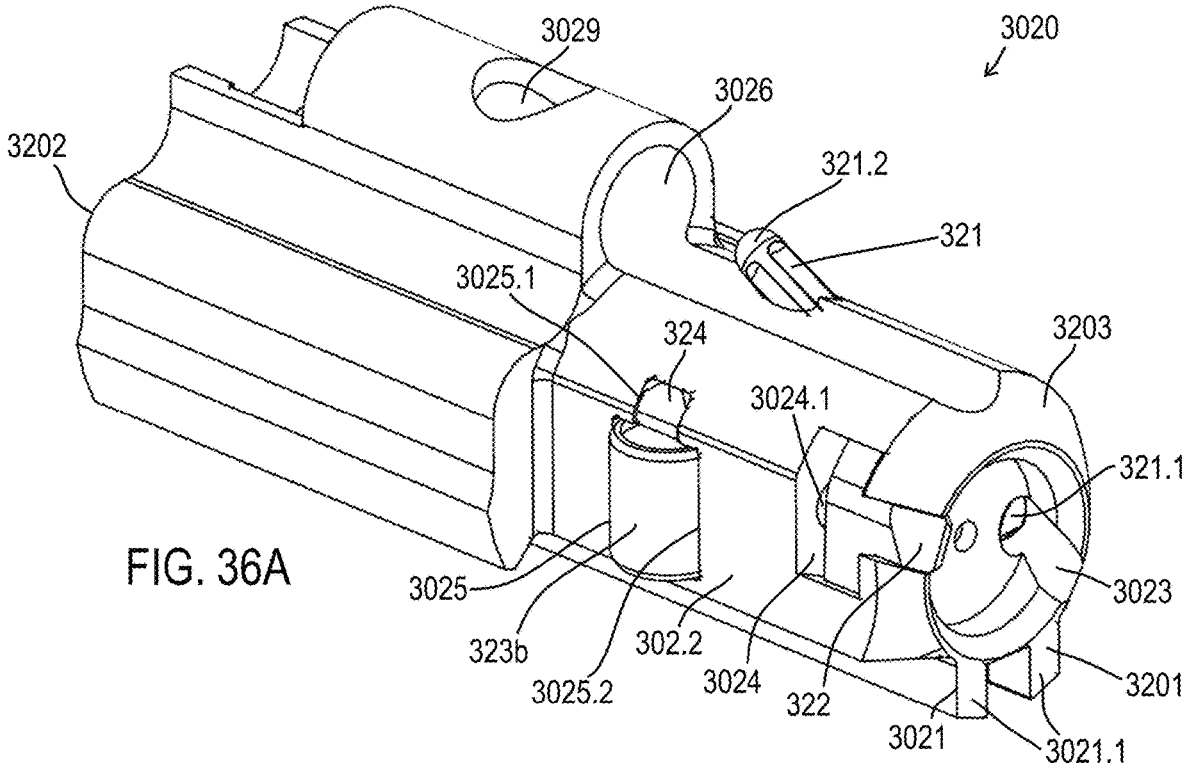
FIG. 36A is a front right perspective view of a forward bolt of the firearm operating system of FIG. 29.
Figure 36B:
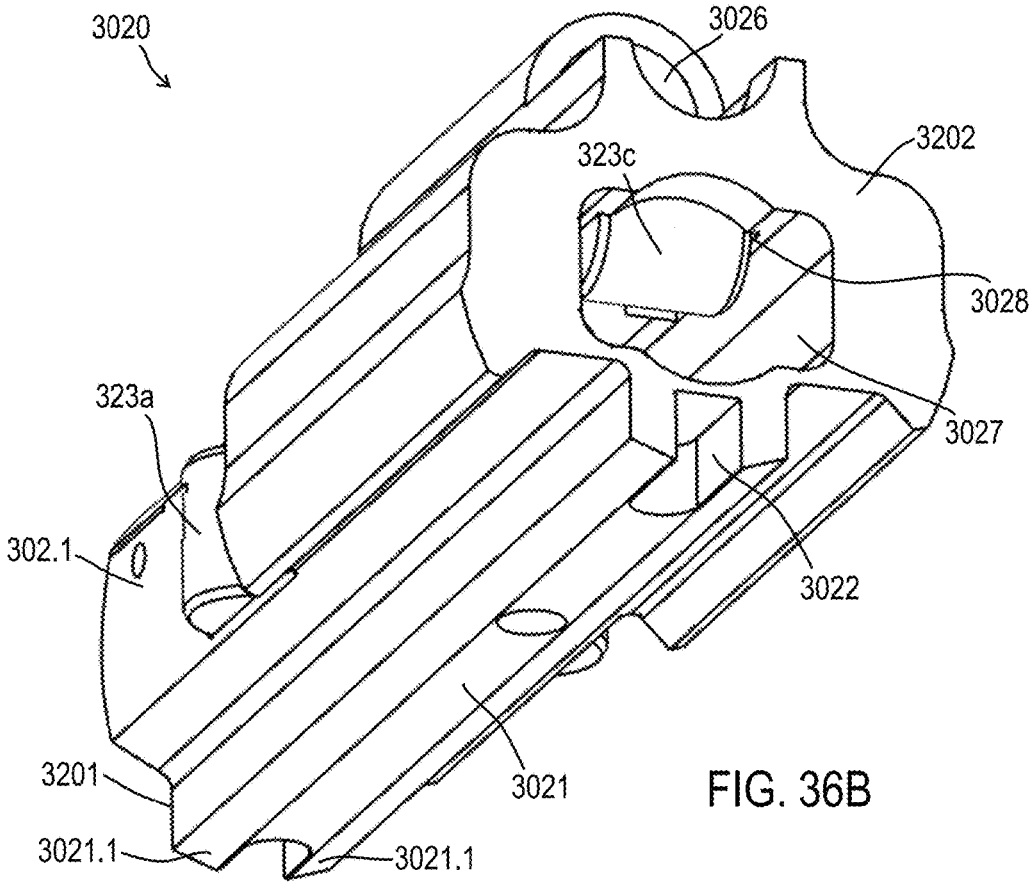
FIG. 36B is a rear left perspective view of the forward bolt of FIG. 36A.

As shown in FIGS. 36A and 36B, the forward bolt 3020 includes a forward face 3201, the aft face 3202, a lower portion 3021, a lower rear cavity 3022, an ejector hole 3023, an extractor cavity 3024, a lateral bearing cavity 3025, a long cam pin cavity 3026, a rear cavity 3027, and an upper bearing cavity 3028 (see FIGS. 36A and 36B). The forward bolt 3020 is shown transparent in FIG. 34 for illustrative purposes. As shown in FIGS. 36A and 34B, the forward bolt 3020 may interface with an ejector pin 321, an extractor 322, at least one bearing 323, and a bearing retainer 324. The lower portion 3021 at the forward face 3201 of the forward bolt 3020 may include two lugs 3021.1 that engage corresponding recesses 3071 of the chamber washer 3070 (see FIG. 41) when the forward bolt 3020 is in the forward position. When the forward bolt 3020 moves forward over the top of the magazine 20 (located in the magazine well 11 of the lower receiver 10), the lugs 3021.1 push the uppermost cartridge 2 out of the magazine 20 and toward the chamber of the firearm 1. The cartridge 2 is in the chamber in a firing position when the cartridge 2 is approximately aligned with a center of the forward face 3201 of the forward bolt 3020 and the lugs 3021.1 are engaged with the corresponding recesses 3071 of the chamber washer 3070. In addition, when the forward bolt 3020 is in the forward position, the beveled surfaces 3203 at the forward face 3201 allow the forward bolt 3020 to move close to the chamber washer 3070 without interference. When the cartridge 2 is in the firing position, forward motion of a forward end 3801 of the firing pin 3080 (e.g., caused by a hammer interacting with the rear end 3802 of the firing pin 3080) causes the cartridge 2 to discharge. Based on the geometry of the beveled surfaces 3203, the forward end of the forward bolt 3020 can reach a forward position and interface with the chamber washer 3070. The chamber washer 3070 provides a funnel to direct the cartridge 2 to the firing position.

The ejector pin 321 interfaces with the ejector hole 3023 of the forward bolt 3020. When the forward bolt 3020 moves rearward due to either (i) manual operation/movement (e.g., operating the charging handle 32) or (ii) cycling of the firearm 1 after firing a cartridge (e.g., cartridge 2), an aft end 321.2 of the ejector pin 321 protrudes out of the ejector hole 3023 until the aft end 321.2 of the ejector pin 321 makes contact with interface surface 3043 of the long cam pin 3040 (see FIG. 40A). The forward bolt 3020 slides along the long cam pin 3040 such that the long cam pin 3040 extends through long cam pin cavity 3026 of the forward bolt 3020. The contact between the aft end 321.2 of the ejector pin 321 and the interface surface 3043 of the long cam pin 3040 causes the ejector pin 321 to move through the ejector hole 3023 such that a forward end 321.1 contacts a rear surface of a cartridge 2 (or an empty shell of a cartridge if a round was fired). The location of the interface surface 3043 on the long cam pin 3040 is designed such that the contact between the aft end 321.2 of the ejector pin 321 and the interface surface 3043 of the long cam pin 3040 occurs while the cartridge 2 (or the empty shell of a cartridge if a round was fired) is located adjacent to the ejection port 31 of the upper receiver 33. Such an arrangement of the long cam pin 3040 allows the ejector pin 321, in coordination with the extractor 322 to eject the cartridge 2 (or the empty shell of a cartridge if a round was fired) through the ejection port 31 of the upper receiver 33. The design of the long cam pin 3040 can be updated to tune the ejection of cartridge 2 (or empty shell). For example, the location of the interface surface 3043 along the long cam pin 3040 can affect ejection of the cartridge 2.

Further, the angle or curvature of the surface of the interface surface 3043 can affect the speed or quickness of the ejection. In addition, adjustment to the properties and/or the location of the interface surface 3043 along the long cam pin 3040 allows the design of the firearm operating system 3000 to be quickly adapted to different calibers. In some embodiments, as shown in FIG. 36A, the ejector pin 321 may include facets or flat surfaces along a length thereof.

The extractor 322 may be located within the extractor cavity 3024 of the forward bolt 3020 such that the extractor 322 can move based on the geometry of the cavity 3024 and an interface with a spring and/or a spherical bearing inserted into hole 3024.1. In some embodiments, the extractor 322 travels parallel to an internal contoured surface of the cavity 3024. In some cases, the direction of travel for the extractor 322 is approximately radial extending from a center of the forward bolt 3020 toward the exterior. In other cases, the extractor 322 pivots based on the geometry of a surface of the extractor 322 (e.g., see surface 122.2 of extractor 122 shown in FIG. 4E, which may be similar to extractor 322 and is designed to interact with a spring and/or a spherical bearing). The extractor 322 may include a hook member (e.g., see hook member 122.1 of extractor 122 shown in FIG. 4E, which may be similar to extractor 322) that engages a cannelure and/or a rim of the cartridge 2 such that the extractor 322 guides the cartridge 2 (or the empty shell of a cartridge if a round was fired) in the direction of the ejection port 31 of the upper receiver 33 using the force provided by the ejector pin 321.

Manual operation/cycling of the firearm operating system 3000 may include rearward movement of the charging handle 32 where the charging handle 32 engages a portion of the firearm operating system 3000. For example, in some embodiments, the charging handle 32 engages a portion of the carrier 3050. In some embodiments, the charging handle 32 engages an upper feature 3054 of the carrier 3050 (see FIGS. 32-34, 37B, and 37C).

Figure 39A:
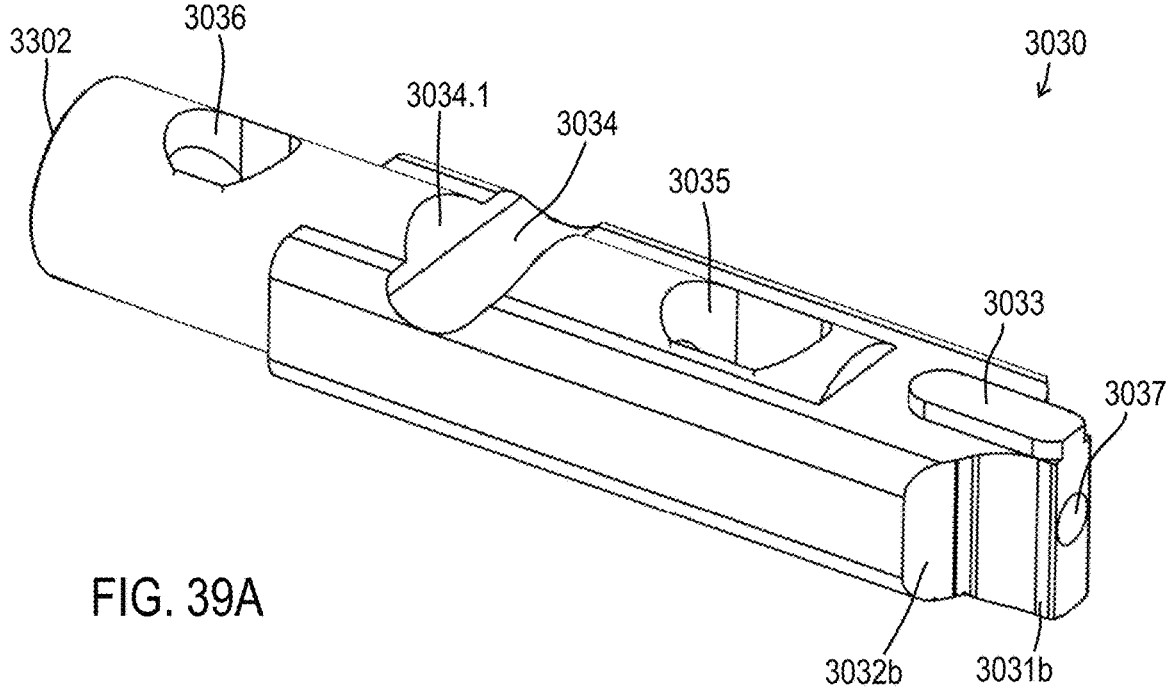
FIG. 39A is a front right perspective view of a short cam pin of the firearm operating system of FIG. 29.
Figure 39B:
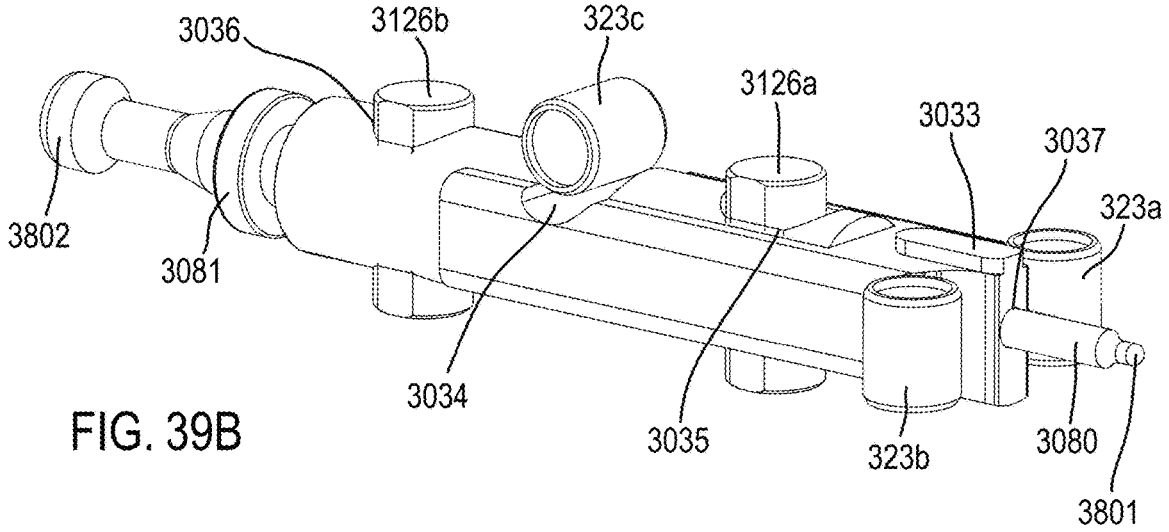
FIG. 39B is a front right perspective view of the short cam pin of FIG. 39A.

The firearm operating system 3000 may include at least one bearing 323. As described above, the bearing(s) 323 may be similar to bearing(s) 123, which may each include an outer surface 123.1 and an upper recess 123.2 (see FIG. 4G). Although the bearing(s) 323 are illustrated as cylindrical rollers, the bearing(s) 323 may have any configuration, including, for example, spherical, tapered, needle, toroidal, annular, etc. In some embodiments, each bearing has a diameter of approximately 0.1" (0.25 cm) to approximately 0.4" (1.02 cm). In other cases, each bearing has a diameter of approximately 0.2" (0.51 cm) to approximately 0.3" (0.76 cm). In other cases, each bearing has a diameter of approximately 0.25" (0.635 cm). In some embodiments, as shown in FIGS. 36A and 36B, the firearm operating system 3000 may include two forward bearings 323*a* and 323*b* that are disposed within the lateral bearing cavity 3025. The forward bearings 323*a* and 323*b* may be configured such that the upper recess 123.2 engages a lower protrusion of the bearing retainer 324 (e.g., see FIG. 4D showing lower protrusion 124.2 of bearing retainer 124, which may be similar to bearing retainer 324). The lower protrusion 124.2 is illustrated as cylindrical; however, the lower protrusion 124.2 may have any appropriate shape including a rectangular or square cross section. The bearing retainer 324 may be inserted into slot 3025.1 of the forward bolt 3020 (see FIG. 36A). In addition, the bearing retainer 324 may be secured from moving laterally (i.e., out of slot 1025.1) because the slot 124.1 of the bearing retainer 324 engages a protrusion 3033 of the short cam pin 3030 (see FIG. 39A). As shown in FIGS. 36B and 39B, the firearm operating system 3000 may also include a rear bearing 323*c* disposed within the upper bearing cavity 3028. In some embodiments, the forward bearings 323*a*, 323*b* include an approximately vertical axis while the rear bearing 323*c* includes an axis that is approximately perpendicular to the axes of the forward bearings 323*a*, 323*b*. In some cases, the axis of the rear bearing 323*c* is approximately horizontal.

The bearings 323 may interface with other components of the firearm operating system 3000. For example, the forward bearings 323*a* and 323*b* may each have an internal configuration similar to the internal configuration of forward bearings 123*a* and 123*b* shown in FIGS. 4A and 4C where a surface of each forward bearing 123*a*, 123*b* is approximately flush with a respective side surface of the forward bolt 102. For example, in the internal configuration, a portion of outer surface 123.1 of the forward left bearing 323*a* is approximately flush with left side surface 302.1 of the forward bolt 3020 and a portion of outer surface 123.1 of the forward right bearing 323*b* is approximately flush with right side surface 302.2 of the forward bolt 3020. In addition, the forward bearings 323*a* and 323*b* may be capable of moving laterally to an extended configuration where the forward bearings 323*a* and 323*b* move laterally out of the lateral bearing cavity 3025 such that at least portions of each of the forward bearings 323*a* and 323*b* extend beyond the respective side surfaces of the forward bolt 3020. For example, in the extended configuration, a portion of outer surface 123.1 of the forward left bearing 323*a* protrudes beyond the left side surface 302.1 of the forward bolt 3020 and a portion of outer surface 123.1 of the forward right bearing 323*b* protrudes beyond the right side surface 302.2 of the forward bolt 3020. A non-limiting example of an extended configuration for the forward bearings 323*a* and 323*b* is shown in FIGS. 36A and 36B. In some embodiments, the forward bearings 323*a* and 323*b* may interface with (i) the short cam pin 3030 (internal to the forward bolt 3020) and (ii) the barrel extension 3060 (external to the forward bolt 3020). For example, when the forward bearings 323*a* and 323*b* are in the internal configuration (and the retracted configuration for the firearm operating system 3000), the short cam pin 3030 is in a rearward position relative to the forward bearings 323*a* and 323*b* such that the bearings interface with a forward portion of the short cam pin 3030 (i.e., near or adjacent to the forward surfaces 3031*a* and 3031*b*) and/or with the rear surfaces 3062*a* and 3062*b* of the barrel extension 3060 (external to the forward bolt 3020). In other words, when the firearm operating system 3000 is in the retracted configuration and the forward bolt 3020 is in a rear position relative to the barrel extension 3060 (i.e., the two lugs 3021.1 are offset rearward from and do not engage the corresponding recesses 3071 of the chamber washer 3070), the rear surfaces 3062*a* and 3062*b* of the barrel extension 3060 constrict and press the forward bearings 323*a* and 323*b* inward to the internal configuration. For example, rear surface 3062*a* presses against bearing 323*a* and rear surface 3062*b* presses against bearing 323*b*.

In some embodiments, multiple actions occur that cause the firearm operating system 3000 to move from the retracted configuration to the deployed configuration. The forward bolt 3020 must be sufficiently forward relative to the long cam pin 3040 such that rear bearing 323*c* (located in upper bearing cavity 3028) interfaces with flat underside portion 3041 of the long cam pin 3040. In such a condition, forward momentum of the components (i.e, the forward bolt 3020, the carrier 3050, etc.) and/or pressure from at least one buffer spring causes the short cam pin 3030 to begin moving forward relative to the forward bolt 3020 (via rear retaining pin 3126*b*). The at least one buffer spring may include a left buffer spring 3601 and/or a right buffer spring 3602. For example, in some embodiments, the left buffer spring 3601 presses forward on inner face 3052*c* of left buffer hole 3052*a* of the carrier 3050. Similarly, the right buffer spring 3602 may press forward on inner face 3052*d* of left buffer hole 3052*b* of the carrier 3050. Due to the location relative to the long cam pin 3040, forward motion of the short cam pin 3030 causes rear bearing 323*c* to move across rear edge 3034.1 of the upper recess 3034 as the short cam pin 3030 moves forward relative to the forward bolt 3020 (i.e., the rear bearing 323*c* moves upward). The forward bolt 3020 is held in position and does not move forward because the forward bolt 3020 is seated such that lugs 3021.1 engage the corresponding recesses 3071 of the chamber washer 3070 and/or the beveled surfaces 3203 at the forward face 3201 engage corresponding surfaces of the chamber washer 3070. The forward motion of the short cam pin 3030 relative to the forward bolt 3020 also causes the forward bearings 323*a* and 323*b* to move from the internal configuration to the extended configuration. In addition to the forward bolt 3020 moving forward relative to the barrel extension 3060, the short cam pin 3030 moves forward relative to the forward bolt 3020. These actions may occur approximately simultaneously or the movement of the forward bolt 3020 relative to the barrel extension 3060 may occur first. Movement of the forward bolt 3020 relative to the barrel extension 3060 aligns recess 3061*a* with bearing 323*a* and recess 3061*b* with bearing 323*b* (i.e., such that bearings 323*a* and 323*b* are no longer restricted by rear surfaces 3062*a* and 3062*b*). Forward motion the short cam pin 3030 relative to the forward bolt 3020 causes left c to press against bearing 323*a* and right ramp surface 3032*b* to press against bearing 323*b* such that the forward bearings 323 move outward from the internal configuration to the extended configuration such that bearing 323*a* moves into recess 3061*a* and bearing 323*b* moves into recess 3061*b*.

Figure 32:
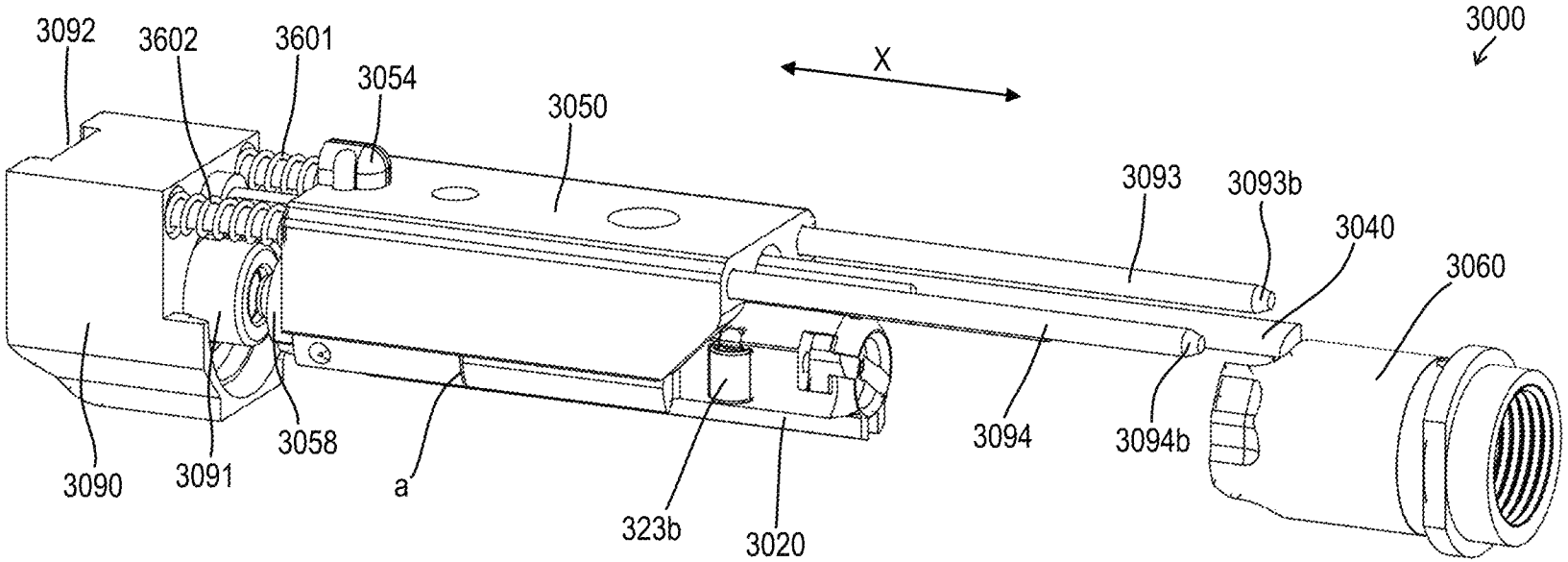
FIG. 32 is a right perspective view of the firearm operating system of FIG. 29.
Figure 33:
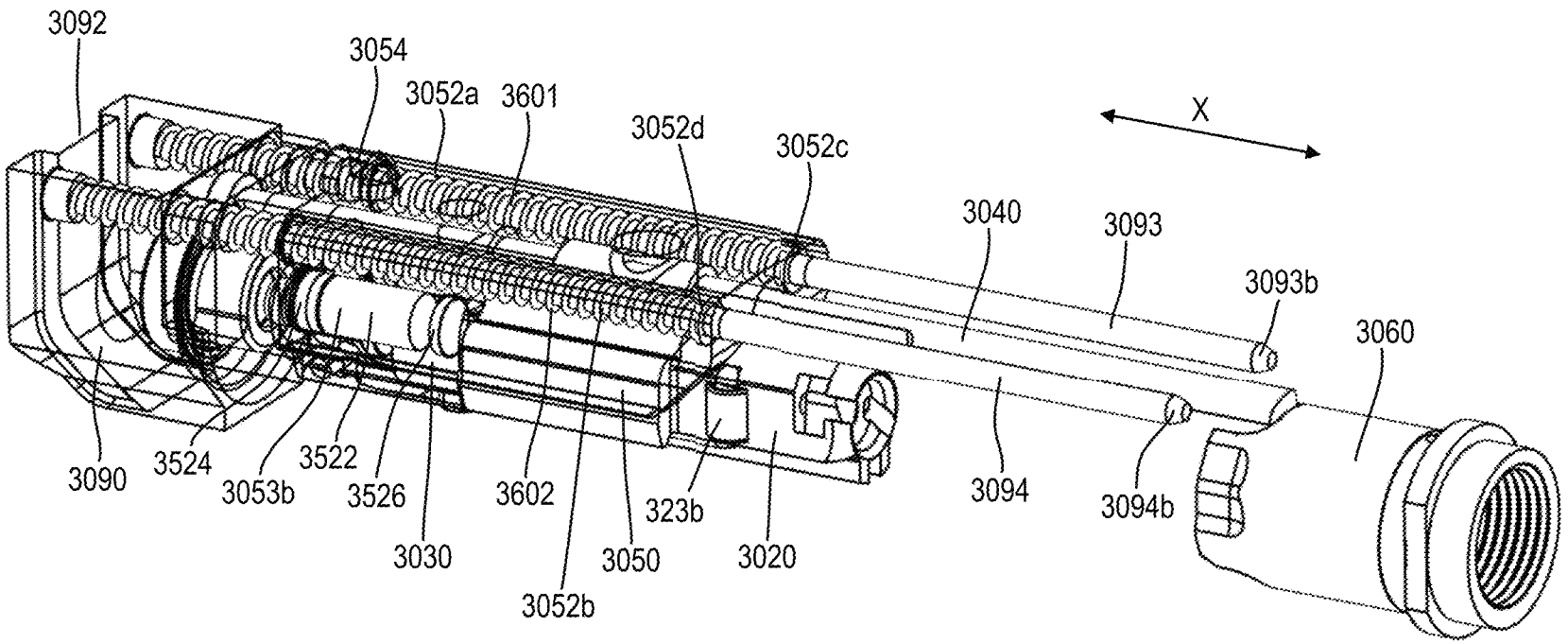
FIG. 33 is a right perspective view of the firearm operating system of FIG. 29.

Unlike many conventional firearms that include a single buffer spring located in a buffer tube as part of a stock located rearward of the lower receiver 10, the firearm operating system 3000 may include at least one buffer spring located within the upper receiver 33 (or upper receiver 30) and/or directly above the lower receiver 10. As shown in FIGS. 32 and 33, the firearm operating system 3000 may include the left buffer spring 3601 and/or the right buffer spring 3602 where these spring(s) extend from within the rear member 3090 to a portion of the bolt assembly. In some embodiments, the spring(s) extend to an internal step (inner faces 3052*c*, 3052*d*) of the carrier 3050. The spring(s) may be compressed when the carrier 3050 moves rearward such that the spring(s) constantly push the carrier 3050 toward a forward end of the firearm 1.

Figure 40A:
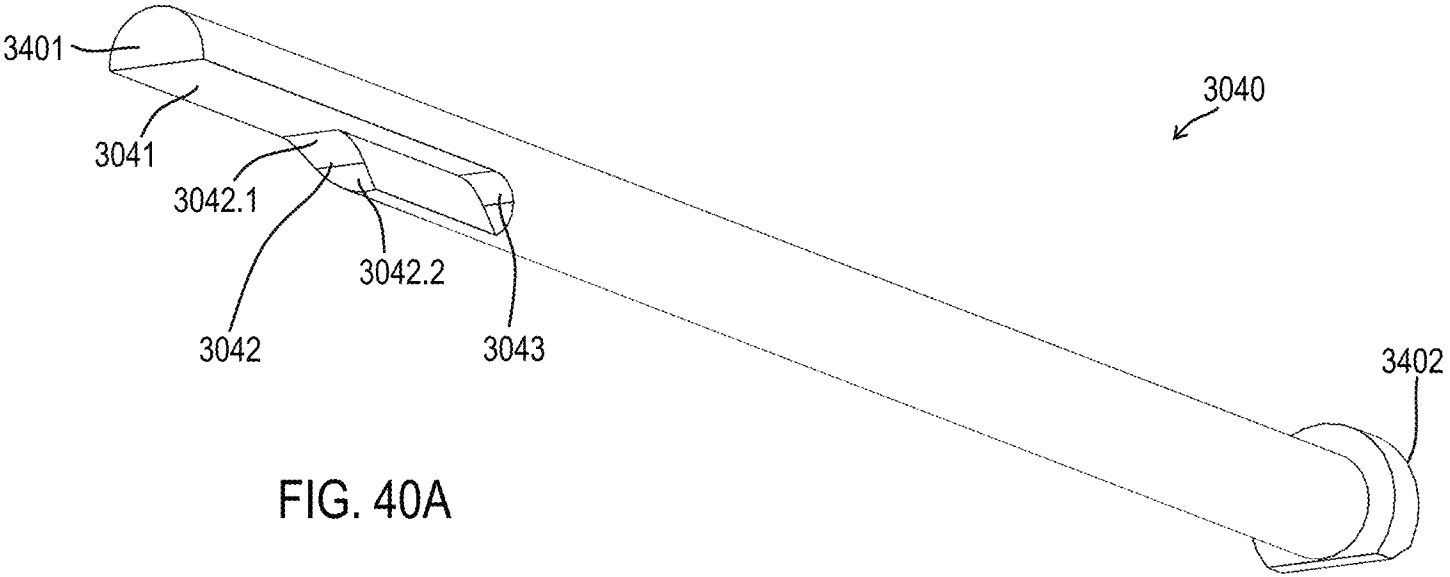
FIG. 40A is a bottom perspective view of a long cam pin of the firearm operating system of FIG. 29.
Figure 40B:
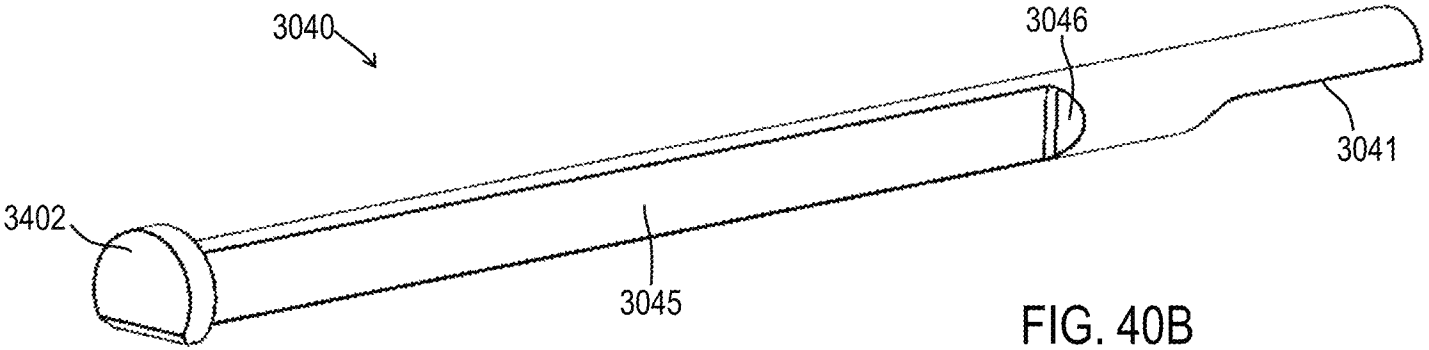
FIG. 40B is a top perspective view of the long cam pin of FIG. 39A.

The rear bearing 323*c* may also have an internal configuration and an extended configuration such that movement of the rear bearing 323*c* is controlled by the short cam pin 3030 and the long cam pin 3040. The upper bearing cavity 3028 (of the forward bolt 3020), which holds the rear bearing 323*c*, is disposed adjacent to (i.e., immediately underneath) the long cam pin cavity 3026 of the forward bolt 3020. When the firearm operating system 3000 is in the retracted configuration and the short cam pin 3030 is in a rear position relative to the forward bolt 3020 (i.e., when the forward bearings 323*a* and 323*b* interface with the forward surfaces 3031*a* and 3031*b* of the short cam pin 3030), the upper recess 3034 of the short cam pin 3030 is aligned with the upper bearing cavity 3028 such that the rear bearing 323*c* falls into the upper recess 3034 (i.e., the internal configuration). The rear bearing 323*c* is forced to remain in the internal configuration during some functions of the firearm operating system 3000. For example, when the rear bearing 323*c* interacts with any portion of the long cam pin 3040 other than the flat underside portion 3041 (i.e., anything between the interface surface 3042 and the aft end 3402 of the long cam pin 3040) the long cam pin 3040 bears against outer surface 123.1 of the rear bearing 323*c* and retains the rear bearing 323*c* within the upper recess 3034 (i.e., the internal configuration). This internal configuration is maintained for all movement of the forward bolt 3020 rearward away from chamber (rearward movement due to (i) manual operation of the charging handle 32 and/or bolt release or (ii) cycling of the firearm 1 after firing a projectile) because the aft end 3402 of the long cam pin 3040 bears against the rear member 3090 (see FIGS. 32, 33, and 38). In some cases, rearward movement of the forward bolt 3020 relative to the long cam pin 3040 will cause the rear bearing 323*c* to press against the interface surface 3042, which will stop motion of the forward bolt 3020 and/or will force the rear bearing 323*c* downward into the upper bearing cavity 3028 and into the upper recess 3034 of the short cam pin 3030 (if the short cam pin 3030 is in the appropriate position relative to the forward bolt 3020). As shown in FIG. 40A, in some embodiments, the interface surface 3042 may include a first portion 3042.1 and a second portion 3042.2. In some cases, the first portion 3042.1 is curved and the second portion 3042.2 is flat.

When the forward bolt 3020 is located sufficiently forward relative to the long cam pin 3040 such that the flat underside portion 3041 (i.e., anything between the interface surface 3042 and the forward end 3401 of the long cam pin 3040) is aligned with the rear bearing 323*c*, forward motion of the short cam pin 3030 relative to the forward bolt 3020 causes the rear bearing 323*c* to move upward due to an interaction with rear edge 3034.1 (see FIG. 39A) of the upper recess 3034 (i.e., the rear bearing 323*c* protrudes at least partially out of upper bearing cavity 3028 into the space adjacent to the flat underside portion 3041 of the long cam pin 3040). In some embodiments, as shown in FIG. 39A, the upper recess 3034 is not symmetric such that the rear edge 3034.1 has a gradual transition into the upper surface of the short cam pin 3030 (see also FIG. 5C showing rear edge 1034.1 of the upper recess 1034, which may be similar to recess 3034). This gradual transition facilitates movement of the rear bearing 323*c*, as described above.

Figure 35:
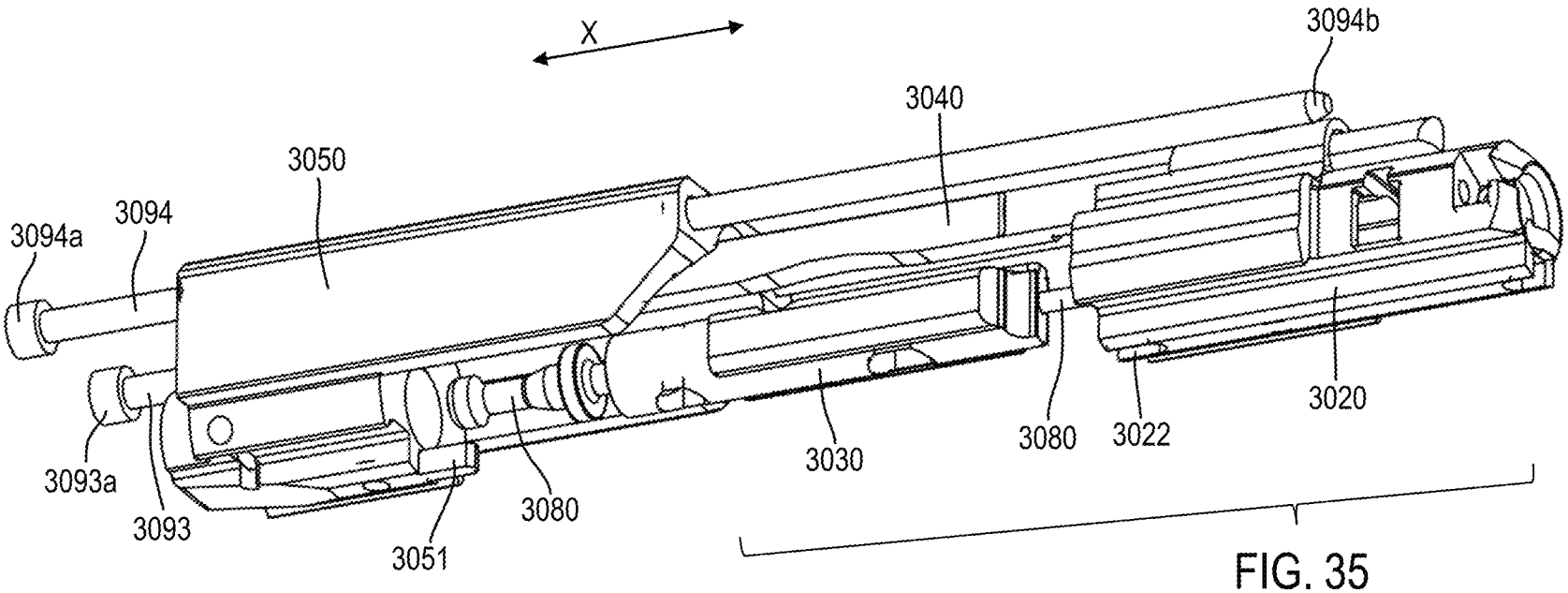
FIG. 35 is an exploded right partial perspective view of the firearm operating system of FIG. 29.
Figure 37A:
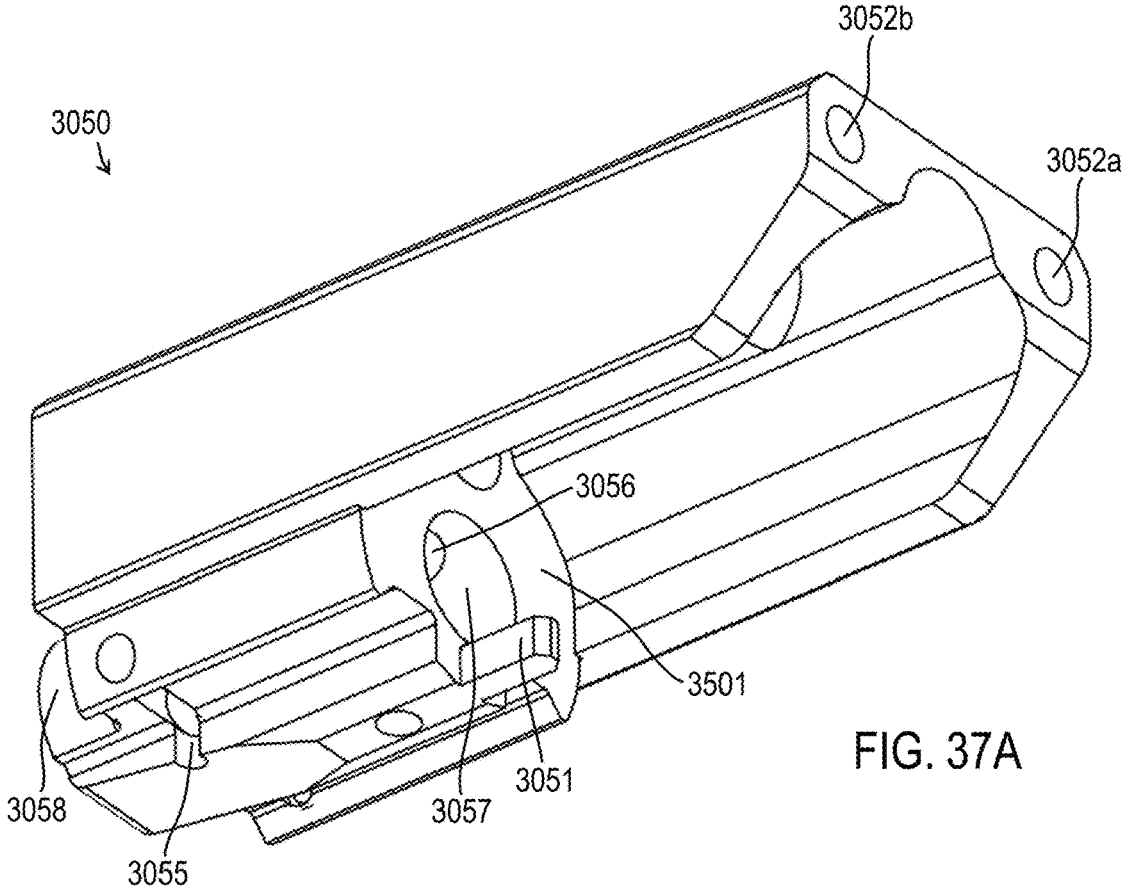
FIG. 37A is a front right perspective view of a carrier of the firearm operating system of FIG. 29.
Figure 37B:
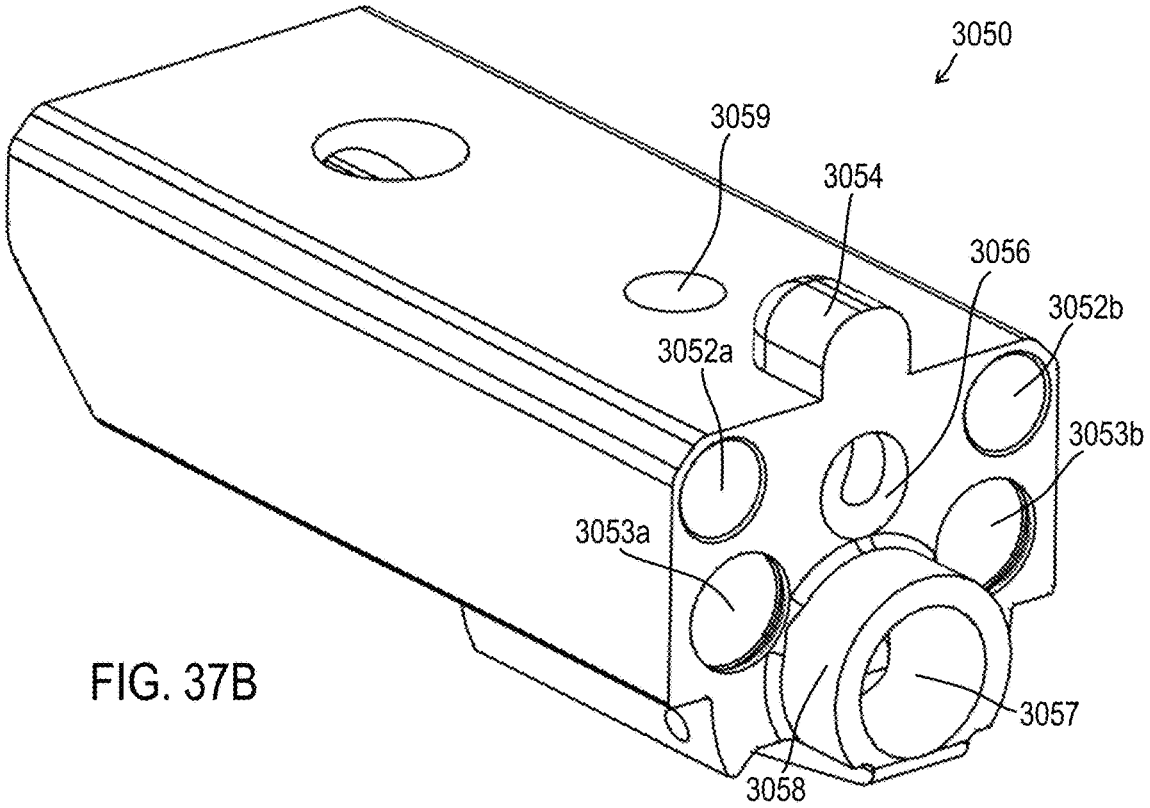
FIG. 37B is a rear left perspective view of the carrier of FIG. 37A.
Figure 37C:
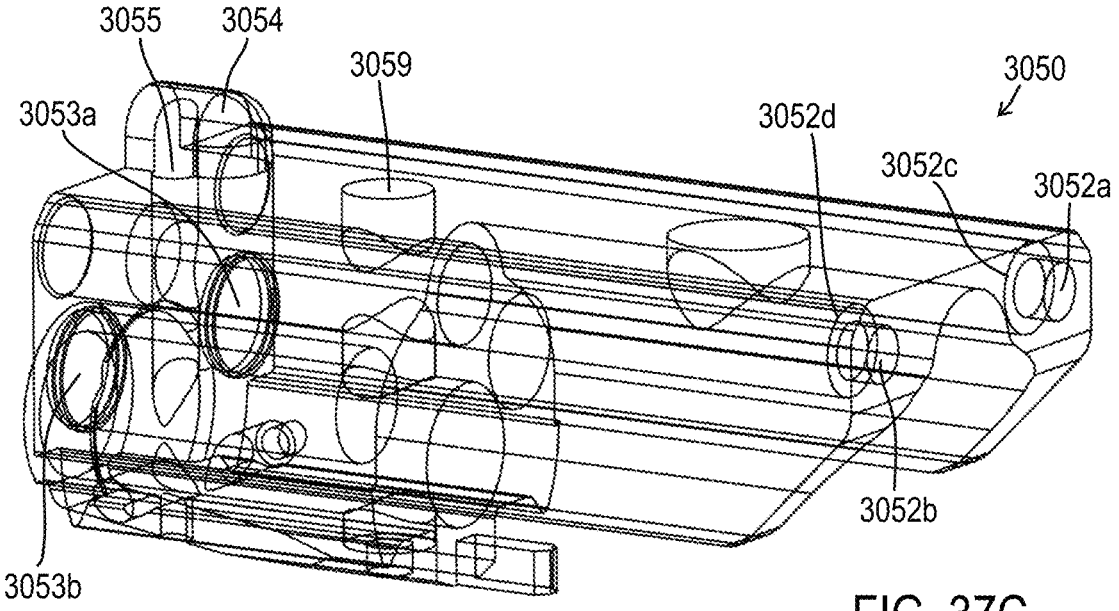
FIG. 37C is a rear left perspective view of the carrier of FIG. 37A.

In some embodiments, the lower rear cavity 3022 of the forward bolt 3020 interacts with a forward protrusion 1051 of the carrier 105 (see FIGS. 35, 36B, and 37A). The forward motion of the short cam pin 3030 relative to the forward bolt 3020 (movement of the firearm operating system 3000 to the deployed configuration, as described above) may also cause the forward bolt 3020 and the carrier 3050 to move closer to one another thus reducing gap a between the aft face 3202 of the forward bolt 3020 and the forward face 3501 of the carrier 3050. When gap a is reduced, the forward protrusion 3051 of the carrier 3050 extends deeper into the lower rear cavity 3022 of the forward bolt 3020. In some embodiments, the forward bolt 3020 and the carrier 3050 are configured such that the forward protrusion 3051 at least partially engages the lower rear cavity 3022 at all times (i.e., including for a maximum value of gap a) such that a hammer for a trigger group of the firearm 1 interacts with an approximately continuous surface on the underside of the forward bolt 3020 and the carrier 3050.

After a cartridge 2 is fired, the mechanisms described above cause a delay before the bolt assembly (the forward bolt 3020, short cam pin 3030, the carrier 3050 and other related components) can move rearward away from the chamber (in the X-direction). In particular, the forward bearings 323*a* and 323*b* press against the ramped surface on the rear side of the recesses 3061*a* and 3061*b* of the barrel extension 3060, respectively. In other words, bearing 323*a* presses against the ramp located between recess 3061*a* and rear surface 3062*a* and bearing 323*b* presses against the ramp located between recess 3061*b* and rear surface 3062*b* (see FIG. 41, also see FIGS. 8 and 9 illustrating barrel extension 106 which may be similar to barrel extension 3060). These ramps of the barrel extension 3060 may be linear (flat) and/or may be curved. In some cases, the geometry of these ramps may be designed (along with the geometry of the bearings 323) to determine the distance, time, rate, etc. of the movement of the bearings 323 after the cartridge 2 has been fired. The interaction between these ramps of the barrel extension 3060 and the forward bearings 323*a* and 323*b* causes the bearings 323*a* and 323*b* to move inward (toward the interior of the lateral bearing cavity 3025) and press against the left and right ramp surfaces 3032*a* and 3032*b* of the short cam pin 3030 (and/or against the curved surface in between the forward surfaces 3031*a*, 3031*b* and the ramp surfaces 3032*a*, 3032*b*). In some cases, in addition to contacting (i) ramp surface 3032*a* of the short cam pin 3030 and (ii) the ramp of the barrel extension 3060 (as described above), the bearing 323*a* also contacts inner surface 3025.2 of the lateral bearing cavity 3025, which is shown in FIG. 36A (see also FIG. 4B illustrating inner surface 1025.2 of the lateral bearing cavity 1025 which may be similar). Accordingly, after sufficient force is applied to the left and right ramp surfaces 3032*a* and 3032*b*, the short cam pin 3030 moves rearward relative to the forward bolt 3020 due to the force applied between the ramps of the barrel extension 3060 and the forward bearings 323*a* and 323*b*, which causes the firearm operating system 3000 to move from the deployed configuration to the retracted configuration. In some embodiments, the barrel extension 3060 includes a plurality of flat portions on an outer surface thereof to facilitate an interface with a tool, such as a wrench (see FIGS. 32 and 33). In some cases, the barrel extension 3060 is an integral component of the barrel 50.

In some embodiments, the barrel extension 3060 is removably attached to the barrel 50 while in other embodiments, the barrel extension 3060 is integral or permanently attached to the barrel 50. For embodiments where the barrel extension 3060 is removably attached to the barrel 50, the barrel extension 3060 may be threaded onto the barrel 50, press-fit on the barrel 50, pinned to the barrel 50, and/or attached in any other appropriate way. Removable attachment of the barrel extension 3060 allows a barrel extension 3060 to be replaced if/when wear occurs to one or both of the ramps located between recesses 3061 and the rear surfaces 3062.

As the bolt assembly (the forward bolt 3020, short cam pin 3030, the carrier 3050 and other related components) begins moving rearward away from the chamber (as described above), the rear bearing 323*c* (disposed within the upper bearing cavity 3028 of the forward bolt 3020) approaches or reaches the interface surface 3042 of the long cam pin 3040. The interaction with the interface surface 3042 may cause the rear bearing 323*c* to move downward. However, downward movement of the rear bearing 323*c* is only possible when the upper recess 3034 of the short cam pin 3030 is located adjacent to the rear bearing 323*c*. In other words, if the short cam pin 3030 is in the forward position relative to the forward bolt 3020 (i.e., when the firing pin 3080 is functional, as described above), the rear bearing 323*c* cannot move downward thus preventing rearward movement of the bolt assembly because the rear bearing 323*c* presses against the interface surface 3042 of the long cam pin 3040. As described above, firing a cartridge causes bearings 323*a*, 323*b* to press left and right ramp surfaces 3032*a*, 3032*b*, respectively, causing the short cam pin 3030 to move rearward relative to the forward bolt 3020 and aligning the upper recess 3034 with the rear bearing 323*c*. After the rear bearing 323*c* enters upper recess 3034, the rear bearing 323*c* can move under/past interface surface 3042 of the long cam pin 3040 thus allowing the bolt assembly to move further rearward. The interface between the long cam pin 3040 and the rear bearing 323*c* locks the firearm operating system 3000 in the retracted configuration where the short cam pin 3030 is in the rearward position relative to the forward bolt 3020 because the outer surface 123.1 of the rear bearing 323*c* bears against an underside of the long cam pin 3040 (i.e., anything between the interface surface 3042 and the aft end 3402) to retain the rear bearing 323*c* within the upper recess 3034.

As shown in the drawings, the carrier 3050 may be shorter than carrier 105 and carrier 2050. Accordingly, although not required, it may be advantageous in some embodiments to include at least one cavity for removable weight(s) in the carrier 3050. For example, the carrier 3050 may include a left weight cavity 3053*a* and a right weight cavity 3053*b* (see FIGS. 33, 34, 37B, and 37C). In some embodiments, the left weight cavity 3053*a* may include a left weight 3521, a left weight retainer/bumper pad 3523, and/or a left front bumper 3525 (see FIG. 34). Similarly, the right weight cavity 3053*b* may include a right weight 3522, a right weight retainer/bumper pad 3524, and/or a right front bumper 3526 (see FIG. 33). The weights 3521, 3522 may be steel, tungsten, tungsten carbide, or any other appropriate material. The weights 3521, 3522 (and other related components) may be shorter than the length of the cavities 3053*a*, 3053*b* such that, in some cases, movement of the weights 3521, 3522 results in a "dead blow" effect. The dead blow effect reduces recoil or rebound of the firearm operating system 3000 and minimizes the potential damage to the various components including the carrier 3050 due to the impacts when moving in the forward or rear direction (parallel to the X-direction).

In some embodiments, the firearm operating system 3000 includes a rear member 3090. As shown in FIGS. 30 and 32-34, the rear member 3090 may be located rearward of the carrier 3050. In some embodiments, the rear member 3090 includes a feature for attenuating impact on a forward side and a feature for interfacing with the lower receiver 10 on a rear side. The channel 3092 is an example of a feature capable of interfacing with the lower receiver 10 (i.e., interfacing with the internal rib of the rear insert 12). As one example, for attenuating impact and/or vibration, the rear member 3090 includes an attenuation member 3091 (see FIGS. 32 and 38). The attenuation member 3091 may be an integral portion of the rear member 3090 or may be a separate component that is inserted into opening 3099 on the forward side of the rear member 3090 (see FIG. 42A). In some embodiments, the attenuation member 3091 has a cylindrical and/or annular shape that approximately matches the size and/or shape of the rear protrusion 3058 of the carrier 3050 (see FIGS. 32, 37A, and 37B). When the bolt assembly moves rearward (e.g., after firing a cartridge), the carrier 3050 compresses at least one spring (e.g., buffer springs 3601, 3602) and may travel rearward such that the rear protrusion 3058 of the carrier 3050 contacts the attenuation member 3091 to stop rearward movement of the bolt assembly. In some embodiments, the attenuation member 3091 includes polymer, rubber, and/or other compliant materials. The attenuation member 3091 may be a stiff (high durometer) polymer material. The shape of the rear protrusion 3058 and the attenuation member 3091 may be configured to allow for clearance of the rear end 3802 of the firing pin 3080. Such a configuration means that the rear end 3802 of the firing pin 3080 may protrude beyond the rearmost surface of the rear protrusion 3058 of the carrier 3050 but will not be contacted due to an impact between the rear protrusion 3058 and the attenuation member 3091.

Figure 38:
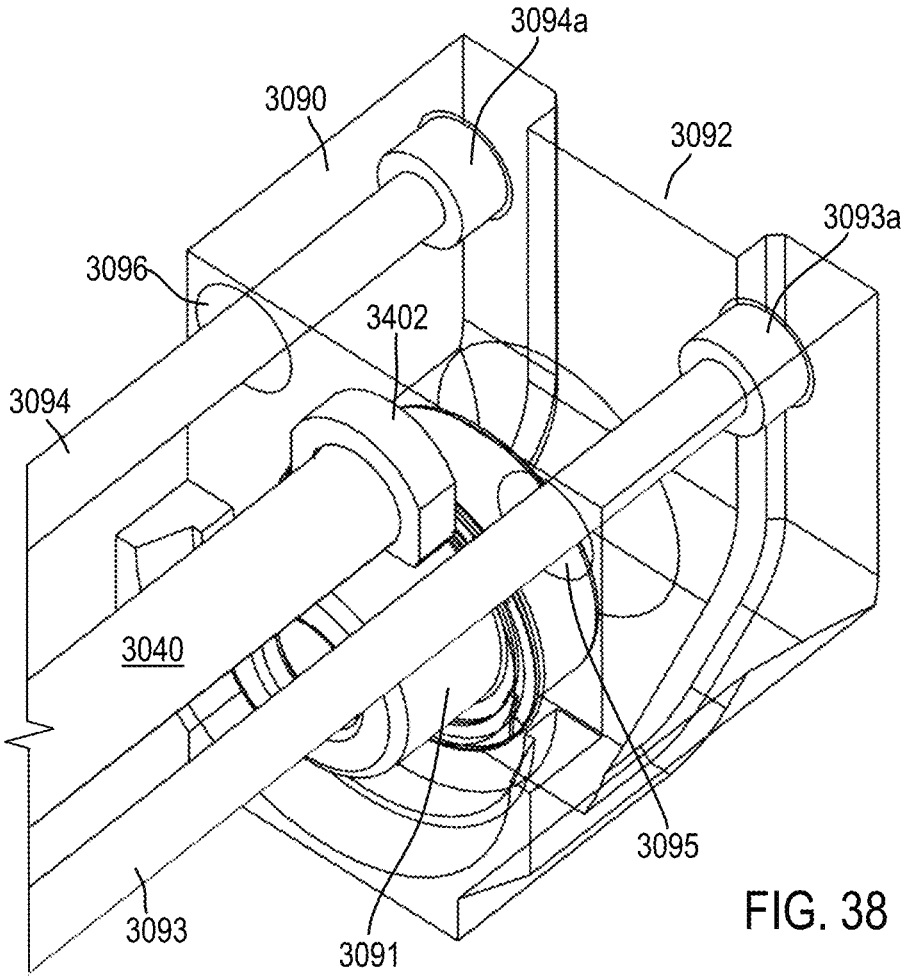
FIG. 38 is a top perspective view of a rear member of the firearm operating system of FIG. 29.

The rear member 3090 may include a blind hole for securing a guide rod for each buffer spring. For example, as shown in FIG. 38, the rear member 3090 may include a first blind hole 3095 to accommodate a first guide rod 3093 and a second blind hole 3096 to accommodate a second guide rod 3094. In some embodiments, the first blind hole 3095 and the first guide rod 3093 are located on a left side of the firearm operating system 3000 while the second blind hole 3096 and the second guide rod 3094 are located on a right side of the firearm operating system 3000. In some embodiments, the blind holes 3095, 3096 and the first guide rods 3093, 3094 are arranged to be parallel to the X-direction. Each guide rod may include a head at a rear end thereof that is inserted into the respective blind hole (head 3093*a* of the first guide rod 3093 and head 3094*a* of the second guide rod 3094). The forward end of each rod may include tapered or partially conical portion. For example, the first guide rod 3093 may include conical portion 3093*b* and the second guide rod 3094 may include conical portion 3094*b*. In some embodiments, the upper receiver 33 (or upper receiver 30) includes corresponding features (such as at least one cavity) to engage and secure the conical portion 3093*b* and/or the conical portion 3094*b*.

The guide rods 3093, 3094 may locate the buffer springs 3601, 3602 and may guide the movement of the bolt assembly (e.g., in the X-direction). In particular, the first guide rod 3093 may be configured to pass through left buffer hole 3052*a* of the carrier 3050 such that the left buffer spring 3601 is compressed along the first guide rod 3093 between (i) head 3093*a* of the first guide rod 3093 and (ii) inner face 3052*c* of left buffer hole 3052*a* of the carrier 3050. The second guide rod 3094 may be configured to pass through right buffer hole 3052*b* of the carrier 3050 such that the right buffer spring 3602 is compressed along the second guide rod 3094 between (i) head 3094*a* of the second guide rod 3094 and (ii) inner face 3052*d* of right buffer hole 3052*b* of the carrier 3050.

Although the firearm operating system 3000 is illustrated with a configuration and bearings similar to those of firearm operating system 100 (e.g., a pair of forward bearings and a long cam pin), the firearm operating system 3000 may be configured similar to firearm operating system 2000. In other words, the rear member 3090, guide rods 3093, 3094, buffer springs 3601, 3602, and/or other components of the firearm operating system 3000 may be combined with the bearings 2023, the bearing spacer 2040, the vertical cam pin 2271, and/or other components of the firearm operating system 2000.

The components of any of the firearms 1 and firearm operating systems 100, 2000, 3000 described herein may be formed of materials including, but not limited to, thermoplastic, carbon composite, plastic, nylon, steel, aluminum, stainless steel, high strength aluminum alloy, tool steel, titanium, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A firearm operating system configured for a semi-automatic firearm, the firearm operating system comprising:
- a bolt;
- a plurality of bearings disposed at least partially within the bolt;
- a carrier disposed on a rear side of the bolt; and
- a cam pin, wherein:
- the bolt is configured to move in a forward/aft direction relative to the carrier; and
- the cam pin comprises a plurality of surfaces that each correspond to one of the plurality of bearings.

2. The firearm operating system of claim 1, wherein each of the plurality of bearings comprises at least one selected from the group of a cylindrical shape or a spherical shape.

3. The firearm operating system of claim 1, wherein each of the plurality of bearings moves in a radial direction of the bolt.

4. The firearm operating system of claim 1, wherein:
- the plurality of bearings comprises three bearings; and
- the bolt comprises three cavities distributed around a perimeter of the bolt such that each bearing moves relative to the bolt through the respective cavity.

5. The firearm operating system of claim 4, further comprising a retracted bearing configuration and a deployed bearing configuration, wherein:
- in the retracted bearing configuration the bearings are biased toward a center of the bolt and do not extend beyond an outer surface of the bolt; and
- in the deployed bearing configuration the bearings are biased away from the center of the bolt and do at least partially extend beyond the outer surface of the bolt.

6. The firearm operating system of claim 4, wherein each cavity comprises a retaining portion that prevents the bearing from passing entirely through the cavity.

7. The firearm operating system of claim 1, wherein the bolt comprises an extractor and an ejector that are both disposed at a forward face of the bolt.

8. The firearm operating system of claim 7, wherein the bolt comprises a coil spring for the extractor and a coil spring for the ejector.

9. The firearm operating system of claim 1, further comprising a barrel extension comprising a plurality of recesses that each corresponds to one of the plurality of bearings.

10. The firearm operating system of claim 1, wherein each of the forward surfaces is oblique relative to a forward/aft direction of the firearm operating system.

11. A firearm operating system for a semi-automatic firearm, the firearm operating system comprising:

a bolt;

a plurality of bearings disposed at least partially within the bolt; and a plurality of forward surfaces that each corresponds to one of the plurality of bearings, wherein:

the bolt is configured to move in a forward/aft direction relative to other components of the firearm operating system; and movement of the bolt causes the plurality of bearings to move relative to the bolt such that the firearm operating system moves; and each of the forward surfaces is not perpendicular relative to a forward/aft direction of the firearm operating system.

12. The firearm operating system of claim 11, further comprising a cam pin comprising a forward section and a rear section, wherein the cam pin is disposed between the bolt and a carrier.

13. The firearm operating system of claim 12, wherein:

the rear section of the cam pin is disposed within a forward cavity of the carrier; and the forward section of the cam pin interacts with the plurality of bearings.

14. The firearm operating system of claim 11, wherein each of the plurality of bearings comprises at least one selected from the group of a cylindrical shape or a spherical shape.

15. The firearm operating system of claim 11, wherein each of the plurality of bearings moves in a radial direction of the bolt.

16. The firearm operating system of claim 11, wherein:

the plurality of bearings comprises three bearings; and the bolt comprises three cavities distributed around a perimeter of the bolt such that each bearing moves relative to the bolt through the respective cavity.

17. The firearm operating system of claim 11, wherein the bolt comprises an extractor and an ejector that are both disposed at a forward face of the bolt.

18. The firearm operating system of claim 17, wherein the bolt comprises a coil spring for the extractor and a coil spring for the ejector.

19. The firearm operating system of claim 11, further comprising a barrel extension comprising a plurality of recesses that each corresponds to one of the plurality of bearings.

20. The firearm operating system of claim 19, wherein the barrel extension comprises threads for attaching to a barrel.

* * * * *